US006294967B1

(12) United States Patent
Hirai et al.

(10) Patent No.: US 6,294,967 B1
(45) Date of Patent: Sep. 25, 2001

(54) LAMINATED TYPE DIELECTRIC FILTER

(75) Inventors: Takami Hirai, Aichi Pref.; Kazuyuki Mizuno, Tokoname; Yasuhiko Mizutani, Komaki, all of (JP)

(73) Assignee: NGK Insulators, Ltd. (JP)

( * ) Notice: Subject to any disclaimer, the term of this patent is extended or adjusted under 35 U.S.C. 154(b) by 0 days.

(21) Appl. No.: 09/271,177

(22) Filed: Mar. 17, 1999

(30) Foreign Application Priority Data

| | | |
|---|---|---|
| Mar. 18, 1998 | (JP) | 10-068407 |
| Mar. 18, 1998 | (JP) | 10-068408 |
| Mar. 25, 1998 | (JP) | 10-077090 |
| Mar. 31, 1998 | (JP) | 10-085292 |

(51) Int. Cl.[7] ..... H01P 1/20; H01P 7/10

(52) U.S. Cl. ..... 333/202; 333/204; 333/205; 333/219.1

(58) Field of Search ..... 333/202, 204, 333/205, 219.1, 221

(56) References Cited

U.S. PATENT DOCUMENTS

| | | | | |
|---|---|---|---|---|
| 5,612,656 | * | 3/1997 | Sakamoto et al. | 333/204 |
| 5,719,539 | * | 2/1998 | Ishizaki et al. | 333/204 |
| 5,818,313 | * | 10/1998 | Estes et al. | 333/204 |
| 5,894,252 | * | 4/1999 | Oida | 333/202 |

FOREIGN PATENT DOCUMENTS

| | | | | |
|---|---|---|---|---|
| 4-43703 | | 2/1992 | (JP) . | |
| 6-120703 | | 4/1994 | (JP) . | |
| 06283903A | * | 10/1994 | (JP) | 333/204 |
| 7-226602 | | 8/1995 | (JP) . | |

* cited by examiner

*Primary Examiner*—Robert Pascal
*Assistant Examiner*—Patricia T. Nguyen
(74) *Attorney, Agent, or Firm*—Burr & Brown

(57) ABSTRACT

A laminated type dielectric filter including a first stage symmetric type strip line resonator and a last stage symmetric type strip line resonator each having at least two resonating elements arranged to oppose one another via dielectric layers, said resonators being aligned in a direction perpendicular to a stacking direction in which said resonating elements are stacked, an input electrode for coupling the first stage symmetric type strip line resonator to an input terminal, an output electrode for coupling the last stage symmetric type dielectric filter to an output terminal, an earth electrode substantially surrounding an outer surface of the laminated type dielectric filter, plural interlayer earth electrodes connected to the earth electrode, and one or more coupling electrode for coupling said plural symmetric type strip line resonators, said the resonating elements, input electrode, output electrode, interlayer earth electrodes and coupling electrodes are isolated by means of dielectric layers, and electrodes of at least one kind of electrode among the above mentioned electrodes are arranged between adjacent resonating elements such that capacitances between the resonating elements and these electrodes are increased to improve filter characteristics.

35 Claims, 33 Drawing Sheets

LAMINATED TYPE DIELECTRIC FILTER

BACKGROUND OF THE INVENTION

1. Field of the Invention

The present invention relates to a laminated type dielectric filter comprising input electrode, output electrode, earth electrode, coupling electrode and resonance electrodes composing a resonator, said electrodes being laminated with each other with interposing dielectric layers therebetween, and more particularly to a laminated type dielectric filter including a strip line resonator.

2. Related Art Statement

Heretofore, there have been proposed such a laminated type dielectric filter including a strip line resonator in, for instance Japanese Patent Application Publication Kokai Hei 6-120703. FIGS. 1 and 2 illustrate this known laminated type dielectric filter. Upon manufacturing such a laminated type dielectric filter, a plurality of dielectric substrates having various kinds of electrodes formed by conductive patterns applied thereon are stacked one another, and after covering upper and lower surfaces and side walls of a stacked assembly except for portions corresponding to input and output electrodes with conductive layers, the assembly is heated to sinter the dielectric substrates. Therefore, in the finally manufactured filter, interfaces between successive dielectric layers are not existent and the various kinds of electrodes are embedded within a dielectric block at given relative positions. However, for the sake of explanation, in the present specification, the dielectric block is shown to be divided into a plurality of dielectric layers each having various kinds of electrodes formed on surfaces thereof as shown in FIG. 1. FIG. 2 depicts an outer appearance of the sintered body of the laminated type dielectric filter.

The known laminated type dielectric filter shown in FIG. 1 comprises first to fourth dielectric layers 1–4. On outer surfaces of the first and fourth dielectric layers 1 and 5 are formed first and second earth electrodes 5 and 6, and on an inner surface of the first dielectric layer 1 are formed an input electrode 7 and an output electrode 8 such that one ends of these electrodes are exposed at side walls of the laminated type dielectric filter. As shown in FIG. 2, these input and output electrodes 7 and 8 are connected to input and output terminals 7*a* and 8*a*, respectively provided on the side wall of the laminated type dielectric filter.

On a surface of the second dielectric layer 2, are formed resonating elements 9 and 10 constructed by strip line electrodes of strip line resonators such that one ends of these resonating elements are connected to an earth electrode 11 (refer to FIG. 2) including the above mentioned earth electrodes 5 and 6 at the side wall of the laminated type dielectric filter, and the other ends of the resonating elements are opened.

Furthermore, on a surface of the third dielectric layer 3 is formed a coupling electrode 12 such that the coupling electrode is overlapped with the resonating elements 9 and 10 via the dielectric layer 3, said coupling electrode coupling the resonating elements inductively. On the first and third dielectric layers 1 and 3 are formed interlayer earth electrodes 13–16 such that these electrodes are overlapped with the open ends of the resonating elements 9 and 10. Ends of these interlayer earth electrodes 13–16 are connected to the earth electrode 11 at the side wall of the laminated type dielectric filter.

In such a laminated type dielectric filter, there are provided four electrostatic capacitances between the resonating element 9 and the interlayer earth electrodes 13 and 15 as well as between the resonating element 10 and the interlayer earth electrodes 14 and 16, and these electrostatic capacitances are connected in parallel with the resonating elements 9 and 10. Therefore, a resonance frequency can be lowered without decreasing a length of the resonating elements.

In the known laminated type dielectric filter, electrostatic capacitance obtained between the coupling electrode 12 and the resonating elements 9 and 10 is connected in parallel with the inductance due to the electromagnetic coupling between the adjacent resonators, and thus a parallel resonance circuit of the electrostatic capacitance and inductance is connected between the adjacent resonators. Since an impedance of this parallel resonance circuit changes from inductive to capacitive at a parallel resonant frequency, the coupling between the resonators may be inductive or capacitive by adjusting the electrostatic capacitances formed between the coupling electrode and the adjacent resonators, respectively. In case of the inductive coupling, it is possible to obtain a filter having an attenuation peak on a higher frequency side to the pass band, and when the electrostatic capacitance is increased, the pass band is narrowed. In the capacitive coupling, it is possible to obtain a filter having an attenuation peak on a lower frequency side to the pass band, and when the electrostatic capacitance is increased, the pass band is widened. When a center frequency of the filter is lowered, the inductive coupling between the adjacent resonators becomes stronger, and therefore in the filter having the attenuation peak on the lower frequency side, the pass band is narrowed, while in the filter having the attenuation peak on the higher frequency side, the pass band is broadened. However, in the latter case, the pass band can be adjusted by increasing the electrostatic capacitance.

In the laminated type dielectric filter having the strip line resonators, there are provided the input electrode 7 for connecting the input terminal 7*a* to the first stage resonator 9 by means of the capacitance and the output electrode 8 for connecting the final stage resonator 10 to the output terminal 8*a* via the capacitance. In such an input and output system by means of the capacitance, the input impedance and output impedance are determined by the capacitances, and therefore by increasing the capacitances, the input impedance and output impedance can be adjusted over a wider range and it is possible to realize a required filter easily.

In accordance with the miniaturization and variety of wireless communication systems, the known laminated type dielectric filter illustrated in FIG. 1 is also required to be small in size and light in weight, and further it is required to manufacture filters having various frequency band properties. For instance, the laminated type dielectric filter is installed within a portable type telephone set. Since the portable type telephone set has been earnestly required to be small in size and light in weight, a further small laminated type dielectric filter is required for the portable type telephone set. In order to make the laminated type dielectric filter be small in size and light in weight, those electrodes are required to be small in size, and thereby the overlapping parts between the electrodes have small areas inevitably, which results in the capacitances between the resonating elements 9, 10 and the interlayer earth electrodes 13 to 16 being small, the capacitances between the resonating elements 9, 10 and the coupling electrode 12 being small, and the capacitances between the resonating elements 9, 10 and the input and the output electrodes 7, 8 being small. Thus, a desired frequency characteristics can not be obtained. If the filter is made be small in size, the resonating elements 9, 10 are small in size, and thereby the capacitances between the resonating elements and the interlayer earth electrode is decreased and the resonating frequency is increased.

Moreover, if the coupling electrode 12 is small in size, the capacitances between the resonating elements 9, 10 and the coupling electrode 12 is decreased, so that when the coupling between the resonators is capacitive, the pass band of the filter is too narrowed, and when the coupling is inductive, the pass band of the filter is too broadened. Thus, an adjustable range of the pass band becomes very narrow and the laminated type dielectric filter having a required pass band width could not be obtained.

Furthermore, if the capacitances between the resonating elements 9, 10 and the input and the output electrodes 7, 8 are small, a return loss could not be large, so that it is difficult to obtain the filter having a low insertion loss.

As above mentioned, in accordance with the miniaturization and variety of the wireless communication systems, the conventional laminated type dielectric filter shown in FIG. 1 has been required to be small in size and have various pass bands. In order to satisfy a requirement of decreasing the pass band frequency without increasing a size and a configuration of the filter, the capacitances between the resonating elements 9, 10 and the interlayer earth electrodes 13 to 16 have to be further increased. If the capacitances between the resonating elements 9, 10 and the interlayer earth electrodes 13 to 16 can be increased, the laminated type dielectric filter having a higher frequency can be easily obtained.

In order to increase the capacitances between the resonating elements 9, 10 and the interlayer earth electrodes 13 to 16, it has been proposed to increase surface areas of overlapping parts of these electrodes. In order to realize it, a width of the open ends of the resonating elements 9, 10 overlapping the interlayer earth electrodes 13 to 16 has to be increased as shown in FIG. 3. However, since this method of increasing the overlapping surface area between the resonating elements 9, 10 and the interlayer earth electrodes 13 to 16 has a limitation, the frequency band can be adjusted only within a narrow range.

Moreover, in another method of increasing the capacitances between the resonating elements 9, 10 and the interlayer earth electrodes 13 to 16, a thickness of the dielectric layers 2, 3 provided therebetween is decreased. However, if the dielectric layers have a small thickness, manufacturing cost of the laminated type dielectric filter might be increased due to dielectric breakdown, decrease in physical strength, and difficulty in handling during manufacturing processes.

Furthermore, JP A 7-226602 proposes another method of increasing the capacitances between the resonating elements 9, 10 and the input and the output electrodes 7, 8, in which a resonating element of an input stage strip line resonator is sandwiched with two input electrodes and a resonating element of an output stage strip line resonator is sandwiched with two output electrodes. However, when interlayer earth electrodes are provided for reducing the filter size and a coupling electrode is provided for improving attenuation characteristics, there is no sufficient space for arranging the two input electrodes and the two output electrodes on respective sides of the resonating elements.

Moreover, JP A 4-43703 discloses a symmetric type strip line resonator. In such a symmetric type strip line resonator, capacitances between resonating elements and interlayer earth electrodes can be increased by stacking the resonating elements in a laminated fashion. In this known filter, however, in order to resonate a pair of resonating elements composing the symmetric type strip line resonator at the same frequency with the same phase, these resonating elements are connected each other via a conductor passing through a through hole formed therebetween. It is, however, difficult to manufacture a symmetric type strip line resonator having such a structure, which results in a high cost.

The above mentioned JP A 4-43703 suggests to constitute a laminated type dielectric filter by aligning plural symmetric type strip line resonators in a direction perpendicular to the stacking direction. However, no layer except for a dielectric layer is arranged between a pair of resonating elements, and there are no teaching how to constitute a practical laminated type dielectric filter.

SUMMARY OF THE INVENTION

It is an object of the present invention to provide, by employing the above symmetric type strip line resonators, a laminated type symmetric dielectric filter, in which the capacitances between resonating elements and various electrodes can be increased without increasing surface areas of these electrodes as well as reducing a thickness of dielectric layers, thereby the filter can be made small in size and light in weight.

It is another object of the present invention to provide, by employing the above symmetric type strip line resonators, a laminated type symmetric dielectric filter, in which the capacitances between resonating elements and various electrodes can be increased without increasing surface areas of these electrodes as well as reducing a thickness of dielectric layers, whereby an operating frequency of the filter can be decreased and an insertion loss can reduced.

It is another object of the present invention to provide, by employing the above symmetric type strip line resonators, a laminated type symmetric dielectric filter, in which the capacitances between resonating elements and interlayer earth electrodes can be increased without increasing surface areas of these electrodes as well as reducing a thickness of dielectric layers, whereby a pass band width of the filter can be adjusted over a wide frequency range from a lower frequency, and thus the filter can satisfy various requirements.

It is another object of the present invention to provide, by employing the above symmetric type strip line resonators, a laminated type symmetric dielectric filter, in which the capacitances between resonating elements and coupling electrodes can be increased without increasing surface areas of these electrodes as well as reducing a thickness of dielectric layers, whereby a pass band width of the filter can be adjusted over a wide frequency range, and thus the filter can satisfy wide variety of requirements.

It is still another object of the present invention to provide a laminated type symmetric dielectric filter, in which an impedance of an input stage symmetrical strip line resonator and an impedance of an output stage symmetrical strip line resonator can be increased, whereby its adjustable range can be widened, and miniaturization, lower frequency, lower insertion loss and high return loss of the filter can be realized.

According to the invention, a laminated type dielectric filter comprises:

a resonator means including a first stage symmetric type strip line resonator and a last stage symmetric type strip line resonator, each of said resonators having at least two resonating elements which are stacked each other with interposing a dielectric layer therebetween, and said resonators being aligned in a direction perpendicular to a stacking direction in which said resonating elements are stacked;

an input means having an input terminal coupled with said first stage symmetric type strip line resonator;

an output means having an output terminal coupled with said last stage symmetric type strip line resonator;

an earth electrode substantially surrounding an outer surface of the laminated type dielectric filter;

plural interlayer earth electrodes connected to the earth electrode; and a coupling electrode coupling said plural symmetric type strip line resonators of the resonator means;

wherein said resonating elements, earth electrode, interlayer earth electrodes, and coupling electrode are mutually separated by means of dielectric layers.

Upon practicing the laminated type dielectric filter according to the present invention, between at least two adjacent resonating elements of respective symmetric type strip line resonators, at least one kind of electrodes selected from the interlayer earth electrode, coupling electrode, input electrode for coupling the input terminal to the first stage symmetric type strip line resonator and output electrode for coupling the last stage symmetric type strip line resonator to the output terminal is arranged with interposing dielectric layers therebetween.

In the laminated type dielectric filter according to the present invention, each of the strip line resonators is composed of a symmetric type strip line resonator including at least two resonating elements opposed to each other via a dielectric layer. Therefore, various kinds of electrodes may be arranged between the two resonating elements, and the capacitances between these electrodes and the resonating elements can be increased. For example, by providing an interlayer earth electrode between the two resonating elements, the capacitances between the resonating elements and the interlayer earth electrode can be increased. Moreover, by providing a coupling electrode between the two resonating elements, capacitances between the coupling electrode and the resonating elements can be increased, and by arranging an input electrode and an output electrode between the two adjacent resonating elements, capacitances between the resonating elements and the input and output electrodes can be increased. Furthermore, two kinds of electrodes selected from the interlayer earth electrode, coupling electrode, input electrode and output electrode may be provided between the two adjacent resonating elements.

Moreover, in the present invention, since the strip line resonator is composed of the symmetric type strip line resonator having plural laminated resonating elements, characteristic impedance of each strip line resonators can be improved and the coupling degree per unit volume can be increased. Consequently, in case of arranging a coupling electrode between the two resonating elements to increase capacitances between the coupling electrode and the resonating elements, a pass band width of the filter can be broadened and narrowed when the coupling between the resonators being capacitive and inductive, respectively. It should be noted that since the capacitances between the coupling electrode and the resonating elements can be easily decreased, the band pass frequency as well as the pass band width can be adjusted over a wide range. Moreover, since without narrowing or broadening the passing band width too much, dimension of the above electrodes can be made small, the filter can be sufficiently made small in size and light in weight.

In an embodiment of the laminated type dielectric filter according to the invention, at least two sets of symmetric type strip line resonators each having at least two resonating elements opposed to each other with interposing a dielectric layer therebetween are aligned in a direction perpendicular to the stacking direction, and interlayer earth electrodes are provided on outer sides of the outermost resonating elements of respective symmetric type strip line resonators, while dielectric layers are interposed between the outermost resonating elements and the interlayer earth electrodes.

In such a laminated type dielectric filter, capacitances are formed between the outermost resonating elements and the interlayer earth electrodes. Thus, without increasing planer dimension of the filter, the capacitances between the resonating elements and the interlayer earth electrodes can be further increased.

In another embodiment of the laminated type dielectric filter according to the present invention, at least two sets of symmetric type strip line resonators each having at least two resonating elements opposed to each other with interposing a dielectric layer therebetween are aligned in a direction perpendicular to the stacking direction, an input electrode for coupling the input terminal to the first stage symmetric type strip line resonator is arranged between two adjacent resonating elements of the first stage symmetric type strip line resonator via dielectric layers, and an output electrode for coupling the last stage symmetric type strip line resonator to the output terminal is arranged between two adjacent resonating elements of the last stage symmetric type strip line resonator by means of dielectric layers.

In such a laminated type dielectric filter according to the present invention, since the input electrode is arranged between the two resonating elements of the first stage symmetric type strip line resonator and the output electrode is arranged between the two resonating elements of the last stage symmetric type strip line resonator, capacitances between the input electrode and the resonating elements and capacitances between the output electrode and the resonating elements can be increased. Furthermore, since the strip line electrodes of the symmetric type strip line resonator are provided in a laminated manner, the characteristic impedance of each strip line electrode can be increased, and thereby the coupling degree per unit volume can be increased and the filter characteristics can be improved.

In a first aspect of the laminated type dielectric filter according to the present invention, at least one of resonating elements composing the above mentioned symmetric type strip line resonator is sandwiched with two interlayer earth electrodes via dielectric layers.

In the laminated type dielectric filter according to such a first aspect of the invention, although all the resonating elements of all the symmetric type strip line resonators may be sandwiched with the interlayer earth electrodes with interposing dielectric layers therebetween, a smaller number of the resonating elements may be sandwiched with interlayer earth electrodes via dielectric layers. In the latter case, another electrodes may be arranged at positions not occupied by the interlayer earth electrodes, and thereby the pass band of the filter can be adjusted.

In the laminated type dielectric filter according to the present invention, since at least one of at least two resonating elements constituting the symmetric type strip line resonator is sandwiched with the interlayer earth electrodes, capacitances between the resonating elements and the interlayer earth electrodes can be increased. Therefore, if the filter has the same dimensions as those of the conventional filter, the resonance frequency can be decreased, and when the filter has the same resonance frequency as that of the conventional filter, the filter size can be decreased. Moreover, since it is easy to decrease the capacitances between the resonating elements and the interlayer earth electrodes, the pass band can be adjusted over a wide frequency range.

In a second aspect of the laminated type dielectric filter according to the present invention, at least one coupling electrode for coupling adjacent symmetric type strip line resonators is sandwiched with resonating elements of these strip line resonators via dielectric layers.

In such a second aspect of the laminated type dielectric filter according to the present invention, the coupling electrode is arranged to oppose the two resonating elements of the adjacent symmetric type strip line resonators via the dielectric layers. Thus, coupling capacitances are added in parallel with the resonators, and capacitances between the coupling electrodes and the resonating elements can be increased. Moreover, since the strip line electrodes of the symmetric type strip line resonator are provided in a laminated manner, the characteristic impedance of each strip line electrode can be increased, and thereby the coupling degree per unit volume can be increased. Therefore, when the resonators are coupled capacitively, the pass band width can be broadened, and when the resonators are coupled inductively, the pass band width can be narrowed. Moreover, since it is easy to decrease the capacitances between the coupling electrode and the resonating elements, the pass band frequency and the pass band width can be adjusted over a wide range. Furthermore, since it is possible to reduce dimension of various kinds of electrodes without narrowing and broadening the pass band width too much, the filter can be sufficiently made small in size and light in weight.

In one embodiment of such a second aspect of the laminated type dielectric filter according to the present invention, two sets of symmetric type strip line resonators each including two resonating elements are provided, and a single coupling electrode for coupling these two resonators is arranged between the two resonating elements of respective resonators with interposing dielectric layers therebetween.

In another embodiment, first, second and third symmetric type strip line resonators each having first, second and third resonating elements are provided side by side, a first coupling electrode for coupling the first and second symmetric type strip line resonators is arranged between the first and the second resonating elements of each of said first and second symmetric type strip line resonators via dielectric layers, and a second coupling electrode for coupling the second and the third symmetric type strip line resonators is arranged between the second and third resonating elements each of said second and third symmetric type strip line resonators via dielectric layers.

In such a laminated type dielectric filter according to the second aspect of the invention, another one or more coupling electrodes may be arranged, through dielectric layers, on a side of at least one of the two resonating elements opposite to said coupling electrode. Thereby, the capacitance connected in parallel with the coupling electrode can be increased, and the pass band width can be adjusted over a wider range.

Although in the above mentioned laminated type dielectric filters according to the first and second aspects of the invention, the input electrode and the output electrode are provided in the input means and the output means, respectively, these input and output electrodes may be dispensed with, and the resonating elements of strip line resonators may be directly connected to the input and output terminals to constitute the L-tap structure.

According to a third aspect of the invention, in the laminated type dielectric filter of said L-tap structure, at least one of plural resonating elements of the first stage strip line resonator is not directly connected to the input terminal.

When at least one of the plural resonating elements of the first stage strip line resonator is not directly connected to the input terminal, an input impedance of the input resonating elements viewed at least from the input terminal can be increased, and thus the input and output impedance can be adjusted over a wide range. Therefore, the adjustment for increasing a return loss can be easily carried out, and the filter can be downsized and the operating frequency and insertion loss of the filter can be lowered. In this case, only one resonating element of the plural resonating elements may be directly connected to the input terminal. Then, the input and output impedance can be adjusted over a much wider range, and the filter can be further downsized and the operating frequency and insertion loss of the filter can be further decreased.

In the laminated type dielectric filter according to the third aspect of the invention, at least one of plural resonating elements of the last stage strip line resonator may not be directly connected to the output terminal. In this case, only one resonating element of the last stage strip line resonator may be directly connected to the output terminal.

It should be noted that according to the present invention, the above mentioned first to third aspects may be combined in various manners. For example, in combining the first and second aspects, the resonating elements of the strip line resonator may be sandwiched with the interlayer earth electrodes and the coupling electrode may be provided between the laminated resonating elements. Furthermore, in combining the first and third aspects, for example, the resonating elements of the strip line resonators may be sandwiched with the interlayer earth electrodes, and only one resonating element of each of the input and output stage strip line resonators may be directly connected to the input and output terminals, respectively. Moreover, in combining the second and the third aspects of the invention, the coupling electrodes may be provided between the laminated resonating elements of the strip line resonators, and only one resonating element of each of the input and output stage strip line resonators may be directly connected to each of the input and output terminals, respectively. Additionally, all the above mentioned first to third aspects may be combined. In this case, for example, the resonating elements of the strip line resonators may be sandwiched with the interlayer earth electrodes, the coupling electrode may be provided between the laminated resonating elements, and only one resonating element of each of the input and output stage strip line resonators may be directly connected to each of the input and output terminals, respectively.

As above mentioned, in combining the second and third aspects, capacitance is formed between the coupling electrodes and the resonating elements of the input stage strip line resonator, and at the same time capacitance is formed between the coupling electrodes and resonating elements of another strip line resonator. In an equivalent circuit, a combined capacitance of these capacitances is connected in parallel with the inductive coupling formed between the resonating elements of the input stage strip line resonator and the resonating elements of said another strip line resonator. Therefore, the coupling degree between the resonators can be adjusted by means of said capacitances, and the laminated type dielectric filter having a desired pass band width can be obtained.

The above capacitances can be easily adjusted by changing overlapping areas between the resonating elements of the input stage strip line resonator and the coupling electrodes and a distance therebetween as well as overlapping areas between the resonating elements of said another strip line resonator and the coupling electrodes and a distance therebetween.

Furthermore, since the combined capacitance of the above coupling adjusting capacitances is connected in parallel with the inductive coupling between the resonating elements, a parallel resonance circuit is equivalently inserted between the adjacent resonating elements.

DETAILED DESCRIPTION OF THE PREFERRED EMBODIMENTS

Figure 4:
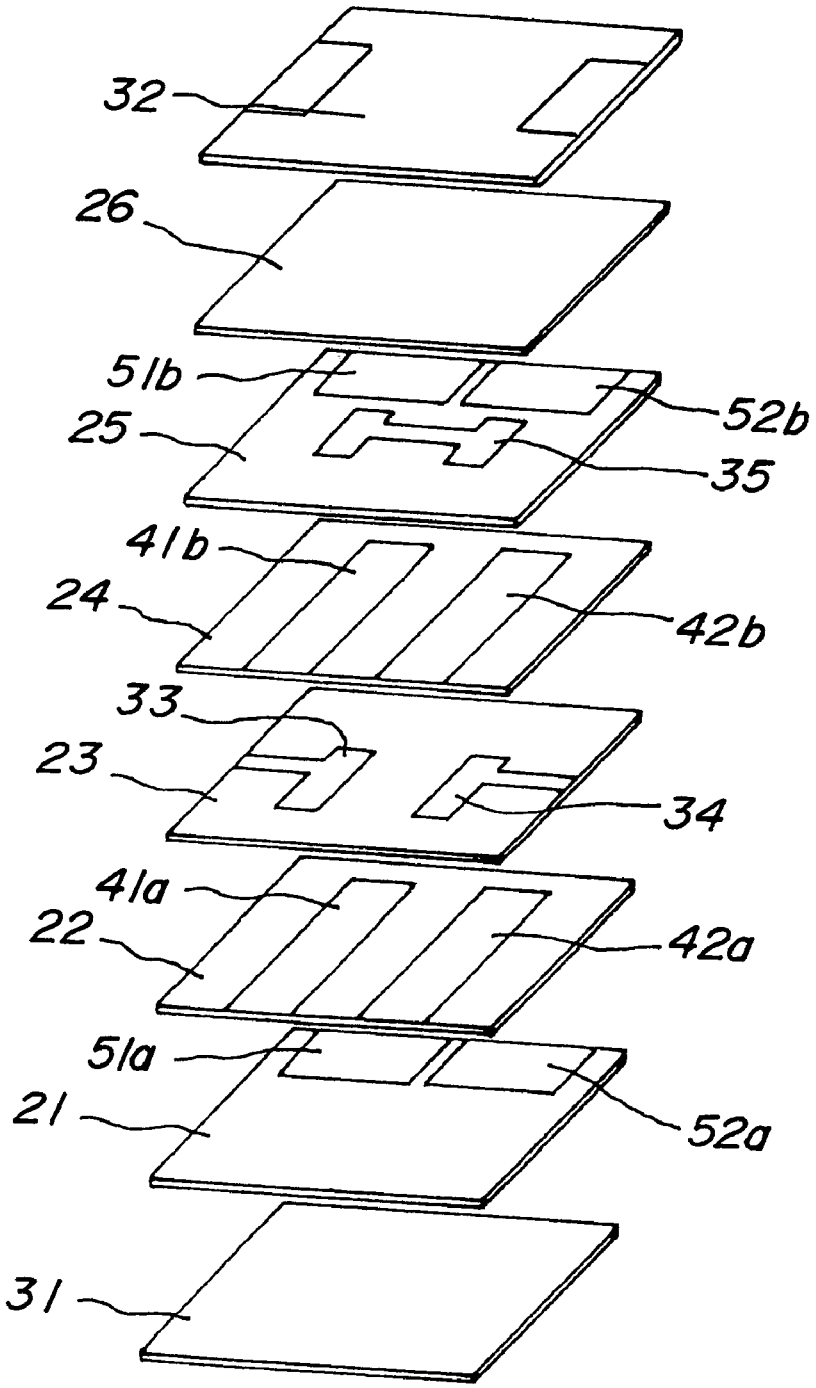
FIG. 4 is a view showing a first embodiment of the laminated type dielectric filter according to the present invention.

FIG. 4 shows a first embodiment of the laminated type dielectric filter according to the present invention. For the sake of explanation, the filter is illustrated such that various kinds of electrodes are formed on imaginary surfaces of dielectric layers like as FIG. 1.

In this embodiment, the laminated type dielectric filter has a stacking structure of first to sixth dielectric layers 21 to 26. Earth electrodes 31, 32 are provided on outer surfaces of the first and sixth dielectric layers 21, 26, respectively, and input and output electrodes 33 and 34 are provided on a surface of the third dielectric layer 23. Resonating elements 41*a*, 42*a* and 41*b*, 42*b* are provided on surfaces of the second dielectric layers 22 and 24, respectively. A coupling electrode 35 is provided on a surface of the fifth dielectric layer 25.

On the surface of the first dielectric layer 21, are formed interlayer earth electrodes 51*a* and 52*a* such that they oppose to the resonating elements 41*a* and 42*a*, respectively formed on the surface of the second dielectric layer 22, and on the surface of the fifth dielectric layer 25 are formed interlayer earth electrodes 51*b* and 52*b* such that they oppose to the resonating elements 41*b* and 42*b*, respectively formed on the surface of the fourth dielectric layer 24.

The resonating elements 41*a* and 41*b* are opposed to each other via the third dielectric layer 23 to constitute a first symmetric type strip line resonator, and the resonating elements 42*a* and 42*b* are opposed to each other by means of the third dielectric layer 23 to constitute a second symmetric type strip line resonator. That is to say, in the present embodiment, the laminated type dielectric filter comprises two sets of symmetric type strip line resonators each including two resonating elements.

It has been known to construct a symmetric type strip line resonator by arranging resonating elements one upon the other with interviewing a dielectric layer, and such a structure is disclosed, for instance, in JP A 4-43703. However, this publication does not disclose concretely how to construct a laminated type dielectric filter by employing such a symmetric strip line resonator.

In this embodiment, the input electrode 33 connecting an input terminal to the first symmetric type strip line resonator is provided between the first and the second resonating elements 41*a* and 41*b* of the first strip line resonator, and the output electrode 34 connecting the second symmetric type strip line resonator to an output terminal is provided between the resonating elements 42*a* and 42*b* of the second strip line resonator. Thus, not only the capacitances between the input electrode and the resonating elements, but also the capacitances between the output electrodes and the resonating elements, can be increased. As a result, the operating frequency and insertion loss of the filter can be lowered without increasing a size of electrodes. Moreover, characteristic impedance of the resonating elements can be increased by stacking the resonating elements of the symmetric strip line resonator with interposing the dielectric layer therebetween, and therefore filter characteristics of the laminated type dielectric filter can be improved.

Figure 1:
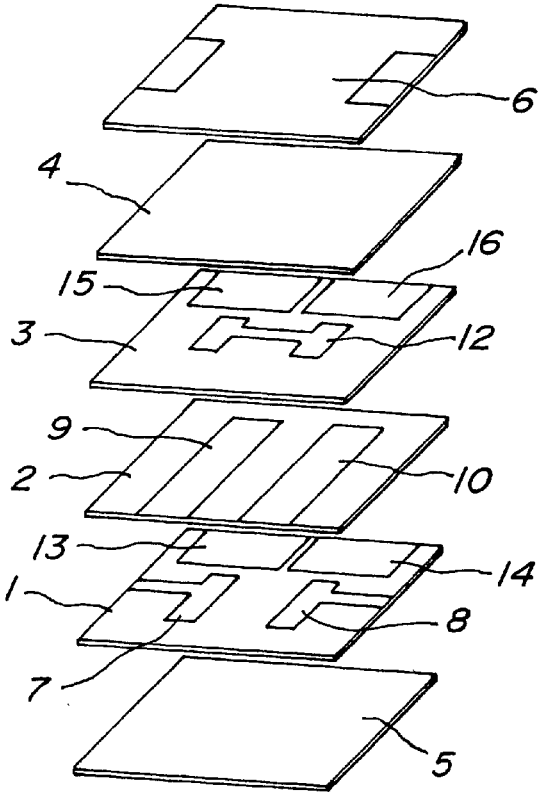
FIG 1 PRIOR ART
FIG. 1 is a schematic view showing a conventional laminated type dielectric filter.
Figure 2:
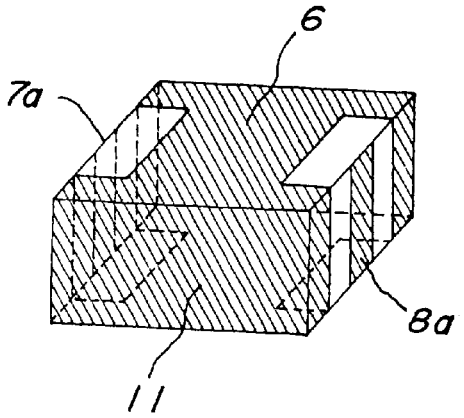
FIG 2 PRIOR ART
FIG. 2 is a perspective view illustrating an outer appearance of the conventional laminated type dielectric filter.
Figure 3:
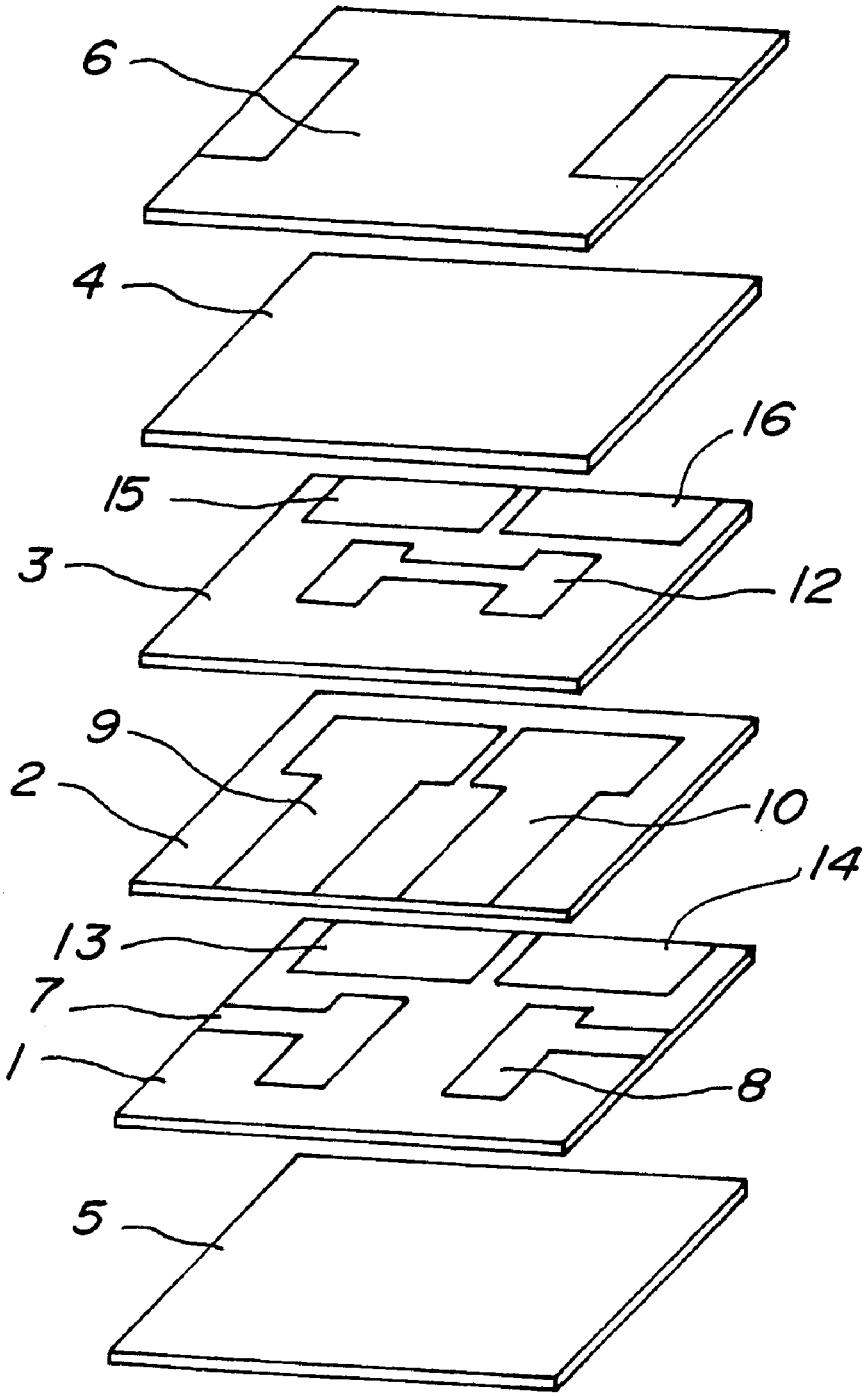
FIG 3 PRIOR ART
FIG. 3 is a schematic view depicting a conventional laminated type dielectric filter having interlayer earth electrodes.
Figure 5:
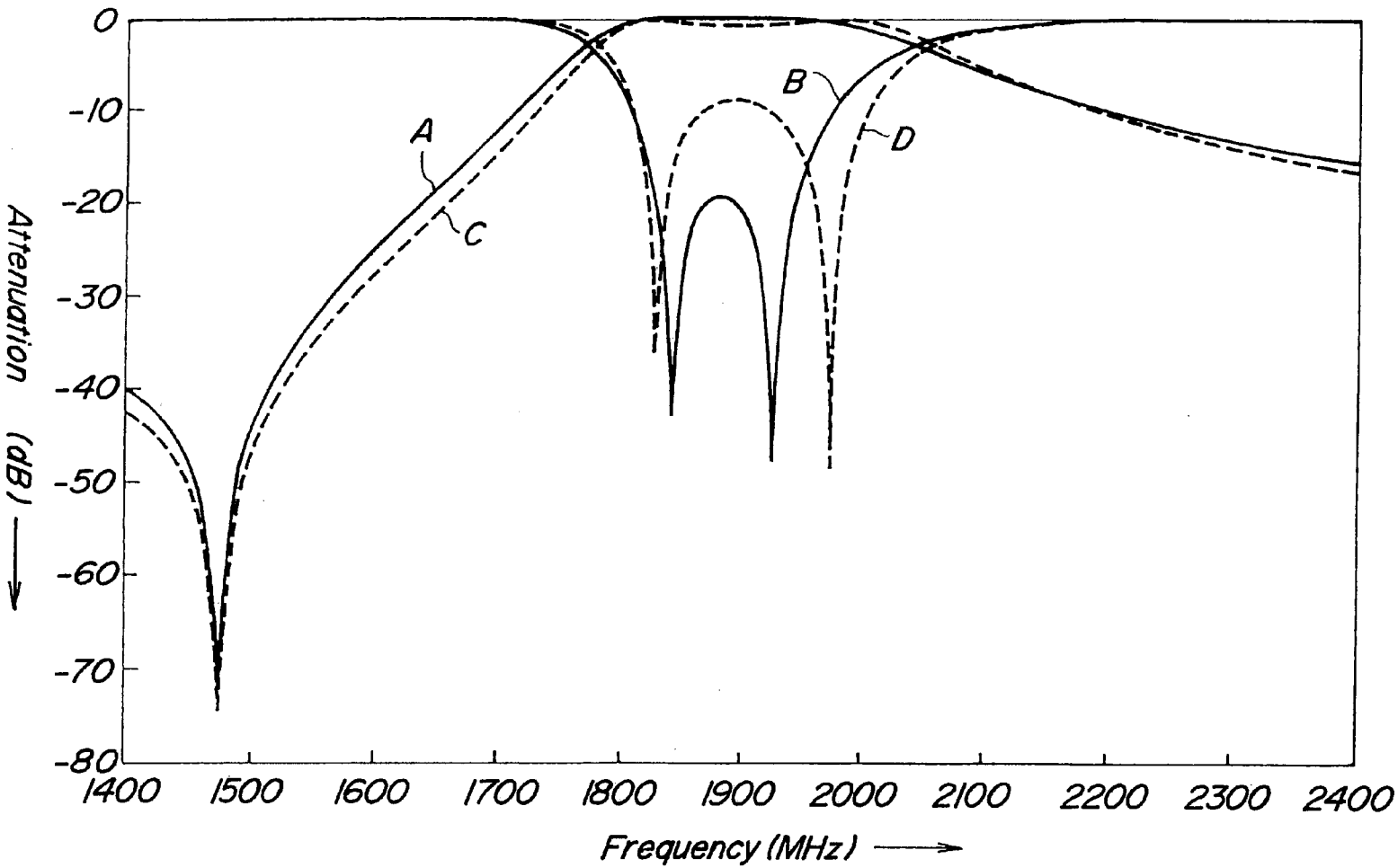
FIG. 5 is a graph showing characteristic of the first embodiment of the laminated type dielectric filter as shown in FIG. 4 in comparison with a characteristics of the conventional laminated type dielectric filter.

FIG. 5 shows transmission and reflection characteristics of the laminated type dielectric filter according to the present invention shown in FIG. 4 in comparison with transmission and reflection characteristics of the conventional laminated type dielectric filter illustrated in FIGS. 1 and 2.

In FIG. 5, solid lines A and B denote transmission and reflection characteristics of the laminated type dielectric filter according to the present invention, respectively, and broken lines C and D represent transmission and reflection characteristics of the conventional laminated type dielectric filter. Both of the laminated type dielectric filters are of the capacitive coupling type in which an attenuation peak appears on a lower frequency side of the pass band.

As is apparent from these curves, the pass band width of the laminated type dielectric filter according to the present invention depicted by the curve A is substantially identical with that of the of the conventional laminated type dielectric filter denoted by the curve C, but the conventional filter has ripples within the pass band, but the filter of the present invention dose not have such ripples. It may be assumed from the reflection characteristic curves B and D.

Figure 6:
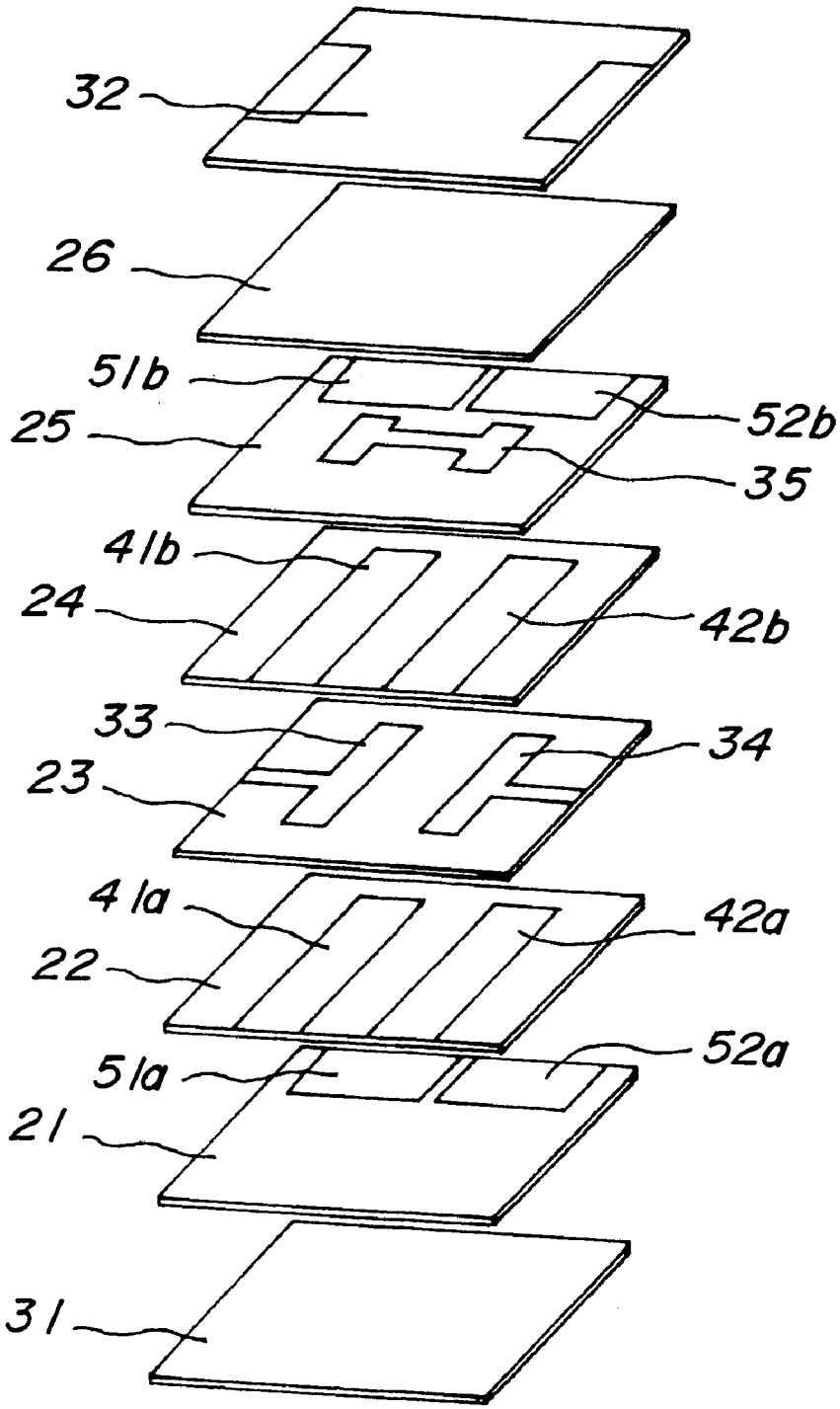
FIG. 6 is a schematic view showing a second embodiment of the laminated type dielectric filter according to the present invention.

FIG. 6 shows a second embodiment of the laminated type dielectric filter according to the present invention. Also in this embodiment, like as the first embodiment shown in FIG. 4, the same operating frequency as the conventional laminated type dielectric filter may be attained by merely arranging interlayer earth electrodes 51*a*, 51*b*; 52*a*, 52*b* on outer sides of pairs of resonating elements 41*a*, 41*b*; 42*a*, 42*b* of respective symmetric type strip line resonators, it is no more necessary to provide interlayer earth electrodes on the third dielectric layer 23. By utilizing such a property, the input electrode 33 formed on the surface of the third dielectric layer 23 is elongated and thereby its surface area of a portion overlapping the resonating elements 41*a*, 41*b* can be increased, and similarly, the output electrode 34 is elongated and its overlapping surface area with respect to the resonating elements 42*a*, 42*b* can be enlarged. In this way, by elongating the input electrode 33, the capacitances between the input electrode 33 and the resonating elements 41*a*, 41*b* can be increased, and by elongating the output electrode 34, the capacitances between the output electrode 34 and the resonating elements 42*a*, 42*b* can be increased.

As is apparent from FIGS. 4 and 6, by adjusting a dimension of the input electrode 33 between the resonating elements 41*a* and 41*b* as well as a dimension of the output electrode 34 between the resonating elements 42*a* and 42*b*, the capacitances between the resonating elements and the input and output electrodes can be changed and the laminated type dielectric filter having desired characteristics can be easily obtained.

Figure 7:
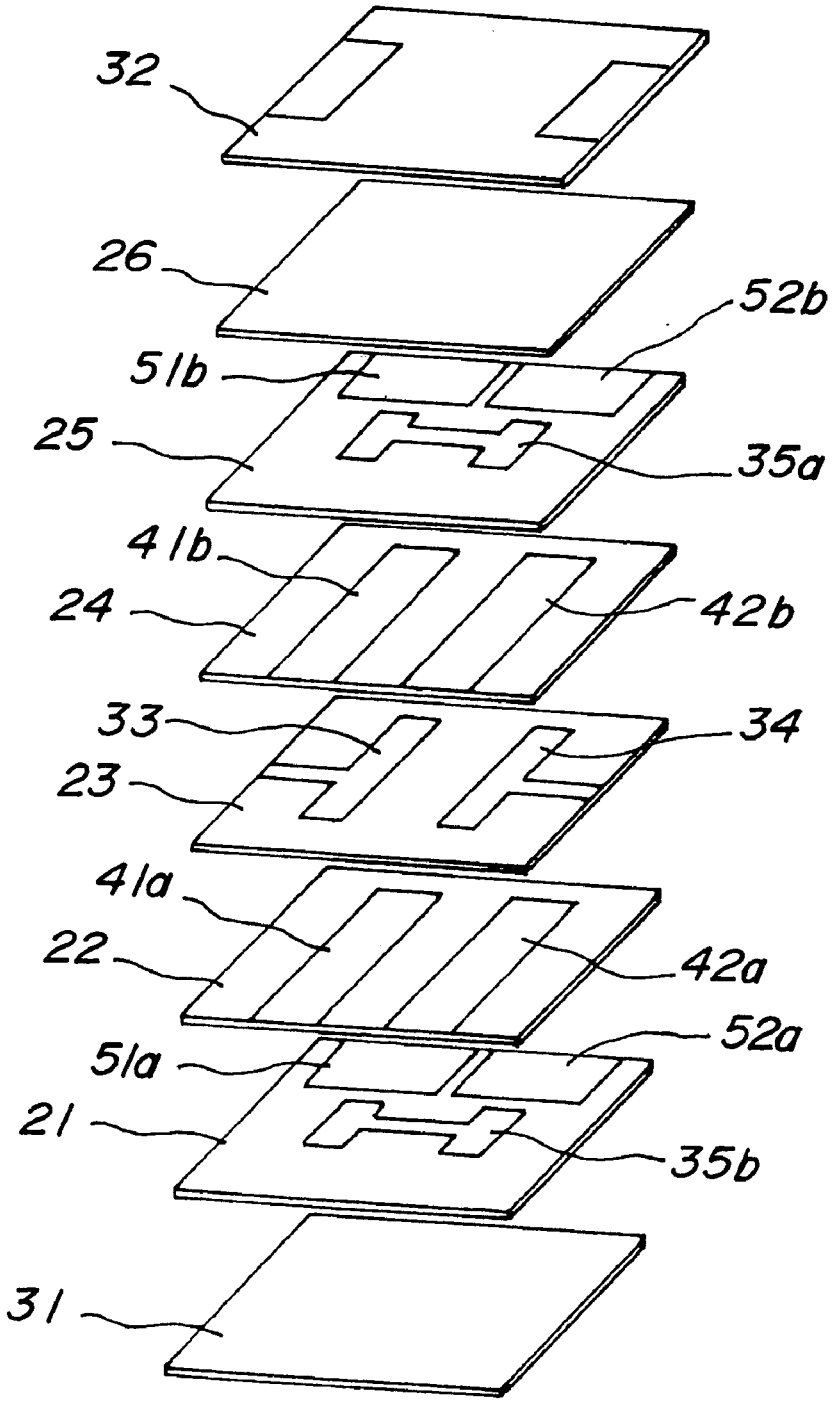
FIG. 7 is a schematic view illustrating a third embodiment of the laminated type dielectric filter according to the present invention.

FIG. 7 shows a third embodiment of the laminated type dielectric filter according to the present invention. This embodiment differs from the second embodiment shown in FIG. 6 in that a first coupling electrode 35*a* is formed on the surface of the fifth dielectric layer 25 such that it overlaps the resonating elements 41*b*, 42*b*, and a second coupling electrode 35*b* is formed on the surface of the first dielectric layer 21 such that it overlaps the resonating elements 41*a*, 42*a*.

The thus obtained structure enables the capacitances between the coupling electrodes and the resonating elements to be large. Moreover, in this structure, the pass band of the filter is flattened and can be adjusted over a wider range. That is, in the case of making the capacitive coupling between the first and second symmetric type strip line resonators, the pass band can be widened, and in the case of the inductive coupling, the pass band width can be made small.

Figure 8:
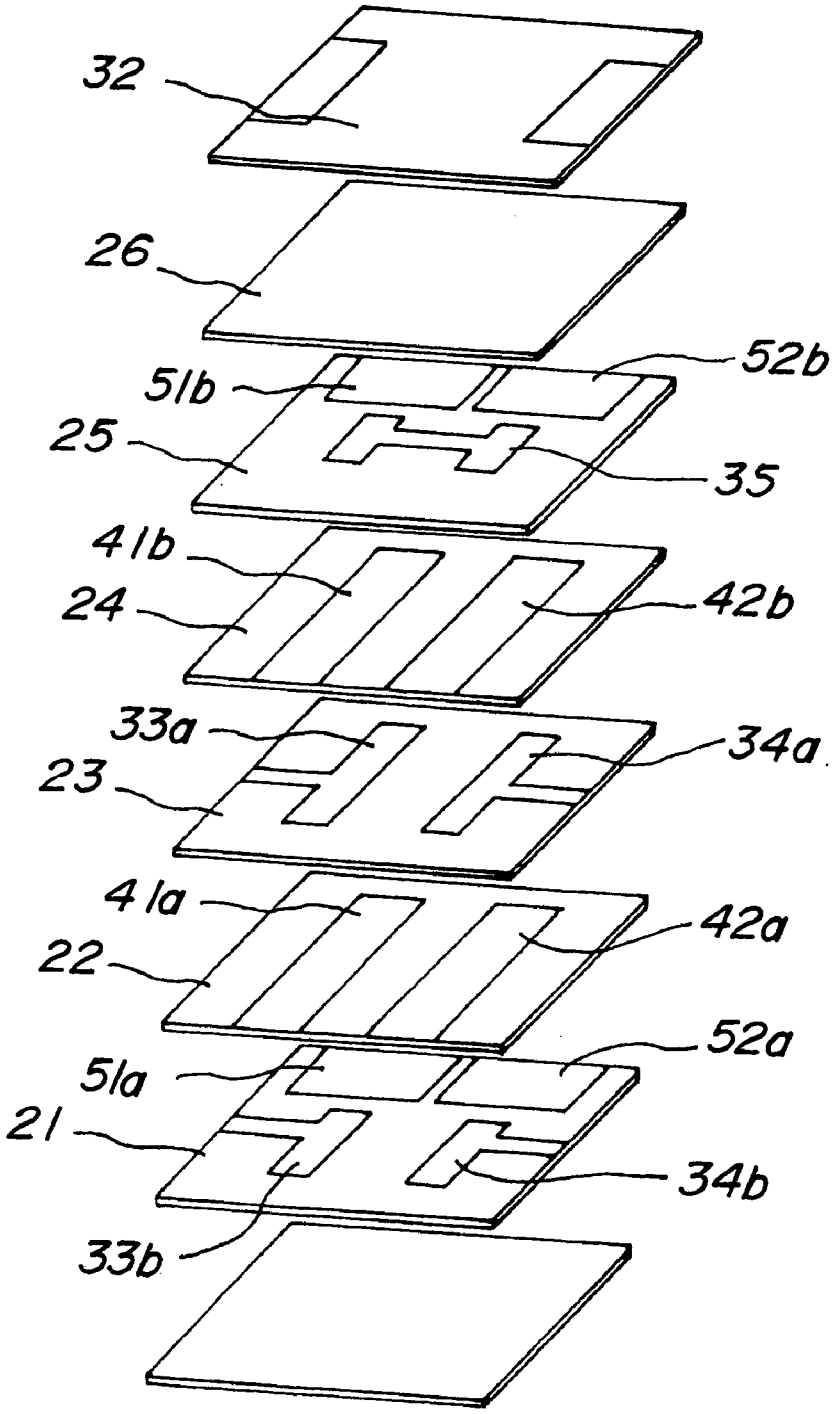
FIG. 8 is a schematic view representing a fourth embodiment of the laminated type dielectric filter according to the present invention.

FIG. 8 shows a structure of a fourth embodiment of the laminated type dielectric filter according to the present invention. This embodiment differs from the second embodiment illustrated in FIG. 6 in that a first input electrode 33*a* and a first output electrode 34*a* are formed on the surface of the third dielectric layer 23, and a second input electrode 33*b* and a second output electrode 34*b* are formed on the surface of the first dielectric layer 21. By constructing the filter in this manner, the capacitances between the input electrodes and the resonating elements and the capacitances between the output electrodes and the resonating elements can be further increased.

Figure 9:
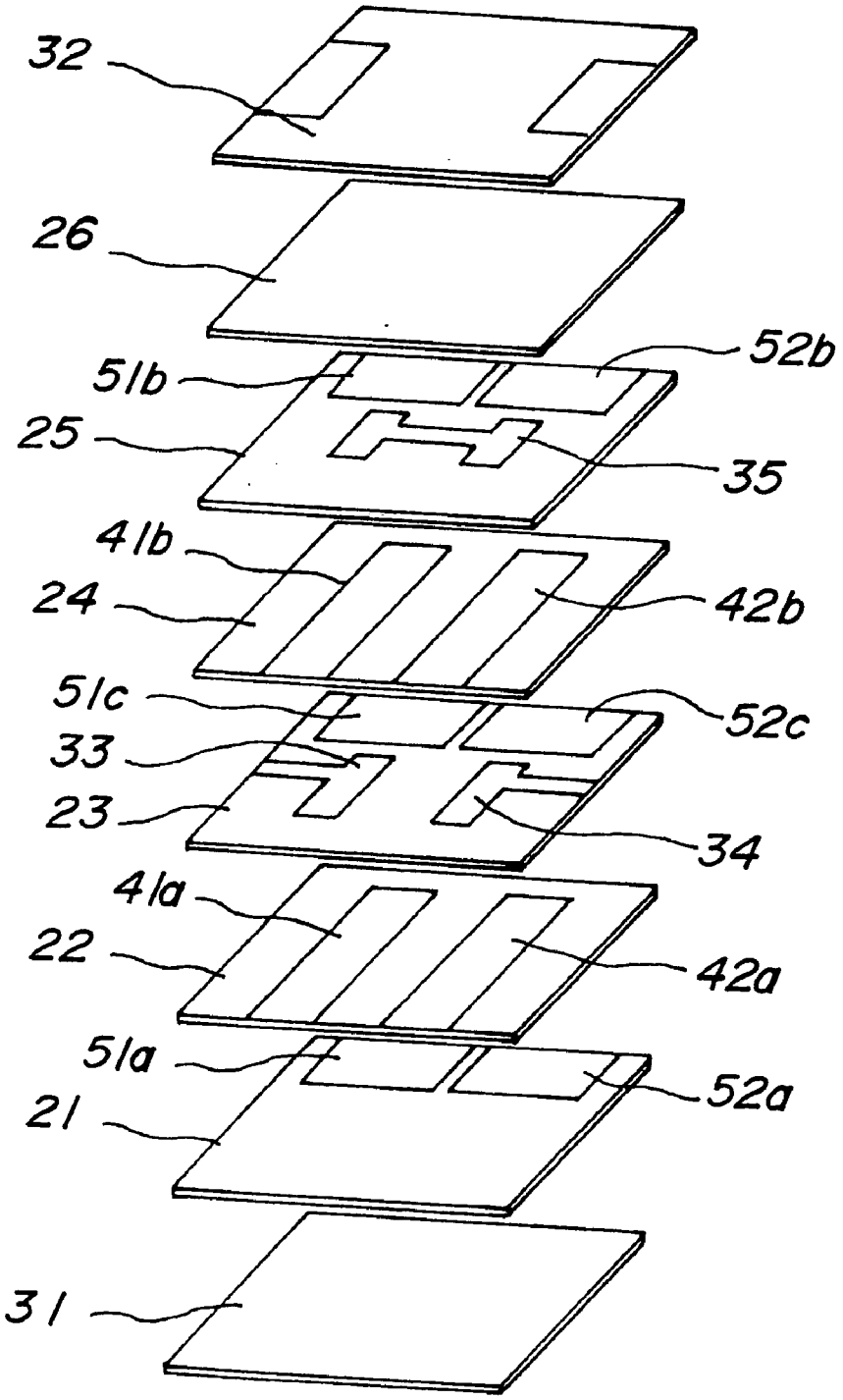
FIG. 9 is a schematic view depicting a fifth embodiment of the laminated type dielectric filter according to the present invention.

FIG. 9 shows a structure of a fifth embodiment of the laminated type dielectric filter according to the present invention. In this embodiment, the first embodiment of the laminated type dielectric filter shown in FIG. 4 is modified by arranging interlayer earth electrodes 51*c*, 52*c* also on the surface of the third dielectric layer 23. That is to say, the resonating elements 41*a*, 41*b* and 42*a*, 42*b* are sandwiched with the interlayer earth electrodes 51*a*, 51*b*, 51*c* and 52*a*, 52*b*, 52*c*. Therefore, the capacitances between the resonating elements and the interlayer earth electrodes can be remarkably increased, and the pass band of the filter can be further flattened and can be shifted toward a lower frequency.

Figure 10:
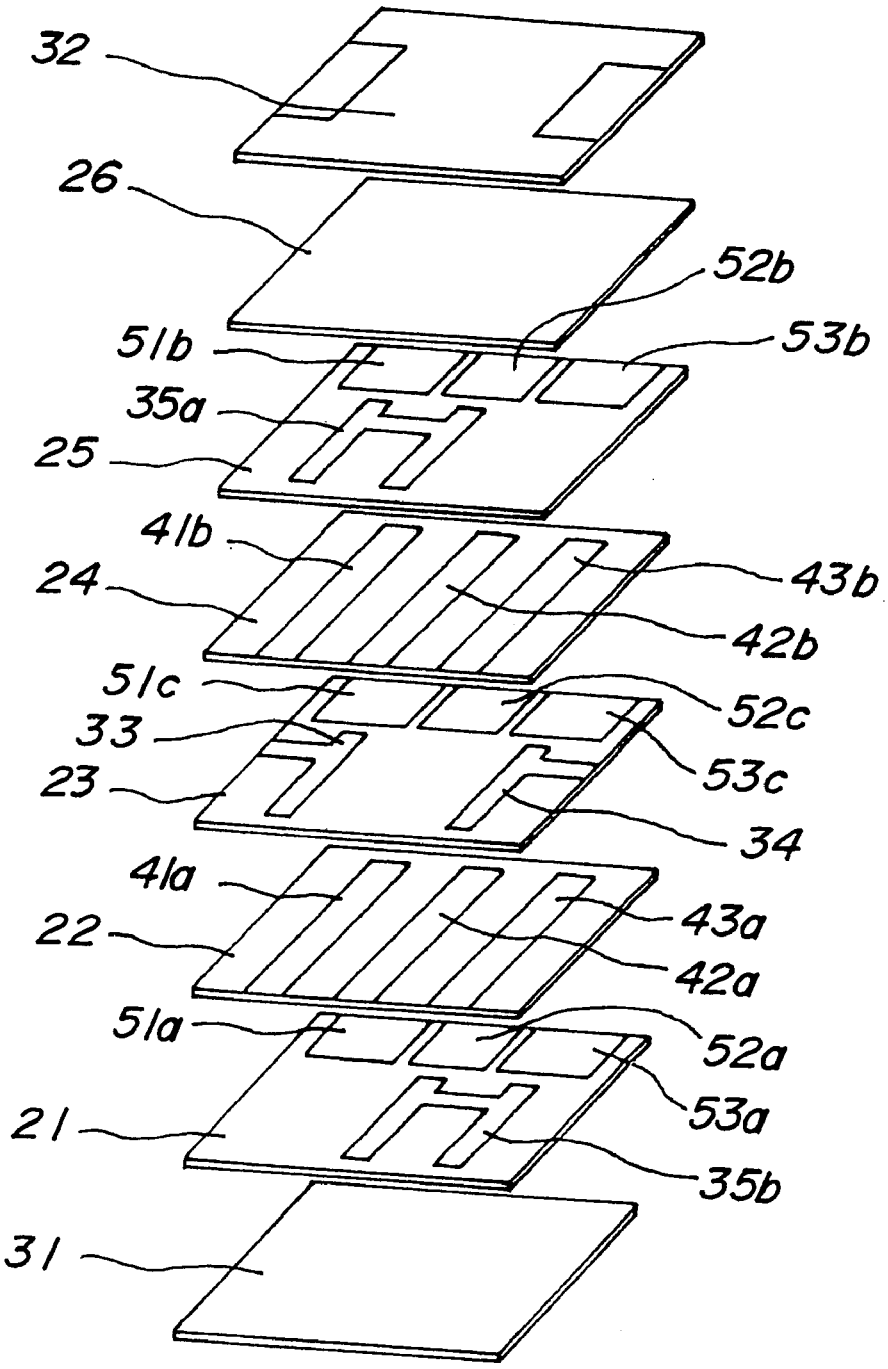
FIG. 10 is a schematic view showing a sixth embodiment of the laminated type dielectric filter according to the present invention.

FIG. 10 shows a sixth embodiment of the laminated type dielectric filter according to the present invention. In this embodiment, the filter comprises three sets of symmetric type strip line resonators each having two resonating elements. First resonating elements 41*a*, 42*a*, 43*a* and second resonating elements 41*b*, 42*b*, 43*b* of the first to the third symmetric type strip line resonators are formed on surfaces of the second and fourth dielectric layers 22 and 24, respectively, the input electrode 33 connecting the input terminal to the first symmetric type strip line resonator and the output electrode 34 connecting the third symmetric type strip line resonator to the output terminal are formed on the surface of the third dielectric layer 23.

Moreover, a first coupling electrode 35*a* connecting the first symmetric type strip line resonator to the second symmetric type strip line resonator is formed on the surface of the fifth dielectric layer 25, and a second coupling electrode 35*b* connecting the second symmetric type strip line resonator to the third symmetric type strip line resonator is formed on the surface of the first dielectric layer 21. Furthermore, interlayer earth electrodes 51*a*, 52*a*, 53*a*; 51*b*, 52*b*, 53*b* and 51*c*, 52*c*, 53*c* are provided on the surfaces of the first, third and fifth dielectric layers 21, 23 and 25, respectively.

In this embodiment, each of the resonating elements 41*a*, 42*a*, 43*a* and 41*b*, 42*b*, 43*b* are sandwiched between the interlayer earth electrodes 51*a*, 52*a*, 53*a*; 51*b*, 52*b*, 53*b*, and 51*c*, 52*c*, 53*c*, and therefore, the capacitances between the resonating elements and the interlayer earth electrodes can be increased. Moreover, since the input electrode 33 and the output electrode 34 are arranged between the resonating elements 41*a*, 41*b* and between the resonating elements 43*a*, 43*b*, respectively, the capacitances between the resonating elements and the input and output electrodes can be increased.

Figure 11:
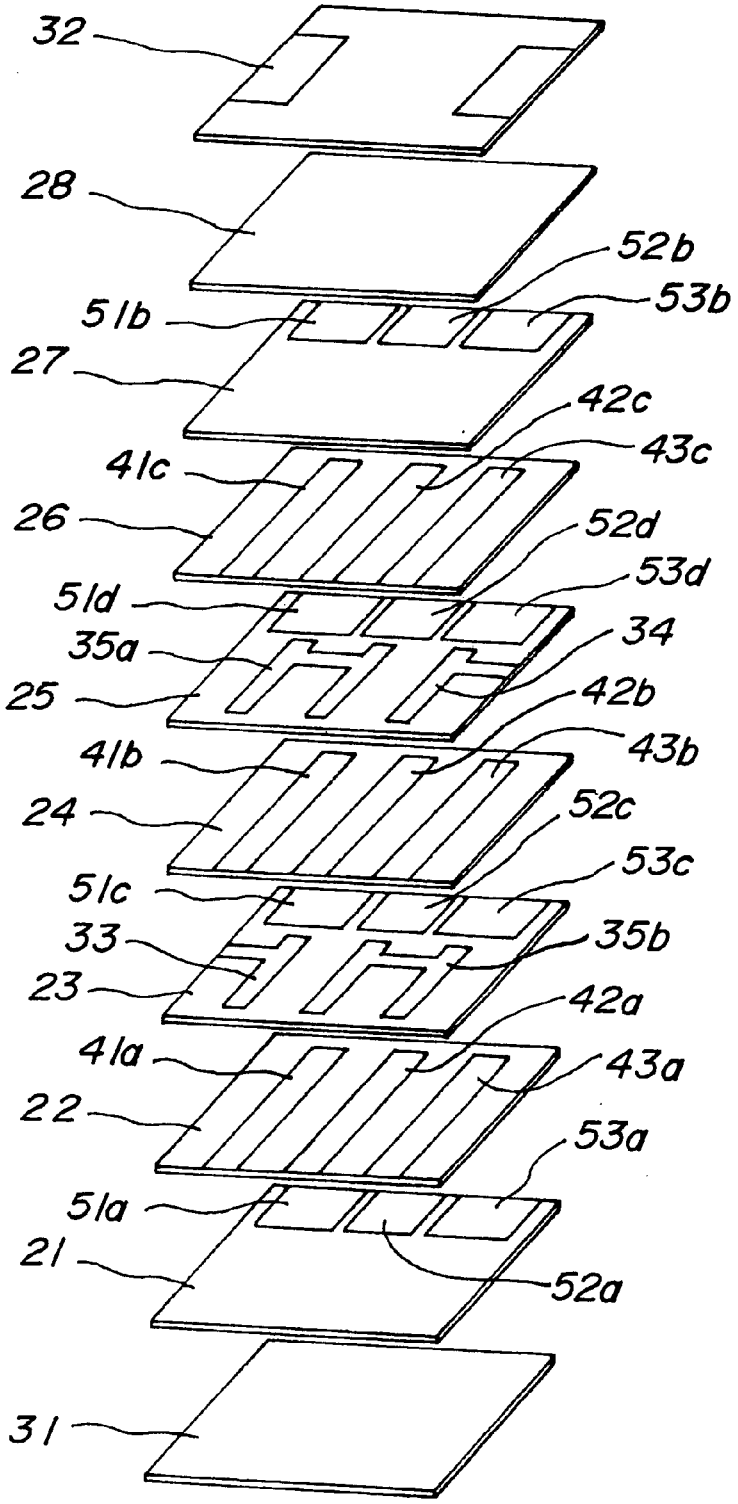
FIG. 11 is a schematic view showing a seventh embodiment of the laminated type dielectric filter according to the present invention.

FIG. 11 shows a structure of a seventh embodiment of the laminated type dielectric filter according to the present invention. In this embodiment, three sets of symmetric type strip line resonators each including three resonating elements are aligned side by side. That is, first to third resonating elements 41*a*, 42*a*, 43*a*; 41*b*, 42*b*, 43*b*, and 41*c*, 42*c*, 43*c* of the first to third symmetric type strip line resonators are formed on surfaces of second, fourth and sixth dielectric layers 22, 24 and 26, respectively. The input electrode 33 connecting the input terminal to the first symmetric type strip line resonator is formed on the surface of the third dielectric layer 23, and the output electrode 34 connecting the third symmetric type strip line resonator to the output terminal is formed on the surface of the fifth dielectric layer 25.

The first coupling electrode 35*a* coupling the first and second symmetric type resonators each other is formed on the surface of the fifth dielectric layer 25, and the second coupling electrode 35*b* coupling the second and third symmetric type strip line resonators each other is formed on the surface of the third dielectric layer 23. Furthermore, interlayer earth electrodes 51*a*, 52*a*, 53*a*; 51*c*, 52*c*, 53*c*; 51*d*, 52*d*, 53*d*, and 51*b*, 52*b*, 53*b* are provided on the surfaces of the first, third, fifth, and seventh dielectric layers 21, 23, 25 and 27, respectively.

In this embodiment, the input electrode 33 is sandwiched between the resonating elements 41*a* and 41*b* and the output electrode 34 is sandwiched between the resonating elements 43*b* and 43*c*, and thus the capacitances between the resonating elements and the input and output electrodes can be increased. Therefore, the pass band frequency as well as the insertion loss of the filter can be lowered. Moreover, since each of the resonating elements of the symmetric type strip line resonators is sandwiched by the interlayer earth electrodes, the capacitances between the resonating elements and the interlayer earth electrodes can be further increased and pass band frequency can be further lowered. Furthermore, since the coupling electrodes 35*a*, 35*b* are also sandwiched by the resonating elements, the capacitances between the coupling electrodes and the resonating elements can be increased and the pass band width of the filter can be adjusted. In this way, the laminated type dielectric filter having desired characteristics can be obtained, while the filter can be small in size and light in weight.

Figure 12:
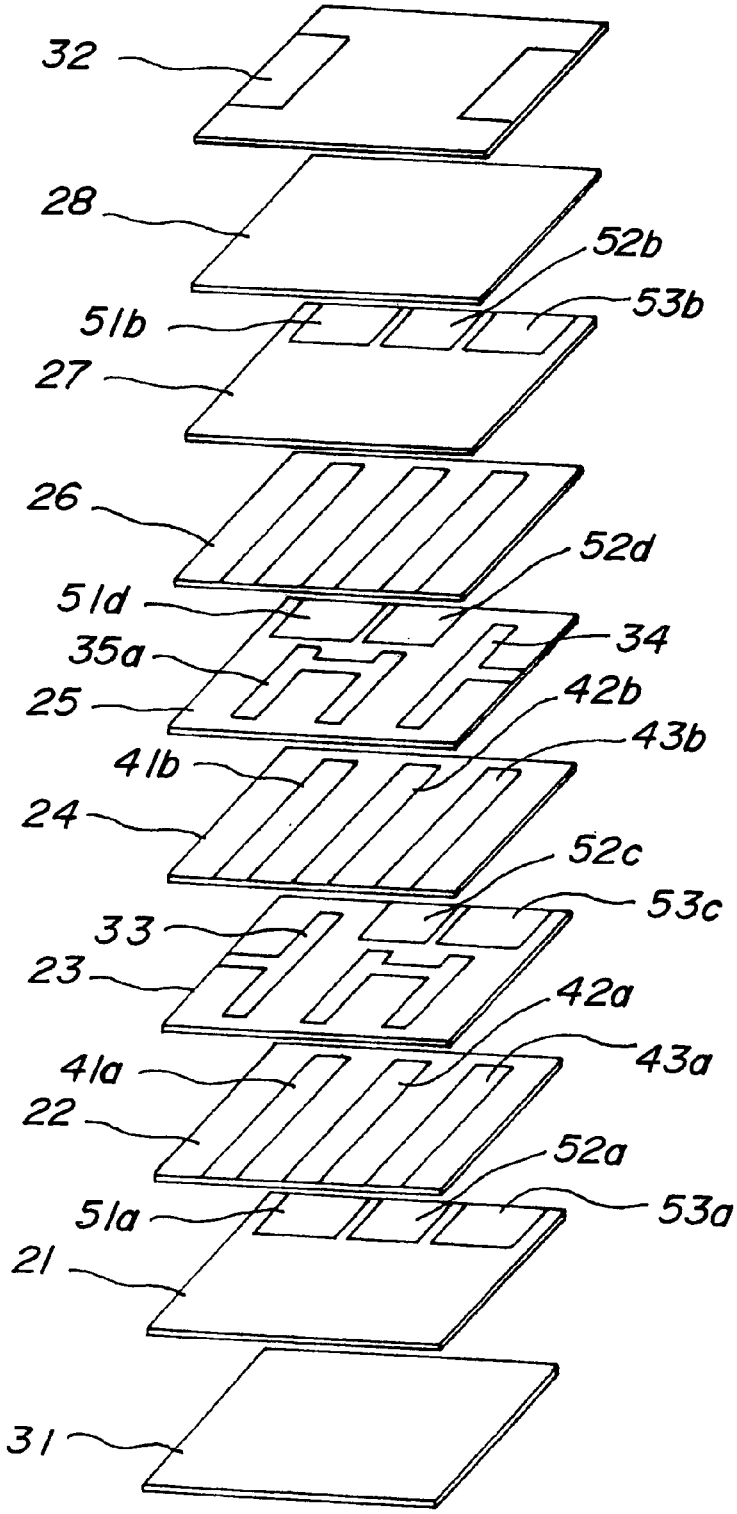
FIG. 12 is a schematic view illustrating an eighth embodiment of the laminated type dielectric filter according to the present invention.

FIG. 12 shows a structure of an eighth embodiment of the laminated type dielectric filter according to the present invention. This embodiment differs from the seventh embodiment shown in FIG. 11 in that the interlayer earth electrodes 51*c* and 53*c* formed on the surfaces of the third and the fifth dielectric layers 23 and 25 are removed and the input and the output electrodes 33, 34 are extended further. The remaining structure of the present embodiment is similar to that of the seventh embodiment.

In this embodiment, since the input and output electrodes 33 and 34 are extended, their overlapping surface areas with respect to the resonating elements become larger, and the capacitances between the elements and the electrodes are increased accordingly. In this manner, according to the invention, by changing kinds and dimensions of the electrodes to be provided on the same dielectric layer, the laminated type dielectric filters having various filter characteristics can be obtained.

As mentioned above, by sandwiching each resonating elements of the symmetric type strip line resonators with the interlayer earth electrodes, the capacitances therebetween can be increased and the pass band frequency can be lowered. In general, in case of establishing the capacitive coupling between the resonators, when the pass band frequency is lowered, the pass band width is liable to be narrowed. However, in the present embodiment, by sandwiching the coupling electrodes with the resonating elements, the capacitances between the coupling electrodes and the resonating elements can be increased, and therefore the pass band width can be broadened. In this manner, the pass band frequency can be lowered without narrowing the pass band width. Moreover, since it is easy to decrease the capacitances, the pass band frequency can be adjusted over a wide range of frequency.

Figure 13:
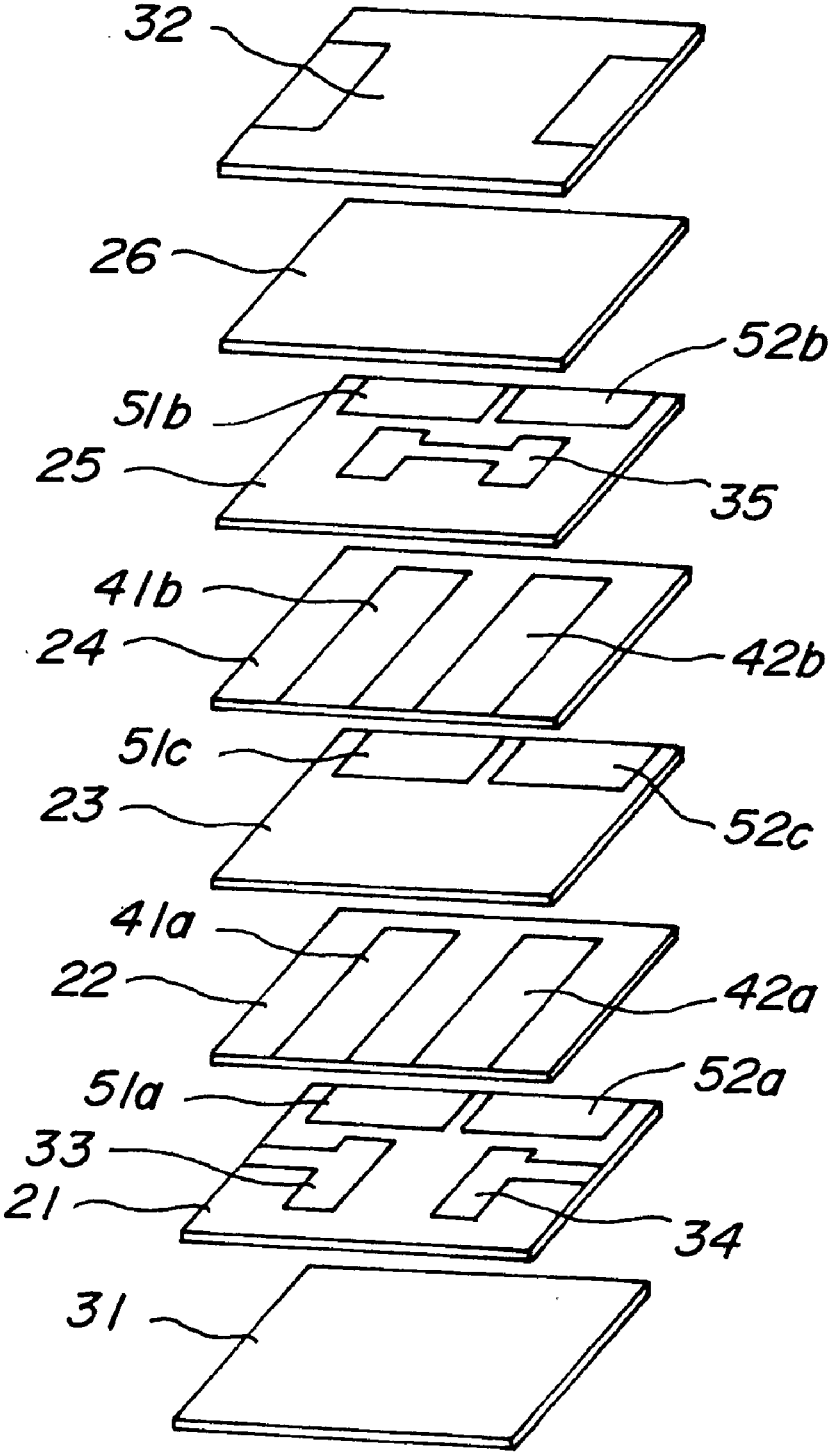
FIG. 13 is a schematic view depicting a ninth embodiment of the laminated type dielectric filter according to the present invention.

FIG. 13 shows a ninth embodiment of the laminated type dielectric filter according to the present invention. This embodiment is a modification of the fifth embodiment depicted in FIG. 9. That is to say, in the filter of the present embodiment, the input and output electrodes 33 and 34 formed on the third dielectric layer 23 in the fifth embodiment are arranged on the first dielectric layer 21. The remaining structure of the present embodiment is similar to that of the fifth embodiment.

In this embodiment, the interlayer earth electrodes 51*a* and 52*a* are formed on the surface of the first dielectric layer 21 at portions overlapping the open ends of the resonating elements 41*a* and 42*a*, the interlayer earth electrodes 51*c* and 52*c* are arranged on the surface of the third dielectric layer 23 at portions overlapping the open ends of the resonating elements 41*a* and 42*a*, and the interlayer earth electrodes 51*b* and 52*b* are formed on the surface of the fifth dielectric layer 25 at portions overlapping the open ends of the resonating elements 41*b* and 42*b*. By constructing the filter in this manner, the capacitances between the resonating elements and the interlayer earth electrodes can be increased without increasing a planer size of the dielectric filter and decreasing a thickness of the dielectric layers.

Figure 14:
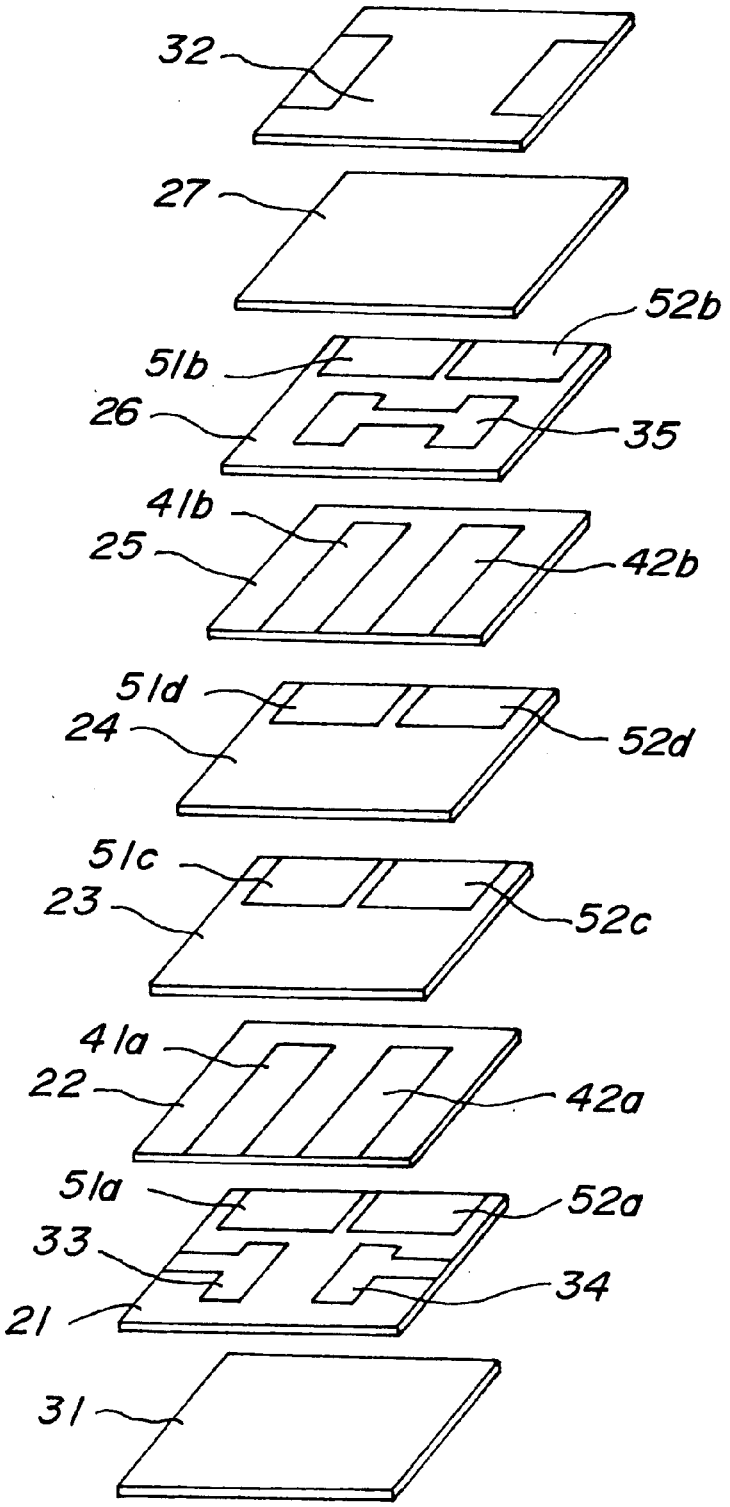
FIG. 14 is a schematic view representing a tenth embodiment of the laminated type dielectric filter according to the present invention.

FIG. 14 shows a tenth embodiment of the laminated type dielectric filter according to the present invention. In the ninth embodiment shown in FIG. 13, the first resonating elements 41*a*, 42*a* and the second resonating elements 41*b*, 42*b* are sandwiched with the intermediate interlayer earth electrodes 51*c* and 52*c*, respectively, in the present embodiment, each of resonating elements is sandwiched by different interlayer earth electrodes.

As illustrated in FIG. 14, seven sheets of first to seventh dielectric layers 21 to 27 are stacked. In this embodiment, first resonating elements 41*a* and 42*a* of the first and second symmetric type strip line resonators are sandwiched between interlayer earth electrodes 51*a* and 51*c* and between the interlayer earth electrodes 52*a* and 52*c*, respectively. Moreover, second resonating elements 41*b* and 42*b* of the first and second symmetric type strip line resonators are sandwiched between interlayer earth electrodes 51*b* and 51*d* and between interlayer earth electrodes 52*b* and 52*d*, respectively.

Figure 15:
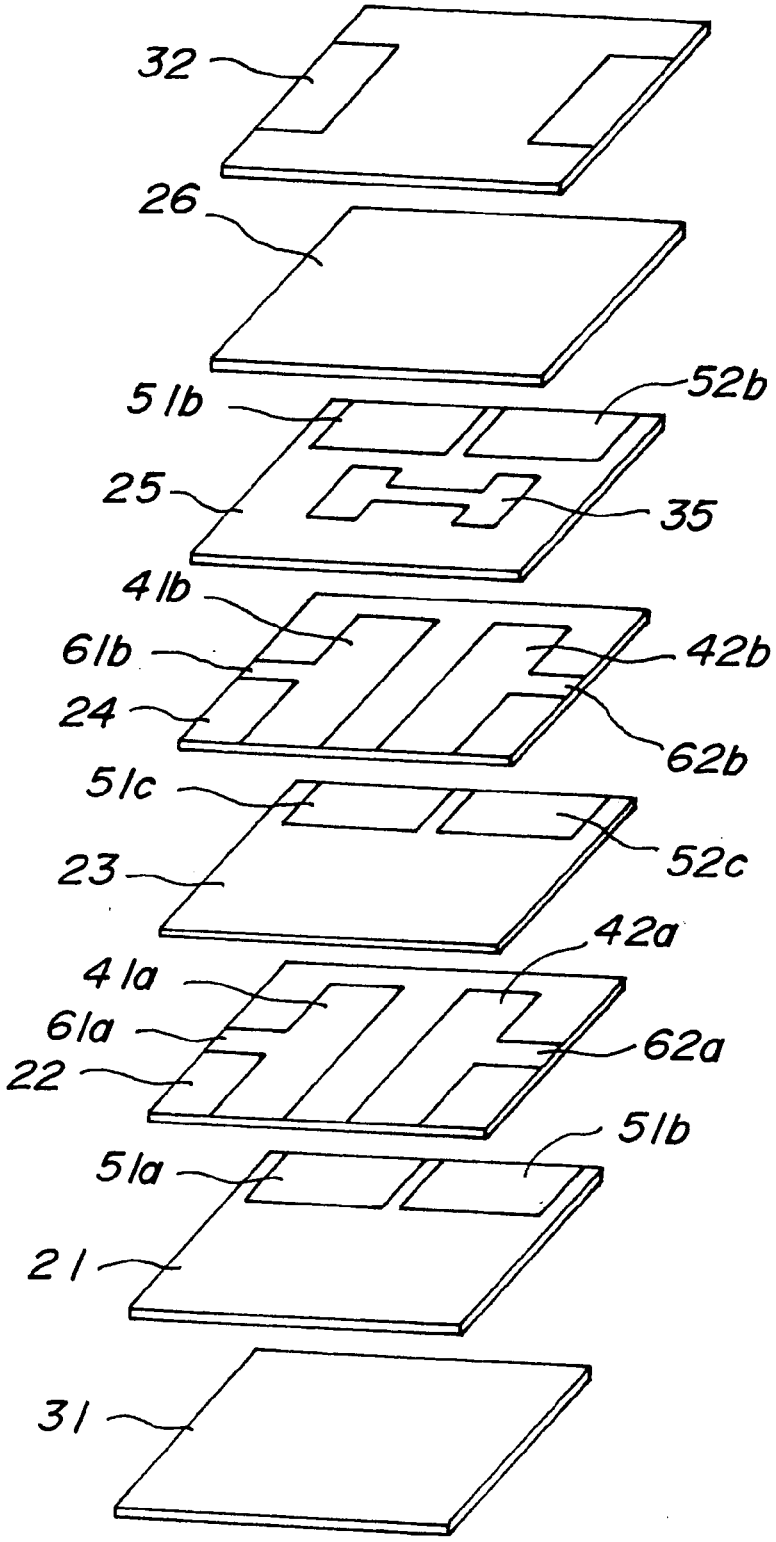
FIG. 15 is a schematic view showing an eleventh embodiment of the laminated type dielectric filter according to the present invention.

FIG. 15 shows an eleventh embodiment of the laminated type dielectric filter according to the present invention. This embodiment differs from the ninth embodiment in that the input and output electrodes 33 and 34 are removed, the resonating elements 41*a* and 41*b* of the first symmetric type strip line resonator are formed such that they also operate as the input electrode, and the resonating elements 42*a* and 42*b* of the second symmetric type strip line resonator are formed such that they serve as the output electrode. In this manner, the filter of the present embodiment is constructed as the laminated type dielectric filter of L-tap configuration. That is to say, the resonating elements 41*a* and 41*b* of the first symmetric type strip line resonator have taps 61*a* and 61*b* which extend up to the input stage edges of dielectric layers 22 and 24, respectively, and the resonating elements 42*a* and 42*b* of the second symmetric type strip line resonator have taps 62*a* and 62*b* extending up to output stage edges of the dielectric layers 22 and 24. The taps 61*a* and 61*b* of the resonating elements of the input stage symmetric type dielectric filter are connected to the input terminal, and the taps 62*a* and 62*b* of the resonating elements of the output stage symmetric type strip line resonator are connected to the output terminal. In this embodiment, all the resonating elements of the input stage symmetric type strip line resonator are connected to the input terminal, and all the resonating elements of the output stage symmetric type strip line resonator are connected to the output terminal.

Figure 16:
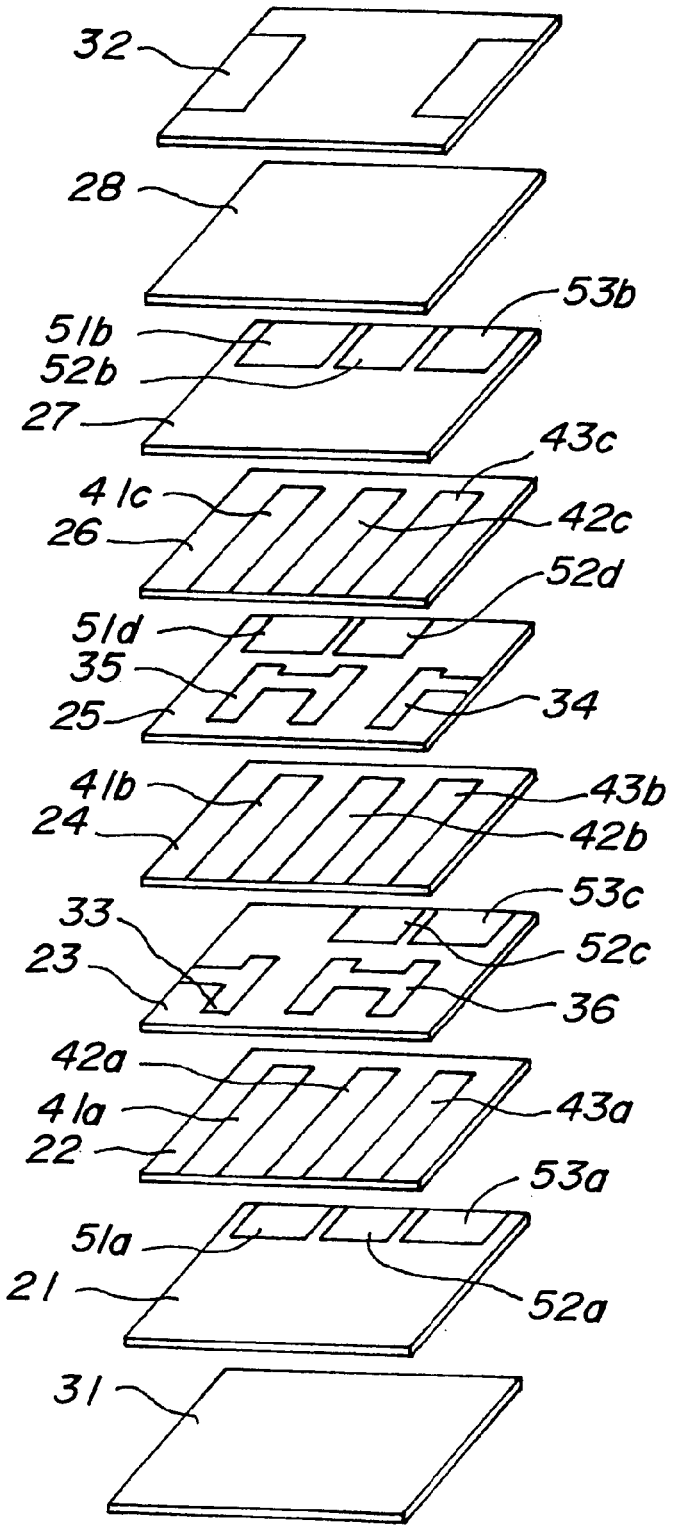
FIG. 16 is a schematic view depicting a twelfth embodiment of the laminated type dielectric filter according to the present invention.

FIG. 16 shows a twelfth embodiment of the laminated type dielectric filter according to the present invention. The filter in this embodiment has three sets of symmetric type strip line resonators each including three resonating elements which are stacked via dielectric layers. Moreover, each of the resonating elements in all the symmetric type strip line resonators, i.e. the strip line electrodes is sandwiched by interlayer earth electrodes.

The filter has a stacking structure of first to eighth dielectric layers 21 to 28 which are stacked one another in succession. Earth electrodes 31 and 32 are provided on outer surfaces of the first and eighth dielectric layers 21 and 28, respectively, the input and output electrode 33 and 34 are formed on surfaces of the third and fifth dielectric layers 23 and 25, respectively. Moreover, coupling electrodes 35 and 36 are provided on the surfaces of the fifth and third dielectric 25 and 23, respectively. Resonating elements 41*a*, 42*a*, 43*a*; 41*b*, 42*b*, 43*b* and 41*c*, 42*c*, 43*c* are formed on surfaces of the second, fourth and sixth dielectric layers 22, 24 and 26, respectively. The resonating elements 41*a*, 41*b* and 41*c* are opposed to one another via the dielectric layers 23 and 25, and constitute the first symmetric type strip line resonator. The resonating elements 42*a*, 42*b* and 42*c* are opposed to one another with interposing the dielectric layers 23 and 25 therebetween, and constitute the second symmetric type strip line resonator. The resonating elements 43*a*, 43*b* and 43*c* are opposed to one another through the dielectric layers 23 and 25, and constitute the third symmetric type strip line resonator. In this embodiment, the three sets of symmetric type strip line resonators each having three resonating elements are aligned in a direction perpendicular to the stacking direction in which the electrodes and layers are stacked.

In this embodiment, the interlayer earth electrodes 51*a*, 52*a* and 53*a* are formed on the first dielectric layer 21 at portions overlapping the open ends of the resonating elements 41*a*, 42*a* and 43*a*, respectively, the interlayer earth electrodes 52*c* and 53*c* are formed on the third dielectric layer 23 at portions overlapping the open ends of the resonating elements 42*a* and 43*a*, respectively, the interlayer earth electrodes 51*d* and 52*d* are formed on the fifth dielectric layer 25 at portions overlapping the open ends of the resonating elements 41*b* and 42*b*, respectively, and furthermore the interlayer earth electrodes 51*b*, 52*b* and 53*b* are formed on the seventh dielectric layer 23 at portions which overlap the open ends of the resonating elements 41*c*, 42*c* and 43*c*, respectively.

In this embodiment, the capacitances between the resonating elements and the interlayer earth electrodes can be made larger than the conventional filter. Moreover, since at portions where the interlayer earth electrodes are removed any other kinds of electrodes may be provided, the freedom in designing the filter can be enhanced.

Figure 17:
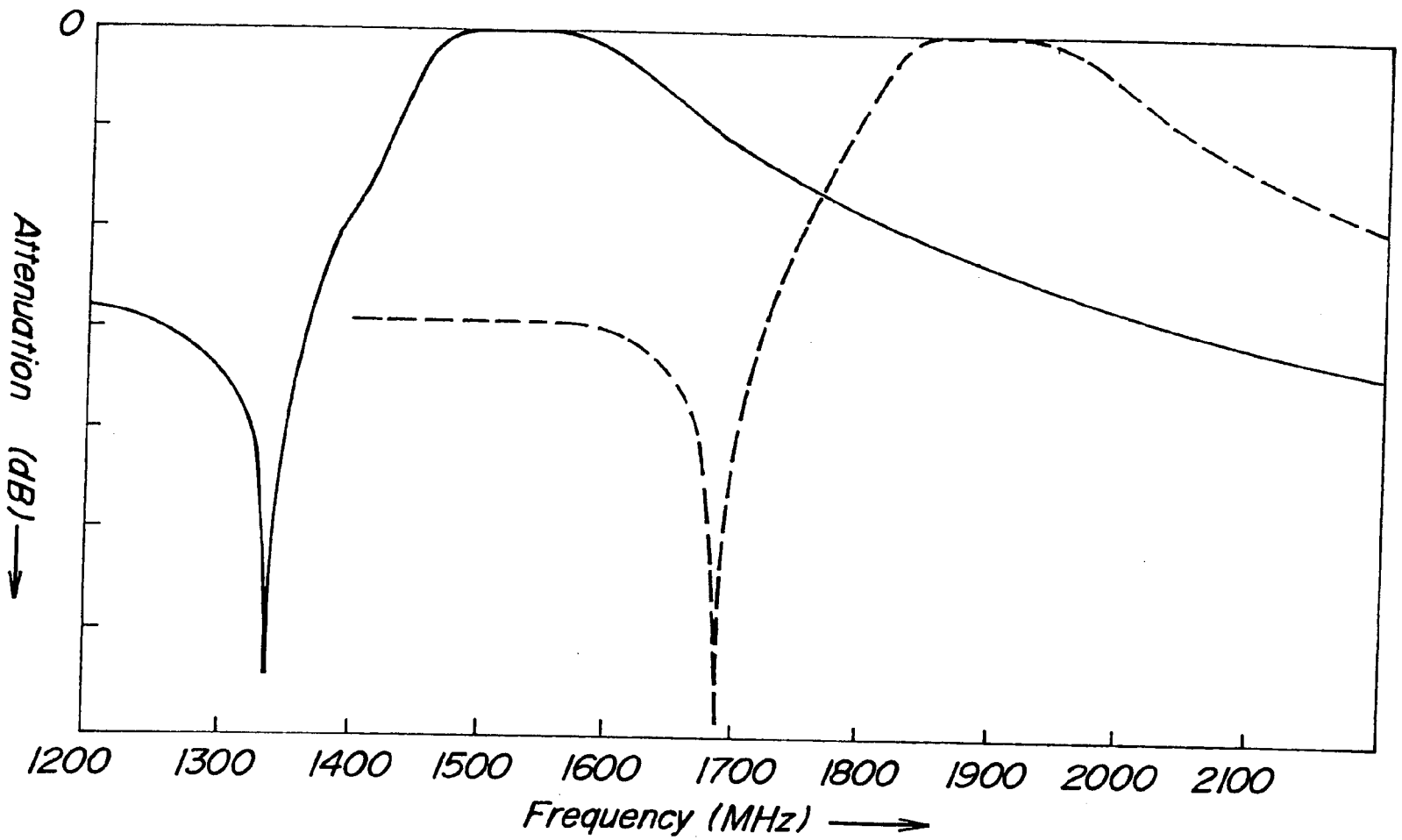
FIG. 17 is a graph expressing characteristics of the laminated type dielectric filter according to the present invention shown in FIG. 16 in comparison with characteristics of the known laminated type dielectric filter.

FIG. 17 shows the frequency characteristic of attenuation in the laminated type dielectric filter of the ninth embodiment shown in FIG. 13 according to the present invention in comparison with that of the conventional laminated type dielectric filter illustrated in FIG. 1. For comparison, the laminated type dielectric filter according to the present invention has the same outer dimension and the same number of resonator stages as those of the conventional laminated type dielectric filter.

In FIG. 17, a solid line A denotes the frequency characteristic of the laminated type dielectric filter having the structure shown in FIG. 13 according to the present invention, and a broken line B represents the frequency characteristic of the conventional laminated type dielectric filter shown in FIG. 1. As is apparent from the comparison of the solid line A with the broken line B, the laminated type dielectric filter of this invention has lower band pass frequency than that of the conventional laminated type dielectric filter.

Figure 18:
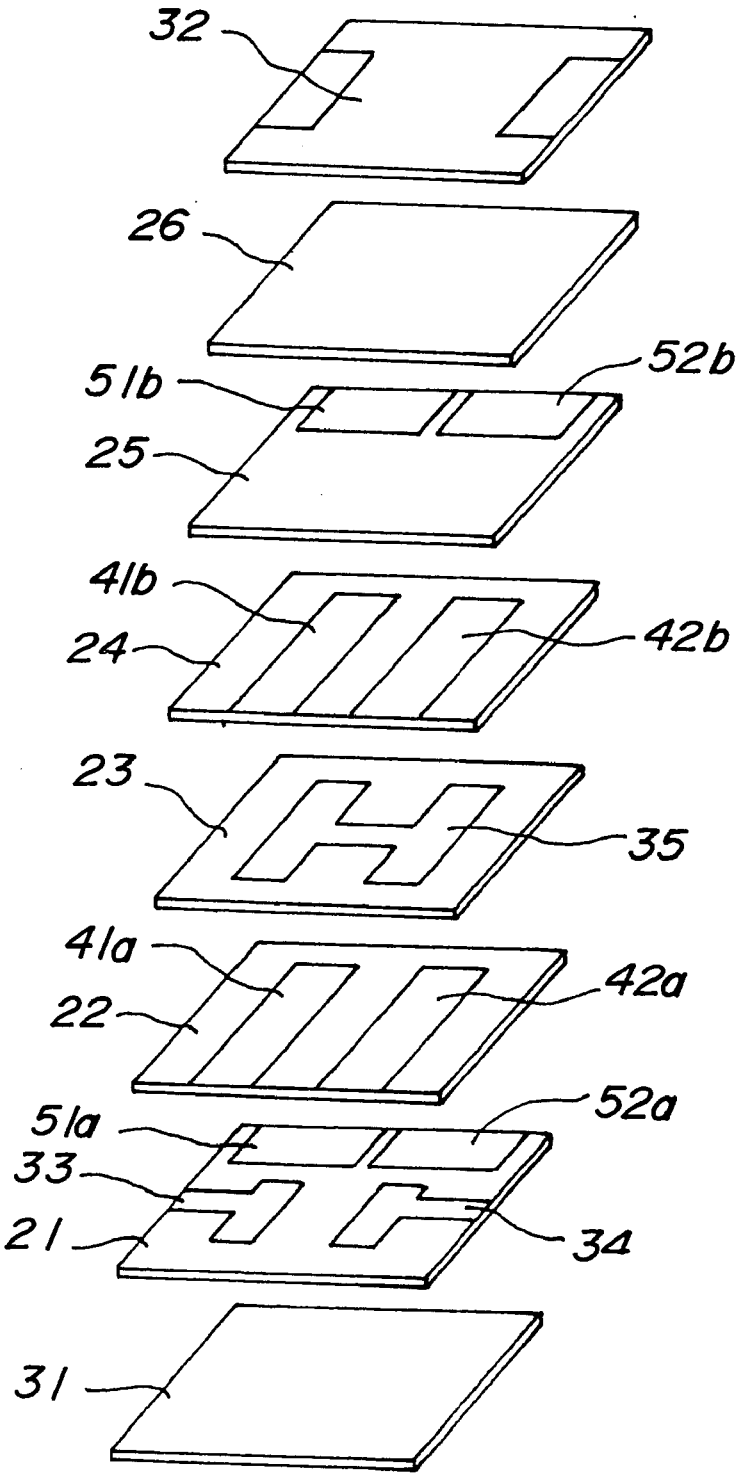
FIG. 18 is a schematic view showing a thirteenth embodiment of the laminated type dielectric filter according to the present invention.

FIG. 18 shows a thirteenth embodiment of the laminated type dielectric filter according to the present invention. In this embodiment, the filter has a successive stack structure of first to sixth dielectric layers 21 to 26. The earth electrodes 31 and 32 are provided on outer surfaces of the first and sixth dielectric layers 21 and 26, respectively, the input and output electrodes 33 and 34 are provided on the first dielectric layer 21, and the resonating elements 41*a*, 42*a*, and 41*b*, 42*b* are provided on surfaces of the second and fourth dielectric layers 22 and 24, respectively.

The interlayer earth electrodes 51*a* and 52*a* are arranged on the first dielectric layer 21 at portions overlapping the open ends of the resonating elements 41*a* and 42*a*, respectively arranged on the second dielectric layer 22, and the interlayer earth electrodes 51*b* and 52*b* are formed on the fifth dielectric layer 25 at portions opposed to the open ends of the resonating elements 41*b* and 42*b*, respectively formed on the fourth dielectric layer 24.

The resonating elements 41*a* and 41*b* are opposed to each other via the third dielectric layer 23, and constitute the first stage symmetric type strip line resonator. The resonator 42*a* and 42*b* are opposed to each other with interposing the third dielectric layer 23 therebetween and constitute the second stage symmetric strip line resonator. That is to say, in this embodiment, the filter has two sets of symmetric type strip line resonators aligned in the direction perpendicular to the stacking direction, each of said resonators including two resonating elements.

In this embodiment, the coupling electrode 35 connecting the first symmetric type strip line resonator to the second symmetric type strip line resonator is formed such that it is sandwiched between the resonating elements 41*a* and 41*b* of the first stage symmetric strip line resonator as well as between the resonating elements 42*a* and 42*b* of the second stage symmetric type strip line resonator.

In this manner, the coupling electrode 35 coupling the first and the second stage symmetric type strip line resonators with each other is provided on the third dielectric layer 23, and is sandwiched by the resonating elements 41*a*, 41*b* and 42*a*, 42*b* formed on the second and the fourth dielectric layers 22 and 24, respectively.

By providing the coupling electrode 35 coupling the first and second stage symmetric type strip line resonators with each other is arranged between the resonating elements 41*a* and 41*b* of the first stage symmetric type strip line resonator as well as between the resonating elements 42*a* and 42*b* of the second stage symmetric type strip line resonator, the capacitances between the resonating elements and the coupling electrode can be increased, and thus the pass band width of the filter can be adjusted over a wide range.

Figure 19:
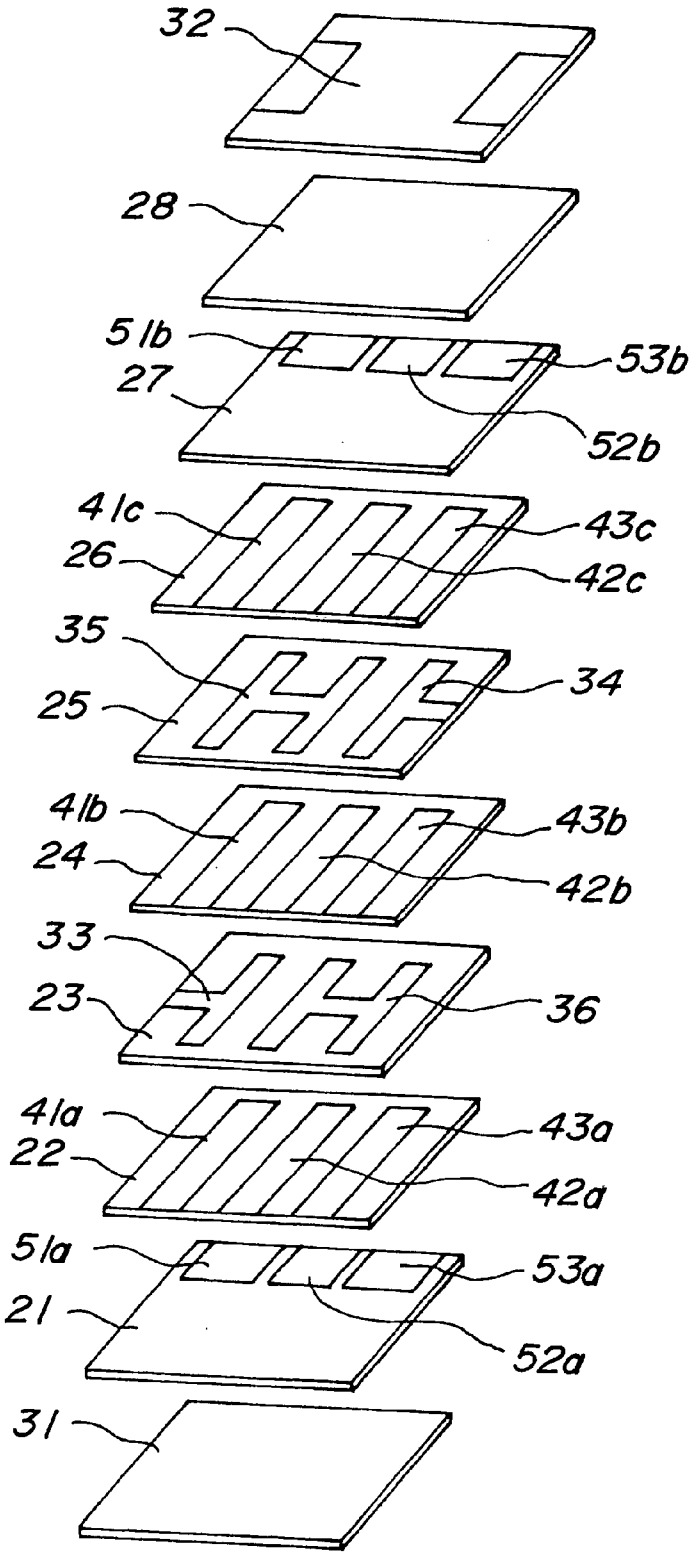
FIG. 19 is a schematic view depicting a fourteenth embodiment of the laminated type dielectric filter according to the present invention.

FIG. 19 shows a fourteenth embodiment of the laminated type dielectric filter according to the present invention. In this embodiment, the filter comprises three sets of symmetric type strip line resonators each being constituted by stacking three resonating elements via dielectric layers, and two coupling electrodes coupling these symmetric type strip line resonators are sandwiched by resonating elements.

That is, the filter has a structure of stacking first to eighth dielectric layers 21 to 28 in succession. The earth electrodes 31 and 32 are provided on outer surfaces of the first and eighth dielectric layers 21 and 28, respectively, the input electrode 33 is provided on the surface of the third dielectric layer 23, and the output electrode 34 is arranged on the surface of the fifth dielectric layer 25. Moreover, the coupling electrode 36 is arranged on the surface of the third dielectric layer 23 and the coupling electrode 35 is provided on the surface of the fifth dielectric layer 25. Resonating elements 41*a*, 42*a*, 43*a*; 41*b*, 42*b*, 43*b* and 41*c*, 42*c*, 43*c* are formed on surfaces of the second, fourth and sixth dielectric layers 22, 24 and 26, respectively. The interlayer earth electrodes 51*a*, 52*a*, 53*a* and 51*b*, 52*b*, 53*b* are provided on surfaces of the first and seventh dielectric layers 21 and 27, respectively.

The resonating elements 41*a*, 41*b* and 41*c* are opposed to one another via the dielectric layers 23 and 25 to constitute the first stage symmetric type strip line resonator, the resonating elements 42*a*, 42*b*, 42*c* are opposed to one another by means of the dielectric layers 23 and 25 to construct the second stage symmetric type strip line resonator, and the resonating elements 43*a*, 43*b*, 43*c* are opposed to one another via the dielectric layers 23 and 25 to constitute the third stage symmetric type strip line resonator. That is, in this embodiment, the filter has three sets of symmetric type strip line resonators which are aligned in the direction perpendicular to the stacking direction, each of said resonators having three resonating elements.

In this embodiment, the first coupling electrode 35 coupling the first and second stage symmetric type strip line resonators with each other is provided on the surface of the fifth dielectric layer 25 and is sandwiched between the resonating elements 41*b* and 41*c* of the first stage symmetric strip line resonator as well as between the resonating elements 42*b* and 42*c* of the second stage symmetric type strip line resonator. Similarly, the second coupling electrode 36 coupling the second and third stage symmetric type strip line resonators with each other is provided on the surface of the third dielectric layer 23 and is sandwiched between the resonating elements 41*b* and 41*c* of the second stage symmetric type strip line resonator as well as between the resonating elements 42*b* and 42*c* of the third stage symmetric type strip line resonator.

In this way, in this embodiment, each of the first and the second coupling electrodes 35 and 36 coupling the three sets of symmetric type strip line resonators composing the laminated type dielectric filter are sandwiched with the resonating elements, and therefore the capacitances between the resonating elements and the coupling electrodes can be increased and the pass band width of the filter can be adjusted over a wide range.

Figure 20:
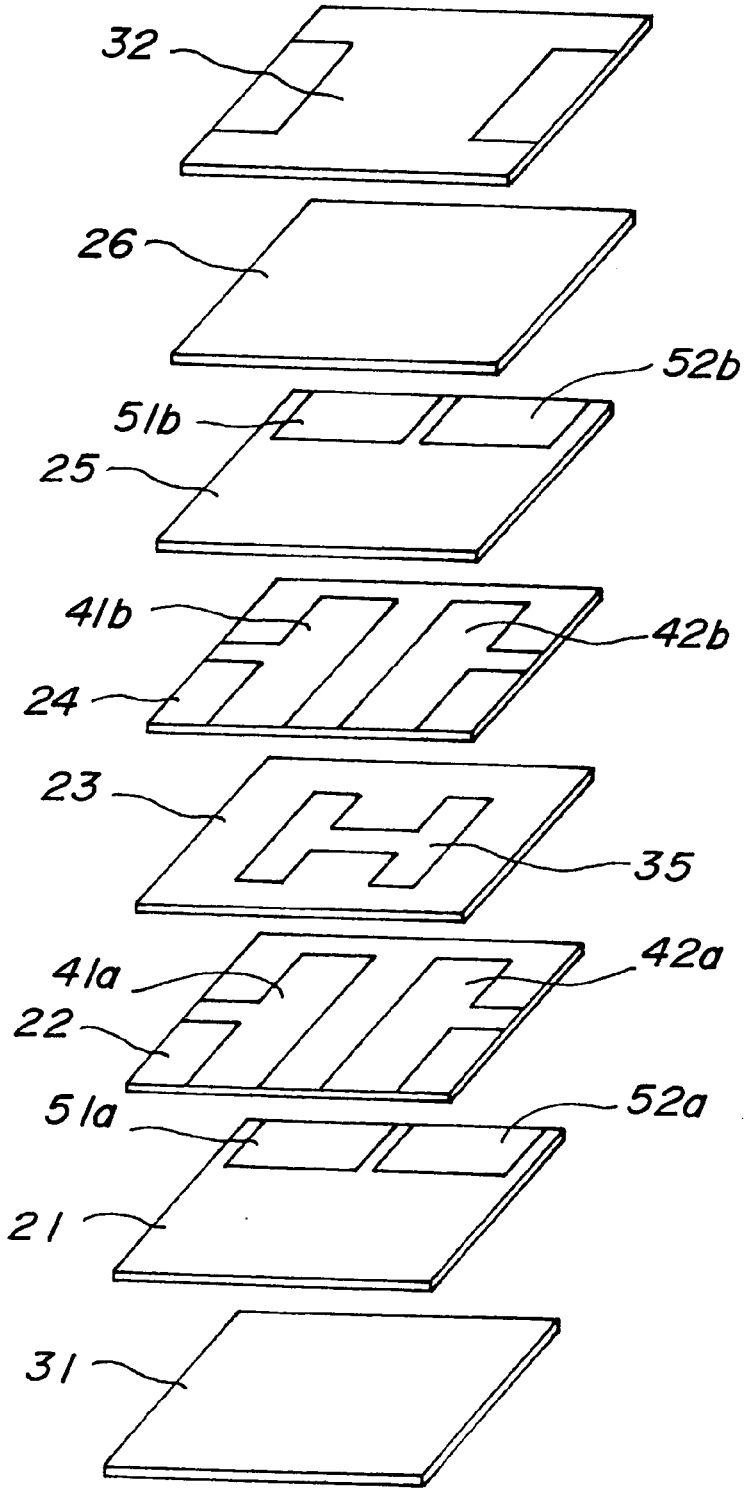
FIG. 20 is a schematic view showing a fifteenth embodiment of the laminated type dielectric filter according to the present invention.

FIG. 20 shows a fifth embodiment of the laminated type dielectric filter according to the present invention. In this embodiment, the input and output electrodes 33 and 34 are removed from the filter of the thirteenth embodiment illustrated in FIG. 18, the resonating elements 41*a* and 41*b* of the first stage symmetric type strip line resonator are directly connected to the input terminal, and the resonating elements 42*a* and 42*b* of the second stage symmetric type strip line resonator are directly connected to the output terminal, whereby the laminated type dielectric filter is constructed as of the L-tap type.

Also in this embodiment, the coupling electrode 35 to coupling the first and second symmetric type strip line resonators with each other is provided to be sandwiched between the resonating elements 41*a* and 41*b* and between the resonating elements 42*a* and 42*b*, and therefore the capacitances between the coupling electrode and the resonating elements can be increased.

Figure 21:
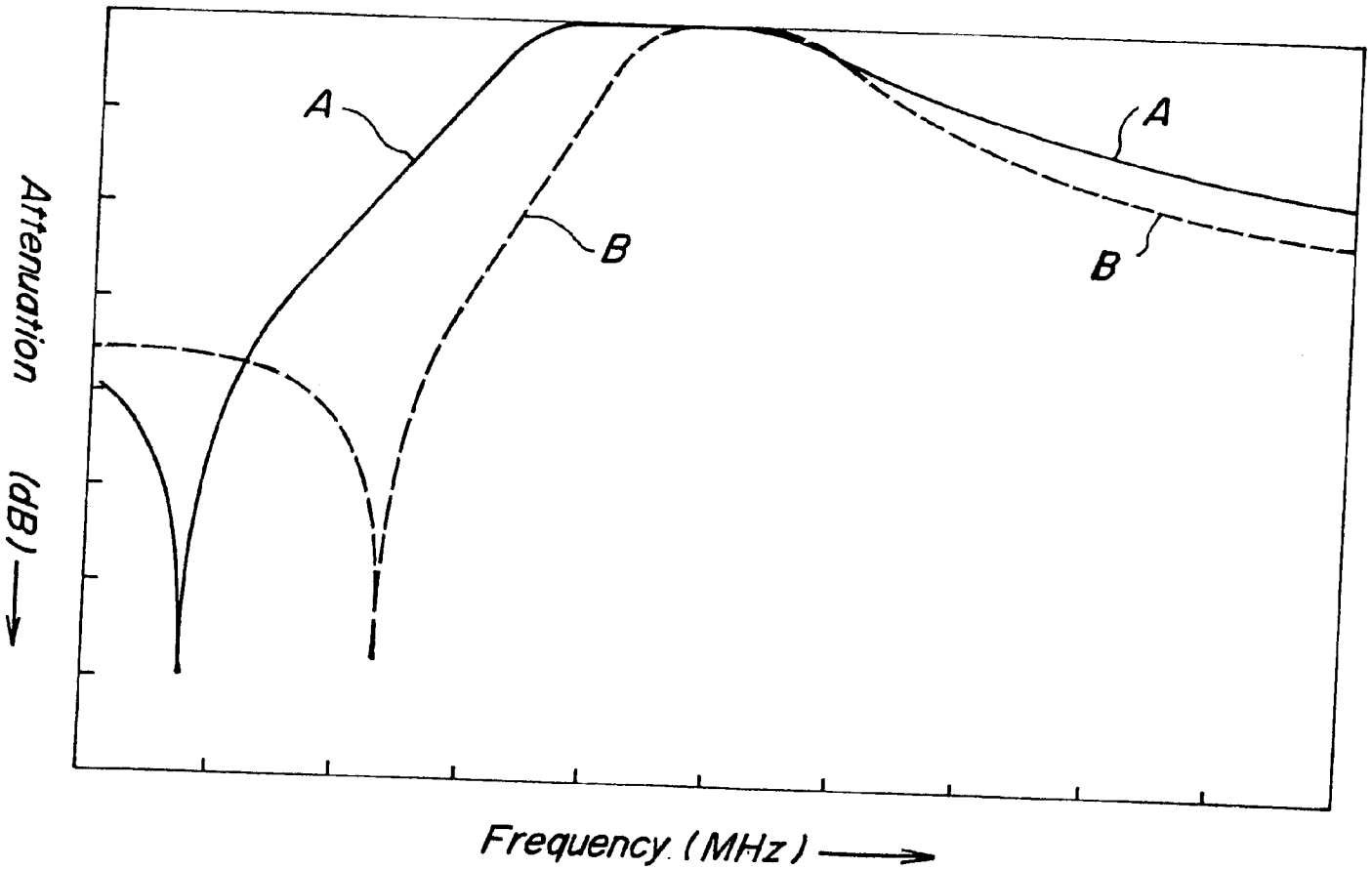
FIG. 21 is a graph representing characteristics of the laminated type dielectric filter according to the present invention shown in FIG. 20 in comparison with characteristics of the known laminated type dielectric filter.

FIG. 21 shows a frequency characteristic of the attenuation of the laminated type dielectric filter of the ninth embodiment shown in FIG. 18 in comparison with a frequency characteristic of the conventional laminated type dielectric filter. The attenuation depicted is denoted on a vertical axis with an arbitrary unit. In FIG. 21, a solid line A represents the frequency characteristic of the laminated type dielectric filter having the structure shown in FIG. 18, and a broken line B denotes the frequency characteristic of the conventional laminated type dielectric filter having the structure depicted in FIG. 1. As is apparent from these curves, these filters are of the capacitive type, in which an attenuation peak lies at a lower frequency than the pass band. A width of the pass band of the filter according to the present invention denoted by the curve A is broader than that of the conventional filter represented by the curve B. From this, it can be understood that the filter of the present invention has a larger capacitance between the coupling electrode and the resonating elements than the conventional filter. In this way, the laminated type dielectric filter according to the present invention can have the wider pass band width, and thus the pass band can be adjusted over a wider range.

Figure 22:
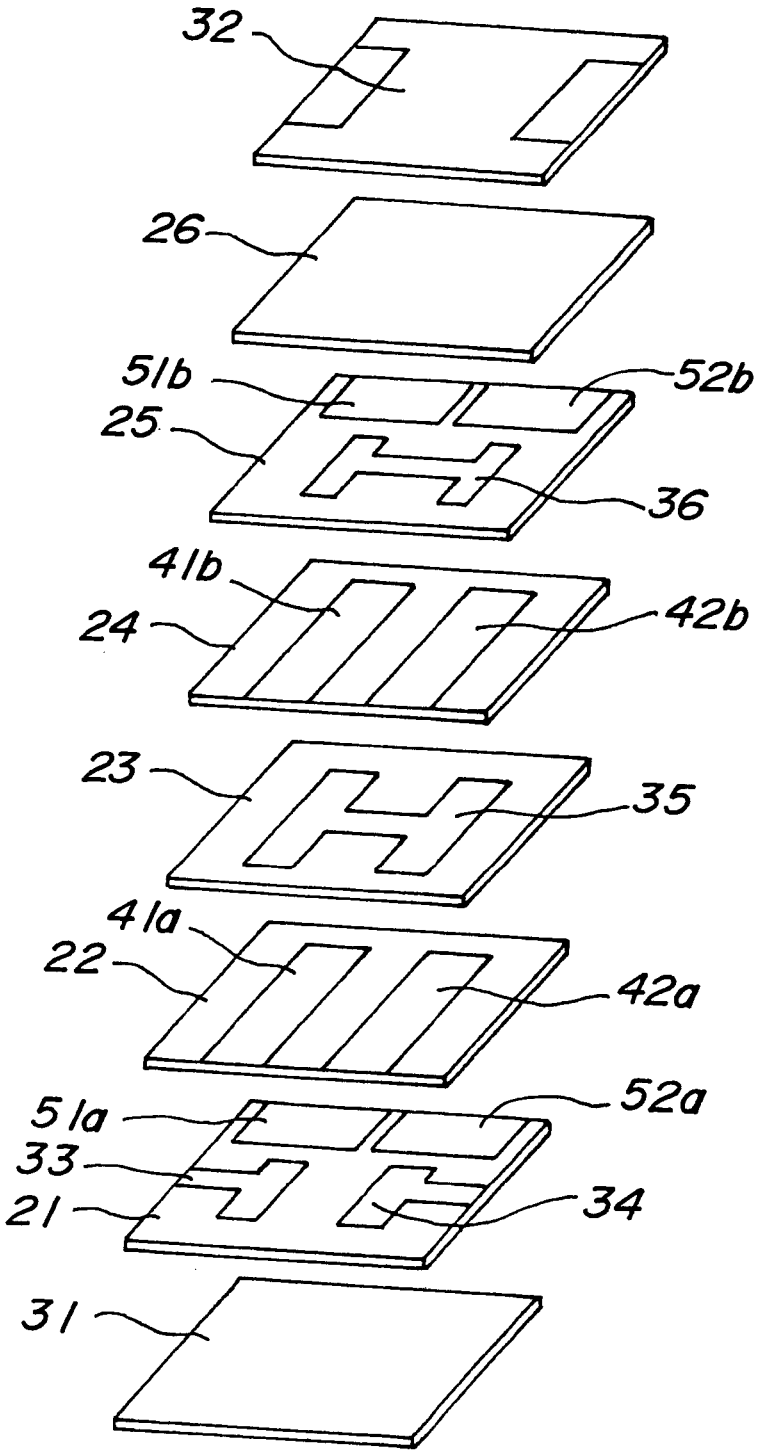
FIG. 22 is a schematic view showing a sixteenth embodiment of the laminated type dielectric filter according to the present invention.

FIG. 22 shows a sixteenth embodiment of the laminated type dielectric filter according to the present invention. This embodiment differs from the thirteenth embodiment shown in FIG. 18 in that the second coupling electrode 36 formed on the surface of the fifth dielectric layer 25 which situates above the strip line electrodes 41*b* and 42*b*. In this filter, since large capacitances are constituted between the second coupling electrode 36 and the strip line electrodes 41*b* and 42*b*, the filter can have, as a whole, larger capacitances, and consequently the pass band frequency can be further lowered and the adjustable range of the pass band can be further widened. Moreover, the filter can be made further smaller in size.

Figure 23:
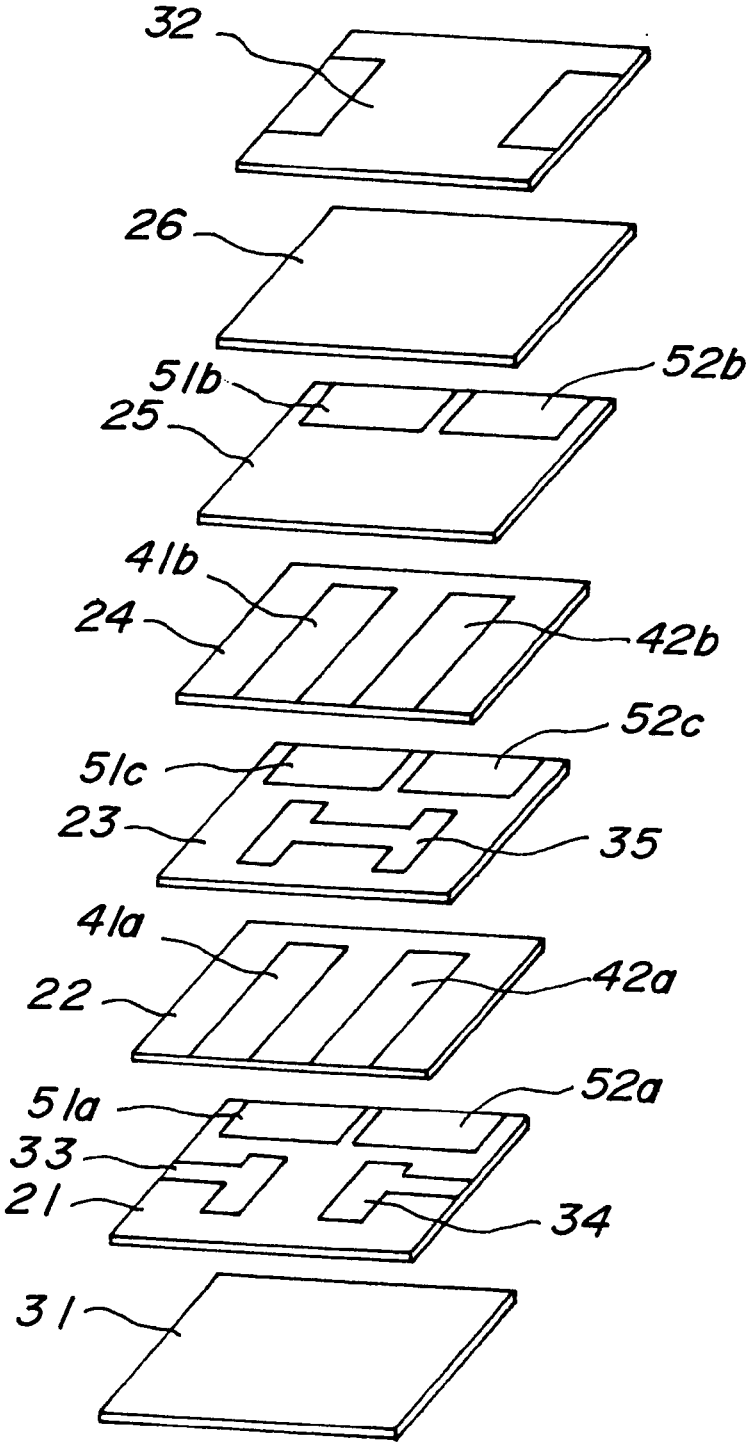
FIG. 23 is a schematic view illustrating a seventeenth embodiment of the laminated type dielectric filter according to the invention.

FIG. 23 shows a seventeenth embodiment of the laminated type dielectric filter according to the present invention. This embodiment differs from the thirteenth embodiment illustrated in FIG. 18 in that the interlayer earth electrodes 51*c* and 52*c* are provided on the surface of the third dielectric layer 23 on which the coupling electrode 35 is arranged such that the interlayer earth electrodes 51*c* and 52*c* overlap the strip line electrode 41*b* and 42*b*, respectively. According to such a structure, the strip line electrodes 41*a* and 41*b* are sandwiched with the interlayer electrodes 51*a*, 51*c* and 51*c*, 51*b*, respectively, and the strip line electrodes 42*a* and 42*b* are sandwiched by the interlayer electrodes 52*a*, 52*c* and 52*c*, 52*b*, respectively, and therefore capacitances are formed between the strip line electrodes and the interlayer electrodes, and thereby the pass band frequency of the laminated type dielectric filter can be lowered and the filter can be made smaller in size.

Generally, when the laminated type dielectric filter is of the capacitive type, the pass band is likely to be narrowed as the pass band frequency is lowered. According to the present invention, however, since the pass band width can be broadened by increasing the capacitance of coupling electrodes, the pass band frequency can be lowered without narrowing the pass band width. Moreover, since it is easy to decrease the electrostatic capacitance, the pass band frequency can be adjusted over a wide frequency range.

Figure 24:
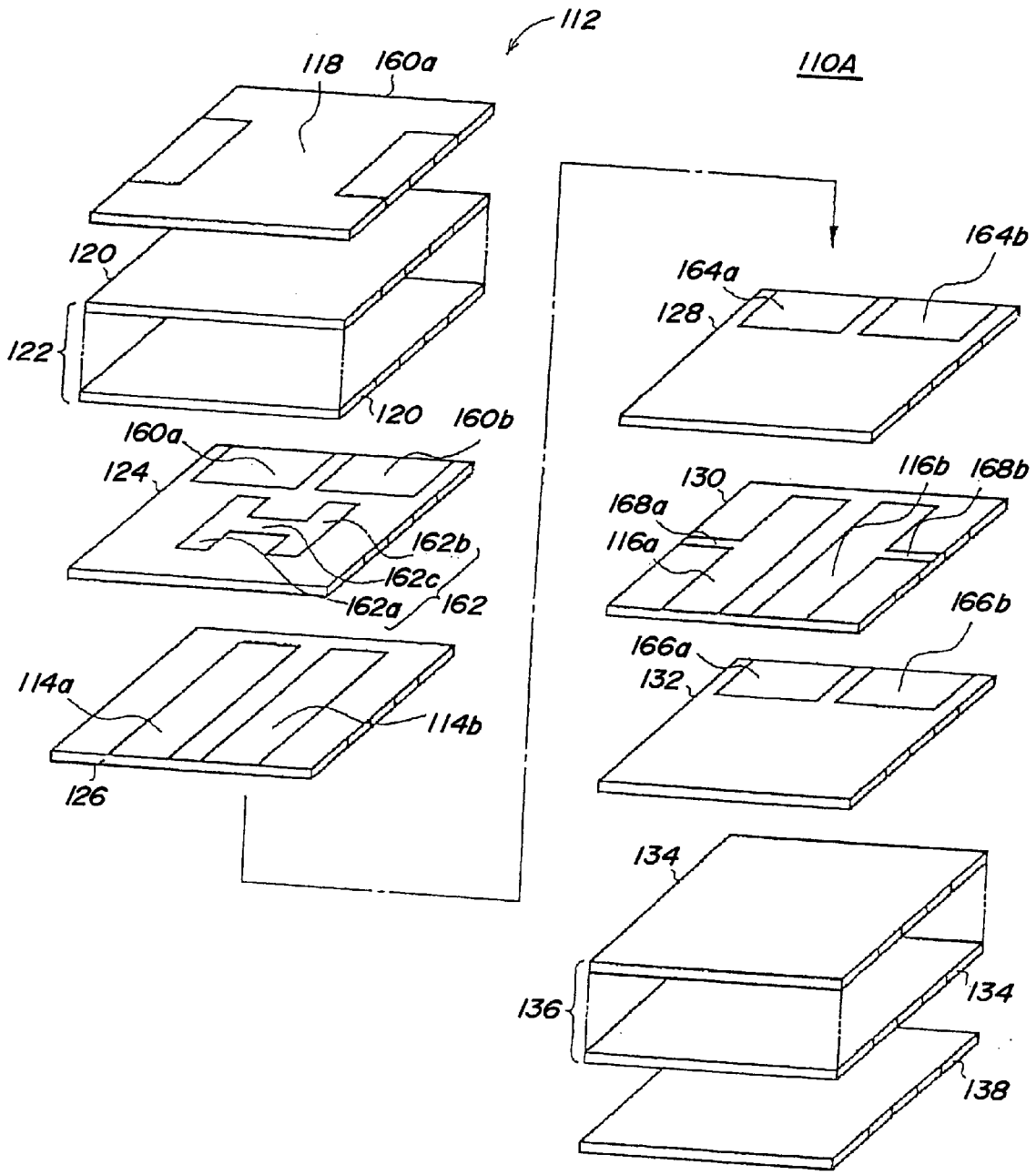
FIG. 24 is a schematic view depicting an eighteenth embodiment of the laminated type dielectric filter according to the present invention.

FIG. 24 shows an eighteenth embodiment of the laminated type dielectric filter according to the present invention. The laminated type dielectric filter 110A of this embodiment has a structure including two pairs of resonating elements 114*a*, 116*a* and 114*b*, 116*b* composing ¼λ type strip line resonators formed within a laminated body 112 composed by stacking and sintering a plurality of dielectric layers. The ¼λ type strip line resonator is constructed by aligning side by side the two sets of the resonators each having a pair of the resonating elements 114*a*, 116*a* and 114*b*, 116*b*.

As shown in FIG. 24, the laminated body 112 comprises, viewing from its top, a first dielectric layer 118, a laminated dielectric layer 122 composed of several second dielectric layers 120, third to seventh dielectric layers 124 to 132, a laminated dielectric layer 136 composed of several eighth dielectric layers, and a ninth dielectric layer 138.

Figure 25:
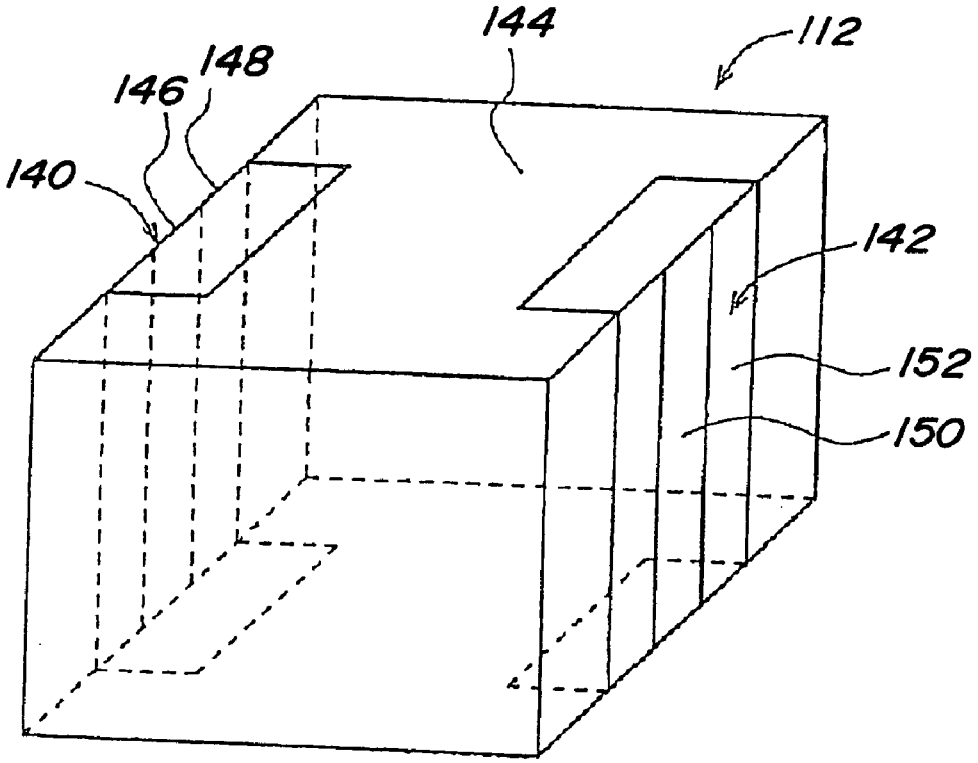
FIG. 25 is a perspective view showing an outer appearance of the laminated type dielectric filter shown in FIG. 24.

Moreover, as shown in FIG. 25, input and out terminal portions 140 and 142 are provided on left and right side surfaces, respectively of the laminated body 112, and an earth electrode 144 is formed on an entire surface of the laminated body except the input and the output terminal portions 140 and 142.

The input terminal portion 140 includes a rectangular input terminal 146 which is formed on the left side surface of the laminated body 112 at a middle thereof and extends in a direction of a thickness of the laminated body, and an area for isolating the input terminal 146 from the surrounding earth electrode 144 (on said area no electrode film is formed and is called, hereinafter, an input stage insulating area 148), and the output terminal portion 142 includes a rectangular output terminal 150 which is formed on the right side surface of the laminated body 112 at a middle thereof and extends in a direction of a thickness of the laminated body, and an area for isolating the output terminal 150 from the surrounding earth electrode 144 (on said area no electrode film is also formed and is called an output stage insulating area 152).

In this embodiment, said input insulating area 148 and output insulating area 152 are extended over the upper and lower surfaces of the laminated body 112.

In the filter 110A of this embodiment, two rectangular resonating elements 114*a*, 114*b* and 116*a*, 116*b* are formed on upper the surfaces of the fourth and the sixth dielectric layer 126 and 130, respectively such that they extend in one direction in parallel with each other.

Among the resonating elements 114*a*, 114*b* and 116*a*, 116*b*, the former resonating elements constitute input stage (a first stage) resonating elements 1114*a* and 116*a*, and the latter resonating elements constitute output stage (second stage) resonating elements 114*b* and 116*b*. One end of each of the resonating elements is connected to the earth electrode 144 and the other end is opened.

First and second interlayer electrodes 160*a*, 160*b* and a coupling electrode 162 are formed on a major surface of the third dielectric layer 124 positioned above the fourth dielectric layer 126. The first interlayer earth electrode 160*a* whose one end is connected to the earth electrode 144 is formed such that it is opposed to the open end portion of the input stage resonating element 114*a*. The interlayer earth electrode 160*b* having one end connected to the earth electrode 144 is formed such that it is opposed to the open end portion of the output stage resonating element 114*b*.

A coupling electrode 162 is electrically floating relative to the earth electrode 144 and the input and output terminals 146 and 150. The coupling electrode 162 comprises first and second rectangular electrode bodies 162*a* and 162*b* corresponding to the input and output stage resonating elements 114*a* and 114*b*, respectively, and said electrode bodies are electrically connected to each other by means of a lead electrode 162*c* formed therebetween.

On one major surface of the fifth dielectric layer 128 provided under the fourth dielectric layer 126, there are formed a first interlayer earth electrode 164*a* such that the first interlayer earth electrode 164*a* include one end portion connected to the earth electrode 144 and is opposed to the open end portions of the input stage resonating elements 114*a* and 114*b*, and a second interlayer earth electrode 164*b* whose one end is connected to the earth electrode 144 and which is opposed to the open end portions of the output stage resonating elements 114*b* and 116*b*.

On a main surface of the seventh dielectric layer 132 provided under the sixth dielectric layer 130, there are formed a first earth electrode 166*a* whose one end is connected to the earth electrode 144 and which is opposed to the open end portion of the input stage resonating element 116*a*, and a second interlayer earth electrode 166*b* whose one end is connected to the earth electrode 144 and which is opposed to the open end portion of the output stage resonating elements 116*b*.

Particularly, in the laminated type dielectric filter 110A of the eighteenth embodiment, the lower resonating element 116*a* among the two input stage resonating elements 114*a* and 116*a* arranged one on the other is directly connected to the input terminal 146 by means of a lead electrode 168*a*, and the lower resonating element 116*b* among the two input stage resonating elements 114*b* and 116*b* arranged one on the other is directly connected to the input terminal 150 by means of a lead electrode 168*b*.

The laminated type dielectric filter 110A in the present embodiment has the above mentioned fundamental construction. Now the electrical coupling between the various kinds of electrodes will be described with reference to FIGS. 26 to 28. First of all, as depicted in FIG. 26, capacitances C1, C2, C3, and C4 are formed between the open end portion of the upper input resonating element 114*a* and each of the first interlayer earth electrodes 160*a*, 164*a*, and between the open end portion of the upper output resonating element 114*b* and each of the second interlayer earth electrodes 160*b*, 164*b*.

Capacitances C5, C6, C7, and C8 are formed between the open end portion of the lower input resonating element 116*a* and each of the first interlayer earth electrodes 164*a*, 166*a*, and between the open end portion of the output resonating element 116*b* positioned upward and each of the lower second interlayer earth electrodes 164*b*, 166*b*.

Figure 26:
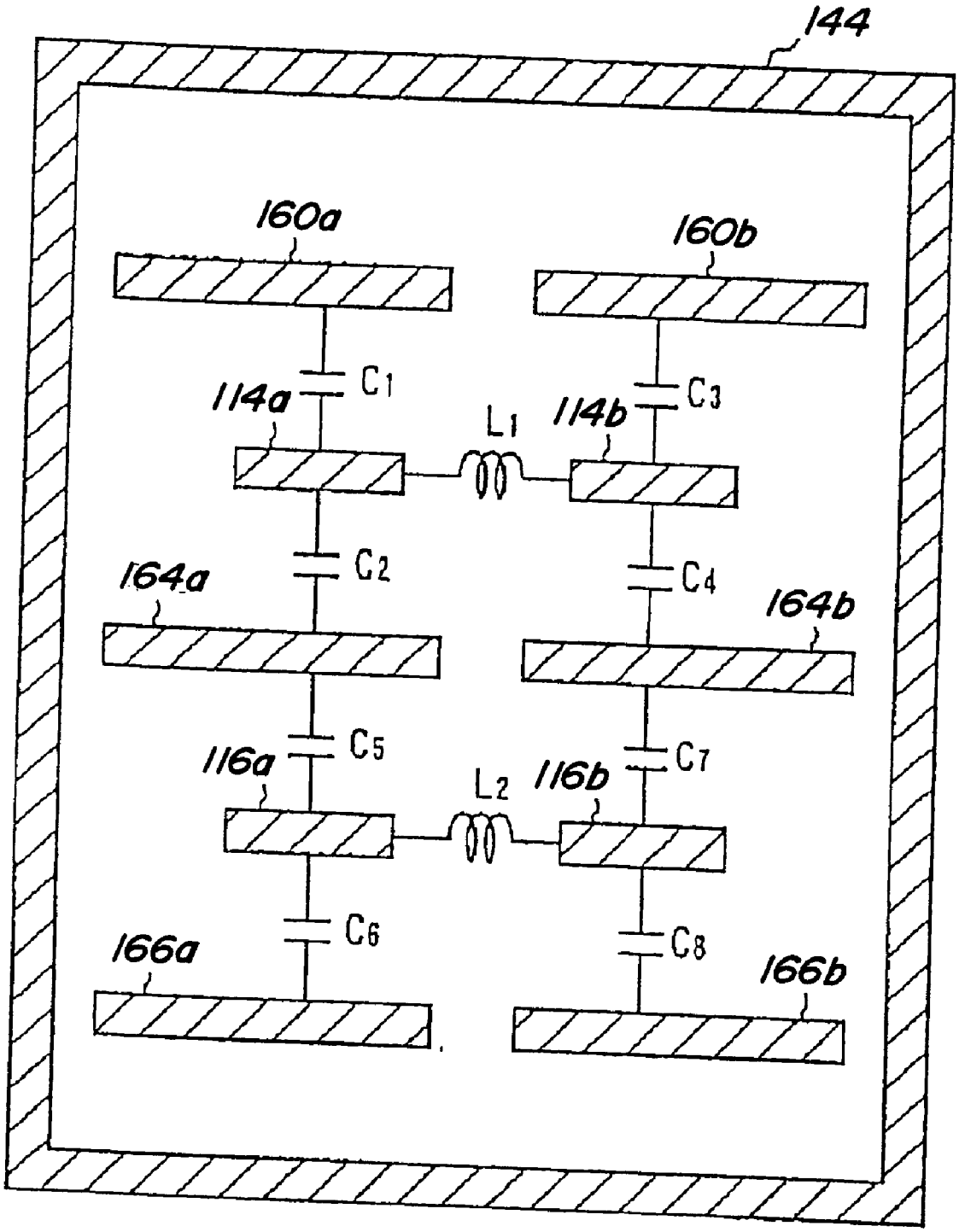
FIG. 26 is a schematic cross sectional view of the filter shown in FIG. 24 cut along a line perpendicular to a surface on which interlayer earth electrodes are formed.

The input resonating element 114*a* and the output resonating element 114*b* are inductively coupled with each other, and an inductance LI is interposed between these resonating elements 114*a* and 114*b* on the equivalent circuit(refer to FIG. 26). Moreover, the input resonating element 116*a* and the output resonating element 116*b* are inductively coupled with each other, and an inductance L2 is interposed between these resonating elements 116*a* and 116*b* on the equivalent circuit(see FIG. 26).

Figure 27:
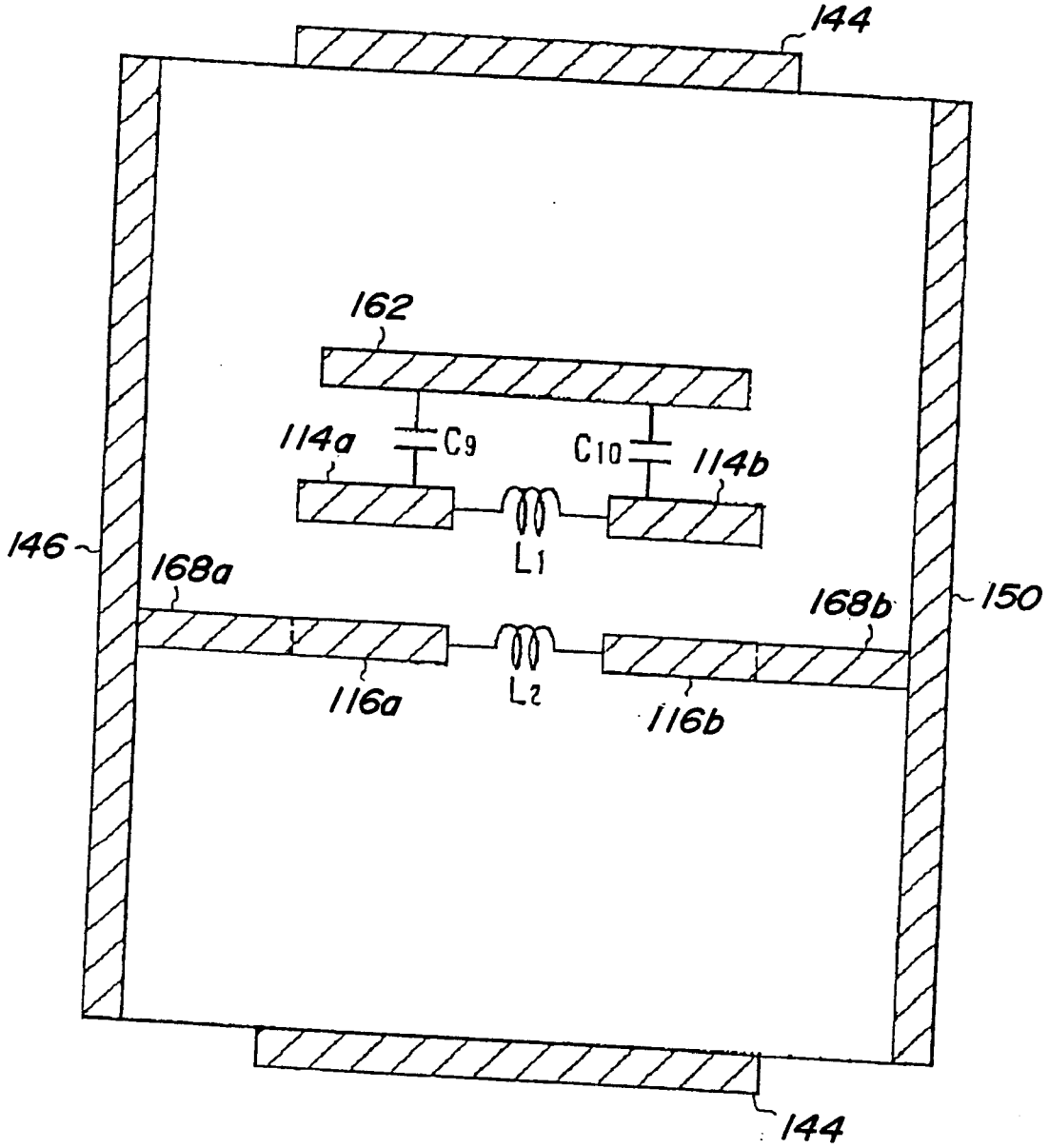
FIG. 27 is a schematic cross sectional view of the filter shown in FIG. 24 cut along a line perpendicular to a surface on which lead electrodes are formed.

Furthermore, as shown in FIG. 27, capacitances C9 and C10 are formed between the coupling electrode 162 and the input resonating element 114*a* as well as the output resonating element 114*b*, respectively.

By the way, in the laminated type dielectric filter 110A, the provision of two pairs of the resonating elements 114*a*, 114*b* and 116*a*, 116*b* on the main surfaces of the fourth and the sixth dielectric layers 126 and 130, respectively is equivalent to stack a plurality of the resonating elements 114*a* and 116*a* as well as a plurality of resonating elements 114*b* and 116*b*. In this case, since the resonating elements 114*a*, 116*a* and 114*b*, 116*b* are supplied with the same signal, an electrical field is not generated between the resonating elements 114*a* and 116*a* as well as between the resonating elements 114*b* and 116*b*. Thus, for example, the input resonating elements 114*a*, 116*a* are considered as a set of input stage symmetric type strip line resonator 300*a* (refer to FIG. 28). Similarly, the output resonating elements 114*b* and 116*b* are considered as a set of output stage symmetric type strip line resonator 300*b*.

Figure 28:
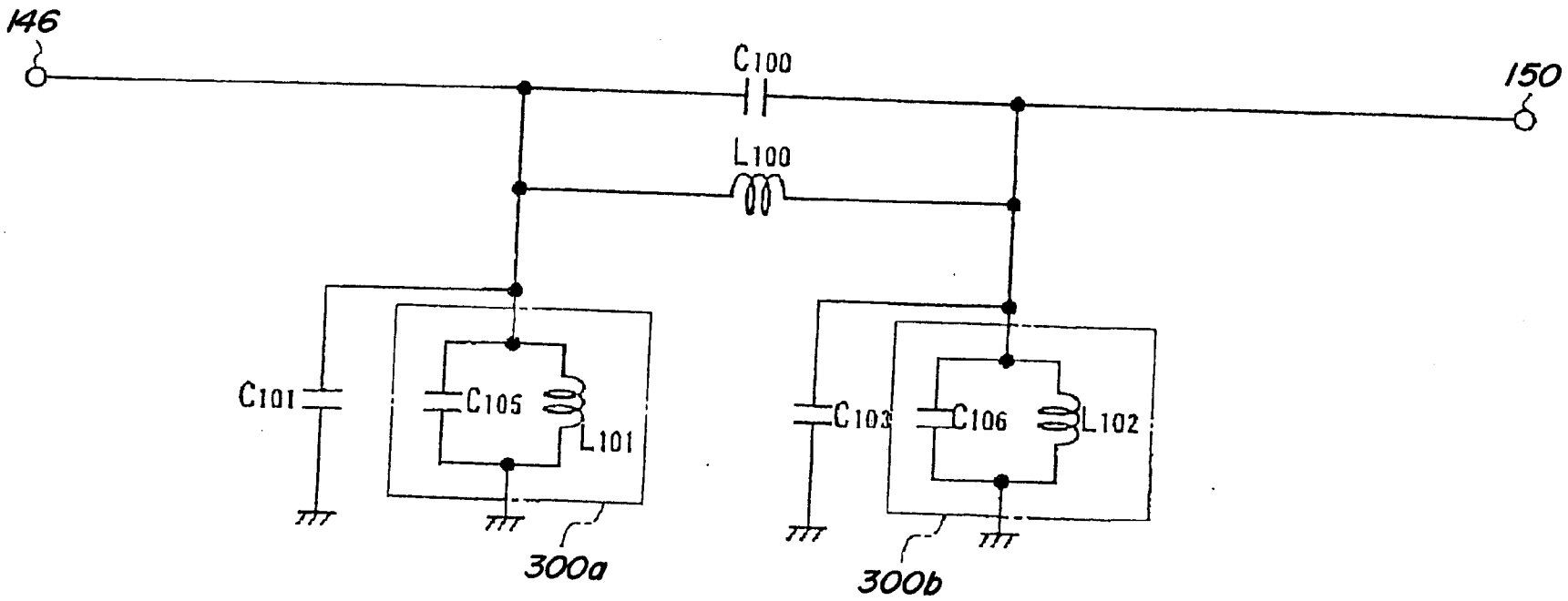
FIG. 28 is an equivalent circuit of the filter shown in FIG. 24.

In this manner, the laminated type dielectric filter 110A may be expressed by the equivalent circuit shown in FIG. 28 and constitutes a band pass filter.

In FIG. 28, a capacitance C100 denotes a combined capacitance of the capacitance C9 between the input resonating element 114*a* and the coupling electrode 162 and the capacitance C10 between the output resonating elements 114*b* and the coupling electrode 162. An inductance L100 represents a combined inductance of an inductance L1 between the resonating elements 114*a* and 114*b* and an inductance L2 between the resonating elements 116*a* and 116*b*.

Moreover, a capacitance C101 is a combined capacitance of the capacitances C1, C2, C5, and C6 between the input resonating elements 114*a*, 116*a* and the first interlayer earth electrodes 160*a*, 164*a*, 166*a*. Capacitance C103 is a combined capacitance of the capacitances C3, C4, C7, and C8 between the input resonating elements 114*b*, 116*b* and the first interlayer earth electrodes 160*b*, 164*b*, 166*b*.

Capacitance C105 and inductance L101 are capacitance and inductance in an equivalently converted input stage resonator 300*a*, and capacitance C106 and inductance L102 are capacitance and inductance in an equivalently converted output stage resonator 300*b*.

In the laminated type dielectric filter 110A, since the coupling electrode 162 is formed on the main surface of the third dielectric layer 124, the capacitances C9 and C10 are formed between the coupling electrode 162 and the input resonating element 114*a* and between the coupling electrode 162 and the output resonating element 114*b*.

In the equivalent circuit shown in FIG. 28, since a combined capacitance of the capacitances C9 and C10 is coupled in parallel with the inductance L1 formed between the input resonating element 114*a* and the output resonating element 114*b*, the degree of the inductive coupling can be adjusted by the capacitances C9, C10. Consequently, the laminated type dielectric filter having a desired pass band width can be obtained.

The capacitances C9, C10 can be easily adjusted by changing an overlapping surface area and a distance between the input resonating element 114*a* and the coupling electrode 162 as well as an overlapping surface area and a distance between the output resonating element 114*b* and the coupling electrode 162.

The combined capacitance formed by the coupling electrodes 162 is connected in parallel with the inductive coupling L1 between the resonating elements 114*a*, 114*b*, and therefore a parallel resonance circuit is connected across the adjacent resonating elements 114*a* and 114*b*. The impedance of the parallel resonance circuit including the combined capacitance of the capacitances C9, C10 and the inductance L1 is changed from inductive to capacitive in the vicinity of its parallel resonant frequency. Thus, the coupling between the resonating elements 114*a* and 114*b* may be either inductive or capacitive by adjusting the capacitances C9 and C10 formed between the adjacent resonating elements 114*a*, 114*b* and the coupling electrode 162.

In the case of establishing the inductive coupling between the resonating elements 114*a* and 114*b*, the laminated type dielectric filter having an attenuation peak on a higher frequency side of the pass band can be obtained because the parallel resonance frequency situates on a higher frequency side. In the case of forming the capacitive coupling between the resonating elements 114*a* and 114*b*, the laminated type dielectric filter having an attenuation peak on a lower frequency side of pass band can be obtained because the parallel resonance frequency is on a lower frequency side. Thus, in both cases, the attenuation characteristic of the filter can be improved.

In the laminated type dielectric filter 110A of this embodiment, the lower input resonating element 116*a* of the two input resonating elements 114*a*, 116*a* is directly connected to the input terminal 146 through the lead electrode 168*a*, and the lower output resonating element 116*b* of the two input resonating elements 114*a*, 116*a* is directly connected to the input terminal 150 through the lead electrode 168*b*. Thus, the impedance of the input stage resonator 300*a* and the impedance of the output stage resonator 300*b* are increased, and therefore the adjustable range of the input impedance and output impedance of the filter can be widened. Consequently, the adjustment for increasing the return loss of the filter can be easily performed, and thus the filter can be small in size, the pass band frequency can be lowered, and insertion loss can be reduced.

Figure 29:
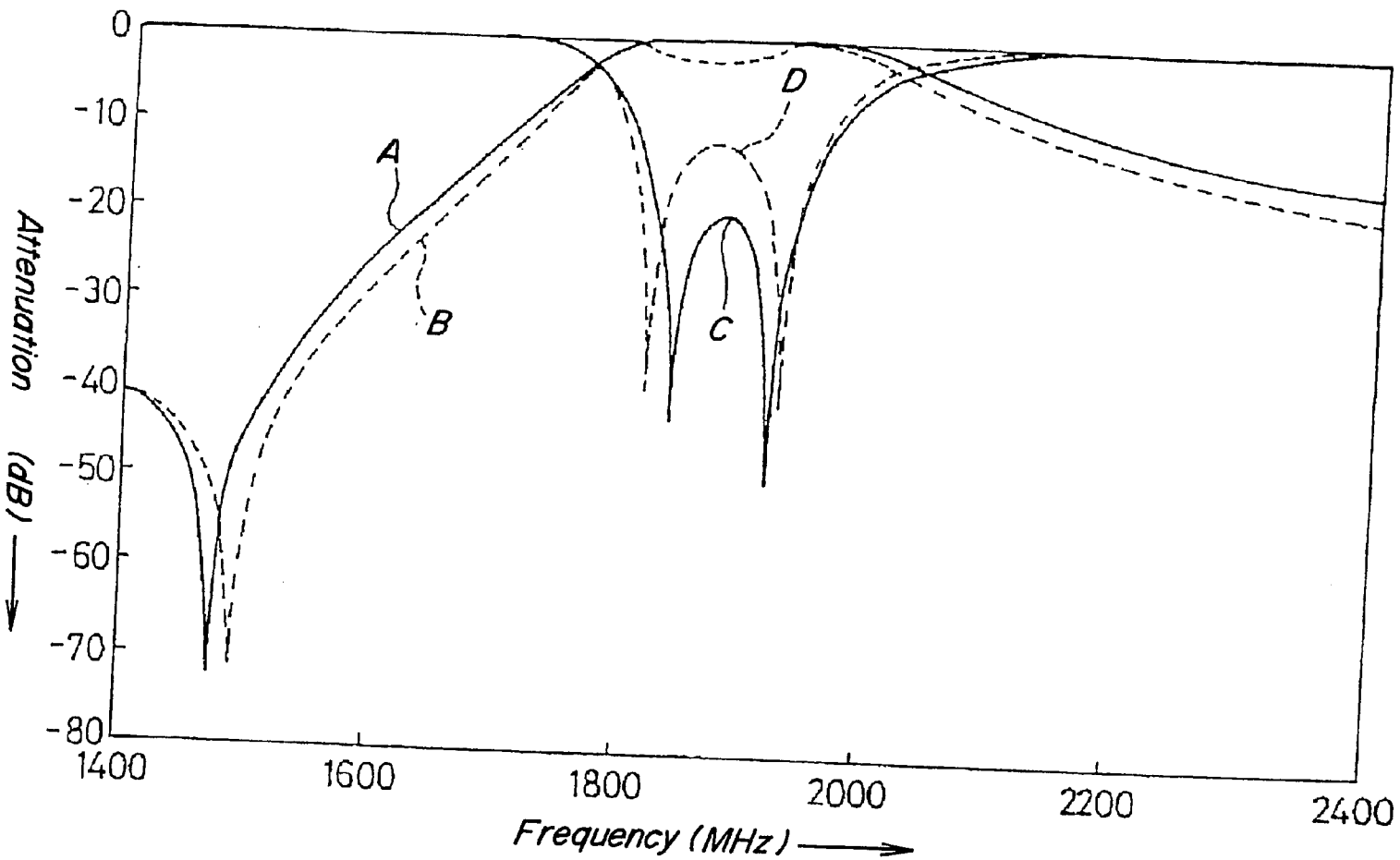
FIG. 29 is a graph representing frequency characteristics of the filters shown in FIGS. 15 and 24, in which the capacitive coupling is formed between the resonating elements by adjusting each coupling electrodes.

FIG. 29 shows the frequency characteristic of the above eighteenth embodiment in comparison with that of the eleventh embodiment shown FIG. 15. Hereupon, in these embodiments, the coupling electrodes (162, 35) are adjusted such that the capacitive coupling is established between the resonating elements (114*a*, 41*b*) and the resonating elements (114*b*, 42*b*).

In the eighteenth embodiment, only one resonating element (116*a*) of the two resonating elements composing the input stage symmetric strip line resonator is directly connected to the input terminal and only one resonating element (116*b*) of the two resonating elements composing the output stage symmetric strip line resonator is directly connected to the output terminal, while in the eleventh embodiment, both of the two resonating elements composing the input stage symmetric strip line resonator are directly connected to the input terminal and both of the two resonating elements composing the output stage symmetric strip line resonator are directly connected to the output terminal.

In FIG. 29, a solid line A and a broken line B represent the frequency characteristics of the eighteenth and the eleventh embodiments, respectively, and a solid line C and a broken line D denote the return loss characteristics of the eighteenth and the eleventh embodiments, respectively.

In both of the eighteenth and eleventh embodiments, the filters have the frequency characteristics in which a central frequency of pass band is about 1990 MHz, but are clearly different in their return loss. That is to say, in the eleventh embodiment, the peak of the return loss (peak of small attenuation) is about 1870 MHz, and the peak value is about −12 dB. Since in the filter of the eleventh embodiment, the return loss is insufficient, as shown in the broken line D of FIG. 29, the frequency characteristic within the pass band (pass band characteristic) has a ripple.

On the other hand, in the eighteenth embodiment, the peak of the return loss (peak of small attenuation) is about 1880 MHz, and the peak value is about −20 dB. That is, the filter of the eighteenth embodiment has a larger return loss than that of the eleventh embodiment, and the pass band characteristic is much smoother and does not contain a ripple as shown in the solid line C of FIG. 29.

From the results shown in FIG. 29, by decreasing the number of resonating elements directly connected to the input and output terminals, the input impedance and output impedance of the filter can be adjusted over a wide range, and therefore the filter can be small in size, the band pass frequency can be lowered, the insertion loss can be decreased and the return loss can be increased.

In the laminated type dielectric filter 110A of the eighteenth embodiment, the first and second interlayer earth electrodes 160*a* and 160*b* are formed on one main surface of the third dielectric layer 128, the first and second interlayer earth electrodes 164*a* and 164*b* are formed on one main surface of the fifth dielectric layer 128, and the first and second interlayer earth electrodes 166*a* and 166*b* are formed on one main surface of the seventh dielectric layer. Therefore, to the capacitances C105 and C106 of the resonators 300*a* and 300*b* obtained by equivalently converting the resonating elements 114*a*, 114*b* and 116*a*, 116*b* are added to the combined capacitances C101 and C103, and it is sufficient for these resonators to have a small inductance, if the resonance frequencies of the resonators are identical with each other. Consequently, the lengths of the resonating elements 114*a*, 114*b* and 116*a*, 116*b* may be shortened, and the whole length of the laminated type dielectric filter may be shortened.

In this case, if a length of the resonating elements 114*a*, 114*b* is shortened, while the overlapping surface areas between the respective resonating elements 114*a*, 114*b* and 116*a*, 116*b* and the first and second interlayer earth electrodes 160*a*, 164*a*, and 160*b*, 164*b* are increased for making the laminated type dielectric filter smaller, the input stage symmetric strip line resonator 300*a* and the output stage symmetric strip line resonator 300*b* are much more strongly coupled with each other inductively and the pass band width of the filter is too broadened. In the eighteenth embodiment, however, since the coupling electrode 162 is provided on the one main surface of the third dielectric layer 124, the inductive coupling between the symmetric type strip line resonators 300*a* and 300*b* can be reduced by adjusting the capacitances C9, C10 formed between the coupling electrode 162 and the resonating elements 114*a*, 114*b*, and the laminated type dielectric filter having a desired pass band width can be obtained.

Next, a method of manufacturing the laminated type dielectric filter of the eighteenth embodiment will be described hereinafter. In this filter, two pairs of the resonating elements 114*a*, 116*a*, and 114*b*, 116*b*, the coupling elements 162, the first interlayer earth electrodes 160*a*, 164*a*, 166*a*, the second interlayer earth electrodes 160*b*, 164*b*, 166*b*, and the lead electrodes 168*a*, 168*b* are completely embedded within the laminated body 112, and therefore these electrodes are preferably made of materials having a low resistivity for reducing an insertion loss.

The dielectric layers are preferably made of a dielectric material having a high reliability and a high dielectric constant, i.e. ceramic dielectric material. Then the filter can be formed to have a sufficiently small size.

Moreover, the dielectric ceramic material is preferably made by the following process. After forming electrode patterns by applying an electrically conductive paste onto molds of ceramic powders, the molds are stacked, and a stacked assembly is sintered to obtain a condensed body, in which conductors are embedded within the ceramic dielectric body as a laminated manner.

In the case of employing Ag based and Cu based electrically conductive materials, since they have low melting points and could not be used together with conventional dielectric materials, it is necessary to use a dielectric material which can be sintered at a temperature not more than melting points (not more than 1000° C.) of said conductive materials.

From a view point of desired characteristics of the high frequency filter, it is preferable to use a dielectric material by means of which a temperature dependency (temperature coefficient) of the resonance frequency of the parallel resonance circuit of the filter is not more than ±50 ppm/° C.

As such a dielectric material, use may be made of, for example, a glass based material such as a mixture of cordierite based glass powder, $TiO_2$ powder and $Nd_2Ti_2O_7$ powder, a $BaO—TiO_2—Re_2O_3—Bi_2O_3$ (Re: rare-earth component) based material having a small amount of glass-forming element compounds or glass powders added thereto, and a $BaO—TiO_2—Nd_2O_3$ based dielectric magnetic powder having a small amount of glass powders added thereto.

In an example, a mixture of 73 wt % of a glass powder having a composition of MgO:18 wt % —$Al_2O_3$:37 wt % —$SiO_2$:37 wt % —$B_2O_3$:5 wt % —$TiO_2$:3 wt %, 17 wt % of a commercially available $TiO_2$ powder, and 10 wt % of a $Nd_2Ti_2O_7$ powder was employed.

The $Nd_2Ti_2O_7$ powder was formed by pre-firing a $Nd_2O_3$ powder and a $TiO_2$ powder at 1200° C. and thereafter crushing a sintered body.

Then, to the mixed powders were added an acrylic organic binder, an elasticizer, a toluene, and an alcohol based flux, and the thus obtained mixture was sufficiently mixed by alumina balls to form a slurry. Green tapes having a thickness of 0.2 mm to 0.5 mm were formed by treating the slurry with a doctor blade method.

Next, by employing an Ag paste as the electrically conductive paste, the conducting patterns were printed on the green tapes as shown in FIG. 24, and green tapes were stacked on the green tapes having the printed conductive patterns formed thereon as shown in FIG. 24 to obtain the green plates having a desired thickness. Next, the stacked body was fired at a temperature of 900° C. to form the laminated body 112.

The earth electrode 144 formed by an Ag electrode was printed on the outer surface of the laminated body except for the input and output terminal parts 140, 142 as shown in FIG. 25, and the input and the output terminals 146, 150 were formed by printing Ag electrodes within to be insulated from the earth electrode 144 and to be connected to the input and output lead electrodes 168*a*, 168*b* (see FIG. 24) were printed within the input and output terminal parts 140, 142. Then, the printed electrodes 144, 146 and 150 were fired at a temperature of 850° C.

Figure 30:
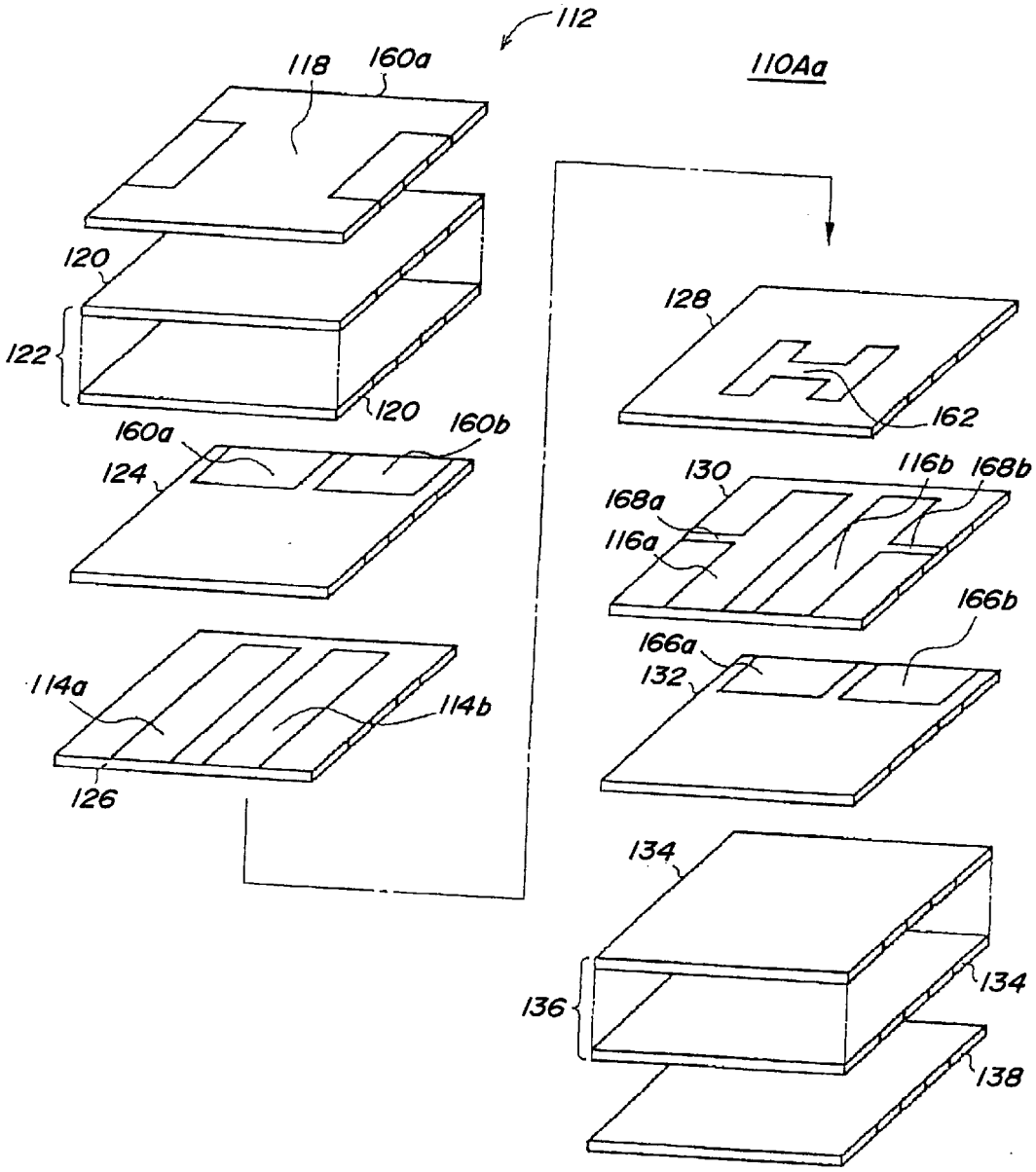
FIG. 30 is a schematic view showing a nineteenth embodiment of the laminated type dielectric filter according to the present invention.

FIG. 30 shows a nineteenth embodiment of the laminated type dielectric filter according to the present invention. The laminated type dielectric filter 110A*a* of this embodiment has a similar structure to that of the filter 110A of the eighteenth embodiment (FIG. 24), but the filter of this embodiment differs from the structure of the filter 110A of the eighteenth embodiment in that only the first and the second interlayer earth electrodes 160*a*, 160*b* are arranged on one main surface of the third dielectric layer 124 and a single coupling electrodes 162 is arranged on one main surface of the fifth dielectric layer 128.

Also in the laminated type dielectric filter of the present embodiment, the lower input resonating element 116*a* of the two input resonating elements 114*a*, 116*a* stacked one on the other is directly connected to the input terminal 146 through the lead electrode 168*a*, and the lower output resonating element 116*b* of the two output resonating elements 114*b*, 116*b* stacked one on the other is directly connected to the output terminal 150 through the lead electrode 168*b*. Therefore, an impedance of the input stage resonator 300*a* viewed from the input terminal and an impedance of the output stage resonator 300*b* viewed from the output terminal become large, and thus the input impedance as well as the output impedance of the filter can be adjusted over a wide range.

Consequently, the adjustment for increasing the return loss can be easily carried out, and it is possible to make the filter small in size, to lower the pass band frequency and to reduce the insertion loss.

Figure 31:
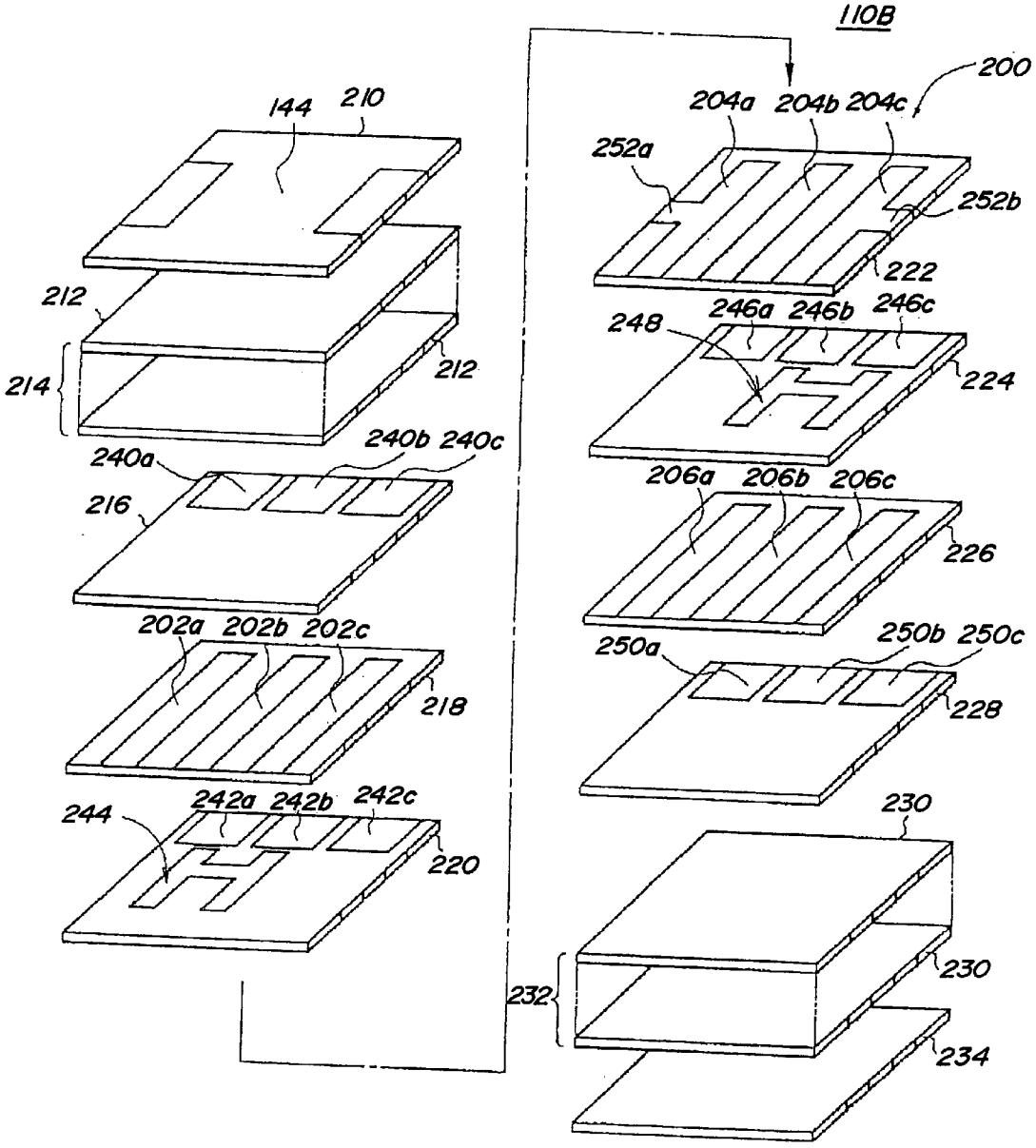
FIG. 31 is a schematic view showing a twentieth embodiment of the laminated type dielectric filter according to the present invention.

FIGS. 31 to 34 show a twentieth embodiment of the laminated type dielectric filter according to the present invention. The laminated type dielectric filter 110B of this embodiment, as shown in FIG. 31, has three sets of resonating elements 202*a*, 204*a*, 206*a*; 202*b*, 204*b*, 206*b*; 202*c*, 204*c*, 206*c* composing ¼λ type strip line resonators within a laminated body 200 constituted by stacking and sintering plural plate-shape dielectric layers. That is to say, three sets of ¼λ type strip line resonators each composed of three resonating elements stacked in a direction of thickness of the laminated body 200 are aligned in a direction perpendicular to the stacking direction.

The laminated body 200 is composed of a stack of, from its top, a first dielectric layer 210, a dielectric layer group 214 constituted by stacking several second dielectric layers 212, third to ninth dielectric layers 216 to 228, a dielectric layer group 232 constituted by stacking several tenth dielectric layers 230, and an eleventh dielectric layer 234.

Since the structure of an input terminal part 240, an output terminal part 242 and earth electrode 244 is similar to that of the nineteenth embodiment of the laminated type dielectric filter 110A, the detail explanation about the structure is omitted here.

In the laminated type dielectric filter 110B of this embodiment, on an upper surface of the fourth dielectric layer 218, there are formed three rectangular resonating elements 202*a*, 202*b*, 202*c* such that the longitudinal directions of the elements are aligned in one direction, on an upper surface of the sixth dielectric layer 222, there are formed three rectangular resonating elements 204*a*, 204*b*, 204*c* such that their longitudinal directions are aligned in one direction, and on an upper surface of the eighth dielectric layer 226, there are formed three rectangular resonating elements 206*a*, 206*b*, 206*c* such that the longitudinal directions of these elements are aligned in one direction.

Among the above resonating elements, a first stage, i.e. input stage symmetric type strip line resonator is composed of the resonating elements 202*a*, 204*a*, 206*a* near the input terminal 146, and a last stage, i.e. output stage symmetric type strip line resonator is composed of the resonating elements 202*c*, 204*c*, 206*c* near the output terminal 150. One end of each of the above resonating elements is connected to the earth electrode 144, and the other end thereof is opened.

On one main surface of the third dielectric layer 216, there are formed a first interlayer earth electrode 240*a* which is opposed to the open end of the upper input stage resonating element 202*a*, a second interlayer earth electrode 240*b* which is opposed to the open end of the upper middle stage resonating element 202*b*, and a third interlayer earth electrode 240*c* which is opposed to the open end of the upper output stage resonating element 204*c*.

On one main surface of the fifth dielectric layer 220, there are formed a first interlayer earth electrode 242*a* which is opposed to the open ends of the upper and lower input stage resonating elements 202*a* and 204*a*, a second interlayer earth electrode 242*b* which is opposed to the open ends of the upper and lower middle stage resonating elements 202*b* and 204*b*, a third interlayer earth electrode 242*c* which is opposed to the open ends of the upper and lower output stage resonating elements 202*c* and 204*c*, and a coupling electrode 244 which is capacitively coupled with the upper and lower input stage resonating elements 202*a* and 204*a* as well as with the upper and lower middle stage resonating elements 202*b* and 204*b*.

On one main surface of the seventh dielectric layer 224, there are formed a first interlayer earth electrode 246*a* which is opposed to the open ends of the input stage resonating elements 204*a* and 206*a*, a second interlayer earth electrode 246*b* which is opposed to the open ends of the upper and lower middle stage resonating elements 204*b* and 206*b*, a third interlayer earth electrode 246*c* opposite to the open ends of the upper and lower output stage resonating elements 204*c* and 206*c*, and a coupling electrode 248 which is capacitively coupled with the upper and lower input stage resonating elements 204*a* and 206*a* as well as with the upper and lower middle stage resonating elements 204*b* and 206*b*.

On one main surface of the ninth dielectric layer 228, there are formed a first interlayer earth electrode 250*a* which is opposed to the open end of the lower input stage resonating element 206*a*, a second interlayer earth electrode 250*b* which is opposed to the open end of the lower middle stage resonating element 206*b*, and a third interlayer earth electrode 250*c* which is opposed to the open end of the lower output stage resonating element 206*c*.

Particularly, in the laminated type dielectric filter 110B of the twentieth embodiment, the intermediate input stage resonating element 204*a* among the three input stage resonating elements 202*a*, 204*a* and 206*a* arranged vertically is electrically connected to the input terminal 146 through a lead electrode 252*a* in a direct manner, and the intermediate output stage resonating element 204*c* among the three output stage resonating elements 202*c*, 204*c* and 206*c* arranged vertically is electrically connected to the output terminal 150 through a lead electrode 252*b* in a direct manner.

The laminated type dielectric filter 110B of this embodiment has the fundamental structure explained above, and the electrical coupling between the respective electrodes will be described hereinafter with reference to FIGS. 32 to 34.

Figure 32:
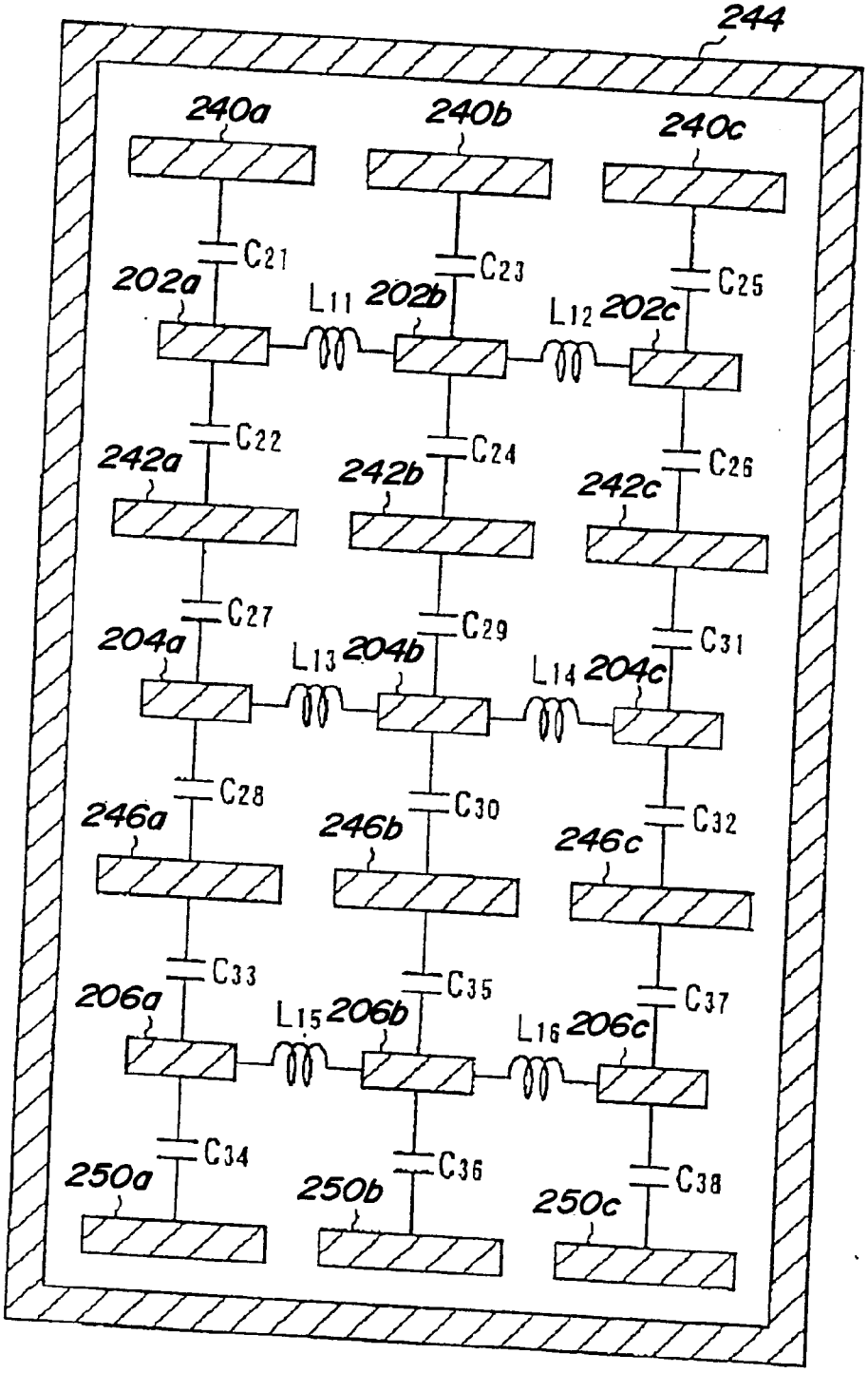
FIG. 32 is a schematic cross sectional view illustrating the filter shown in FIG. 31 cut along a line perpendicular to a surface on which interlayer earth electrodes are formed.

First of all, as shown in FIG. 32, capacitances C21, C22, C23, C24, C25, and C26 are formed between the open end of the upper input stage resonating element 202*a* and the upper and lower first interlayer earth electrodes 240*a* and 242*a*, between the open end of the middle stage resonating element 202*b* and the upper and lower second interlayer earth electrodes 240*b* and 242*b*, and between the open end of the output stage resonating element 202*c* and the upper and lower third interlayer earth electrodes 240*c* and 242*c*, respectively.

The input stage, middle stage and output stage resonating elements 202*a*, 202*b* and 202*c* are inductively coupled with one another, and thereby an inductance L11 is inserted between the resonating elements 202*a* and 202*b*, and an inductance L12 is inserted between the resonating elements 202*b* and 202*c* on an equivalent circuit (refer to FIG. 32).

Capacitances C27, C28, C29, C30, C31, and C32 are formed between the open end of the middle stage resonating element 204*a* and the upper and lower first interlayer earth electrodes 242*a* and 246*a*, between the open end of the middle stage resonating element 204*b* and the upper and lower second interlayer earth electrodes 242*b* and 246*b*, and between the open end of the output stage resonating element 204*c* and the upper and lower third interlayer earth electrodes 242*c* and 246*c*.

The input stage, middle stage and output stage resonating elements 204*a*, 204*b* and 204*c* are inductively coupled with one another, and thereby an inductance L13 is inserted between the resonating elements 204*a* and 204*b* and an inductance L14 is inserted between the resonating elements 204*b* and 204*c* on an equivalent circuit (see FIG. 32).

Capacitances C33, C34, C35, C36, C37, and C38 are formed between the open end of the lower input stage resonating element 206*a* and the upper and lower first interlayer earth electrodes 246*a* and 250*a*, between the open end of the middle stage resonating element 206*b* and the upper and lower second interlayer earth electrodes 246*b* and 250*b*, and between the open end of the output resonating element 206*c* and the upper and lower third interlayer earth electrodes 246*c* and 250*c*, respectively.

The input stage, middle stage and output stage resonating elements 206*a*, 206*b* and 206*c* are inductively coupled with one another, and thereby an inductance L15 is inserted between the resonating elements 206*a* and 206*b* and an inductance L16 is inserted between the resonating elements 206*b* and 206*c* on an equivalent circuit (refer to FIG. 32).

Figure 33:
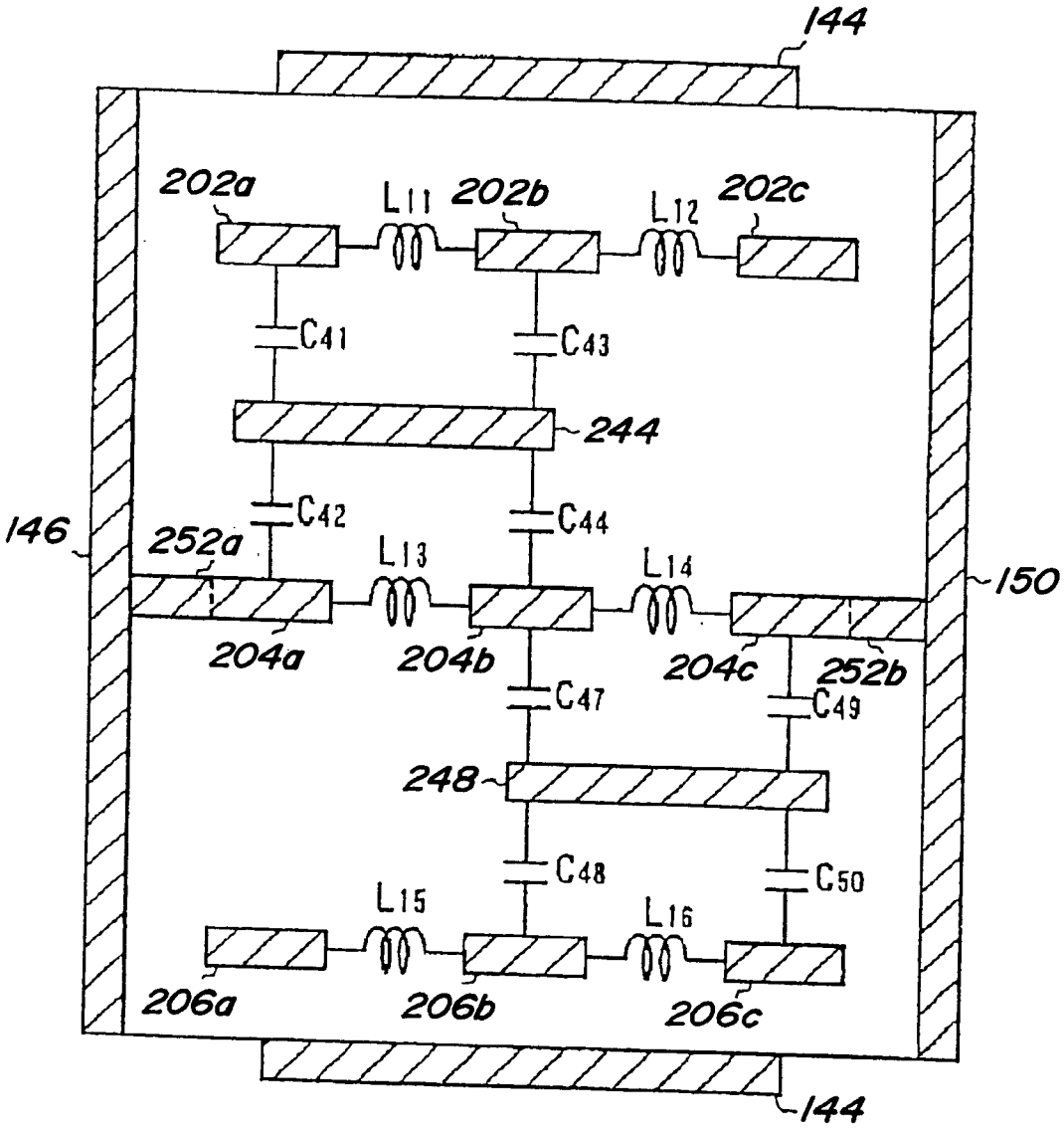
FIG. 33 is a schematic cross sectional view depicting the filter illustrated in FIG. 31 cut along a line perpendicular to a surface on which lead electrodes are formed.

Moreover, as illustrated in FIG. 33, capacitances C41, C42, C43, and C44 are formed between the upper coupling electrode 244 and the upper and lower input stage resonating elements 202*a* and 204*a*, and between the coupling electrode 244 and the middle stage resonating elements 202*b* and 204*b*, respectively.

Similarly, capacitances C47, C48, C49 and C50 are formed between the lower coupling electrode 248 and the upper and lower middle stage resonating elements 204*b*, 206*b*, and between the coupling electrode 248 and the output stage resonating elements 204*c* and 206*c*, respectively.

Also in this case, like as the above nineteenth embodiment of the laminated type dielectric filter 110A, all the input stage resonating elements 202*a*, 204*a*, 206*a* are considered to constitute the input stage resonator 400*a* (refer to FIG. 34), all the middle stage resonating elements 202*b*, 204*b*, 206*b* are considered to compose the middle stage resonator 400*b*, and all the output stage resonating elements 202*c*, 204*c*, 206*c* are considered to constitute the output stage resonator 400*c*.

Figure 34:
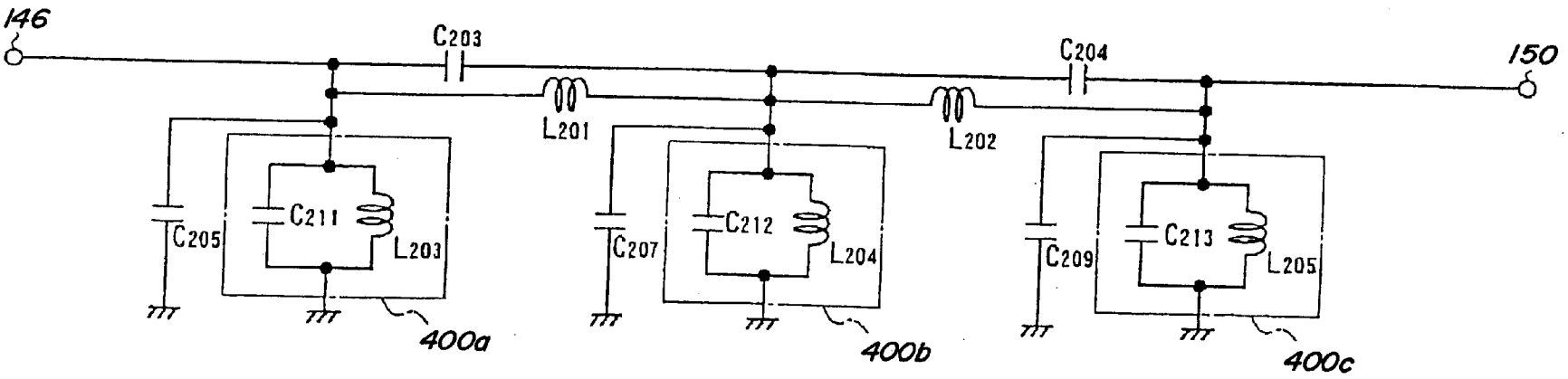
FIG. 34 is an equivalent circuit of the filter shown in FIG. 31.

Thus, the equivalent circuit of the twentieth embodiment of the laminated type dielectric filter constitutes the band pass filter as shown in FIG. 34.

Hereupon, in FIG. 34, a capacitance C203 is a combined capacitance of the capacitances C41, C42 between the input stage resonating elements 202*a*, 204*a* and the coupling electrode 162 (see FIG. 33) and the capacitances C43, C44 between the middle stage resonating elements 202*b*, 204*b* and the coupling electrode 162. A capacitance C204 is a combined capacitance of the capacitances C47, C48 between the middle stage resonating elements 204*b*, 206*b* and the coupling electrode 164 (refer to FIG. 33) and the capacitances C49, C50 between the output stage resonating elements 204*c*, 206*c* and the coupling electrode 164.

An inductance L201 is a combined inductance of the inductances L11, L13, and L15 between the input stage resonating elements 202*a*, 204*a*, 206*a* and the middle stage resonating elements 202*b*, 204*b*, 206*b* (refer to FIG. 33), and an inductance L202 is a combined inductance of the L12, L14 and L16 between the middle stage resonating elements 202*b*, 204*b*, 206*b* and the output stage resonating elements 202*c*, 204*c*, 206*c* (see FIG. 33).

Moreover, a capacitance C205 is a combined capacitance of the capacitances C21, C22, C27, C28, C33, C34 between each of the input stage resonating elements 202*a*, 204*a*, 206*a* and each of the first interlayer earth electrode 240*a*, 242*a*, 246*a*, 250*a* (refer to FIG. 32), and a capacitance C207 is a combined capacitance of the capacitances C23, C24, C29, C30, C35, C36 between each of the middle stage resonating elements 202*b*, 204*b*, 206*b* and each of the second interlayer earth electrode 240*b*, 242*b*, 246*b*, 250*b* (see FIG. 32). Furthermore, a capacitance C209 is a combined capacitance of the capacitances C25, C26, C31, C32, C37, C38 between each of the output stage resonating elements 202*c*, 204*c*, 206*c* and each of the third interlayer earth electrode 240*c* 242*c*, 246*c*, 250*c* (see FIG. 32).

Then, capacitance C211 and inductance L203 are equivalently converted capacitance and inductance of the input stage resonator 400*a*, capacitance C212 and inductance L204 are equivalently converted capacitance and inductance of the middle stage resonator 400*b*, and capacitance C213 and inductance L205 are equivalently converted capacitance and inductance of the output stage resonator 400*c*.

As above mentioned, in the twentieth embodiment of the laminated type dielectric filter 110B, the coupling electrodes 244 and 248 are formed on one main surfaces of the fifth and seventh dielectric layers 220 and 224, respectively, and thus by controlling the capacitances C41 to C44 and C47 to C50, the degree of the inductive couplings between the resonating elements 202*a*, 202*b*, between the resonating elements 204*a*, 204*b*, between the resonating elements 204*b*, 204*c*, and between the resonating elements 206*b*, 206*c* can be adjusted, and the filter having a desired pass band width can be obtained.

Moreover, in the laminated type dielectric filter 110B of this embodiment, only the intermediate resonating element 204*a* among the three input stage resonating elements 202*a*, 204*a*, 206*a* positioned vertically is directly connected to the input terminal 146 through the lead electrode 252*a*, and only the intermediate resonating element 204*c* among the three output stage resonating elements 202*c*, 204*c*, 206*c* positioned vertically is directly connected to the output terminal 150 through the lead electrode 252*b*. Therefore, the impedance of the input stage resonator 400*a* viewed from the input terminal and the impedance of the output stage resonator 400*c* become high, and therefore the input impedance and output impedance can be adjusted over a wide range. Consequently, the adjustment for increasing the return loss can be easily performed, and it is possible to make the filter small in size and to lower the pass band frequency and insertion loss.

Moreover, in the twentieth embodiment of the laminated type dielectric filter 110B, the first to third interlayer earth electrodes 240*a* to 240*c*; 242*a* to 242*c*; 246*a* to 246*c* and 250*a* to 250*c* are formed on one main surfaces of the third, fifth, seventh, and ninth dielectric layers 216, 220, 224, and 228, respectively. Thus, the combined capacitances C205, C207, and C209 are coupled to the capacitances C211, C212, and C213 of the resonators 400*a*, 400*b*, and 400*c* when equivalently converting the resonating elements 202*a* to 202*c*, 204*a* to 204*c*, and 206*a* to 206*c*. Consequently, if the resonators 400*a*, 400*b*, 400*c* have the same resonating frequency, their inductance becomes small, and thus the resonating elements 202*a* to 202*c*, 204*a* to 204*c*, and 206*a* to 206*c* can be shortened and a length of the whole filter 110B of the twentieth embodiment can be shortened.

The degree of the inductive couplings between the resonating elements 202*a*, 202*b*, between the resonating elements 204*a*, 204*b*, between the resonating elements 204*b*, 204*c*, and between the resonating elements 206*b*, 206*c* can be adjusted, and the filter having a desired pass band width can be obtained.

Moreover, in the laminated type dielectric filter 110B of this embodiment, only the intermediate resonating element 204*a* among the three input stage resonating elements 202*a*, 204*a*, 206*a* positioned vertically is directly connected to the input terminal 146 through the lead electrode 252*a*, and only the intermediate resonating element 204*c* among the three output stage resonating elements 202*c*, 204*c*, 206*c* positioned vertically is directly connected to the output terminal 150 through the lead electrode 252*b*. Therefore, the impedance of the input stage resonator 400*a* viewed from the input terminal and the impedance of the output stage resonator 400*c* become high, and therefore the input impedance and output impedance can be adjusted over a wide range. Consequently, the adjustment for increasing the return loss can be easily performed, and it is possible to make the filter small in size and to lower the pass band frequency and insertion loss.

Moreover, in the twentieth embodiment of the laminated type dielectric filter 110B, the first to third interlayer earth electrodes 240*a* to 240*c*; 242*a* to 242*c*; 246*a* to 246*c* and 250*a* to 250*c* are formed on one main surfaces of the third, fifth, seventh, and ninth dielectric layers 216, 220, 224, and 228, respectively. Thus, the combined capacitances C205, C207, and C209 are coupled to the capacitances C211, C212, and C213 of the resonators 400*a*, 400*b*, and 400*c* when equivalently converting the resonating elements 202*a* to 202*c*, 204*a* to 204*c*, and 206*a* to 206*c*. Consequently, if the resonators 400*a*, 400*b*, 400*c* have the same resonating frequency, their inductance becomes small, and thus the resonating elements 202*a* to 202*c*, 204*a* to 204*c*, and 206*a* to 206*c* can be shortened and a length of the whole filter 110B of the twentieth embodiment can be shortened.

This invention is not limited to the above mentioned embodiments, but various alternations and modifications may be conceived. For example, although the filters in the above embodiments have two symmetric type strip line resonators each including two resonating elements or three symmetric type strip line resonators each including two resonating elements or three symmetric type strip line resonators each including three resonating elements, the number of the resonating element constituting each of the symmetric type strip line resonators is not limited to two or three, but may be four or more. Moreover, the number of the symmetric type strip linc resonators is not limited to two or three and may be four or more.

Furthermore, since various kinds of electrodes may be arranged to be opposed to the resonating elements via the dielectric layers to form capacitances therebetween, the shape and arrangement of the input and output electrodes and coupling electrodes and the number of the coupling electrodes may be modified in various ways.

In the embodiments in which all the resonating elements are sandwiched with the interlayer earth electrodes, only a part of the resonating elements may be sandwiched with the interlayer earth electrodes.

As above mentioned, since in the laminated type dielectric filter according to the present invention, two or more than two symmetric type strip line resonators each having two or more than two resonating elements opposed to each other via the dielectric layers are provided, the characteristic impedance of the respective resonators can be increased so that the coupling degree per unit volume of the filter can be increased and the filter characteristics can be improved.

Moreover, since at least one kind of electrodes among the interlayer earth electrode, coupling electrode for coupling adjacent symmetric type strip line resonators, input electrode for coupling the input terminal to the first stage symmetric type strip line resonator, and output electrode for coupling the last stage symmetric strip line resonator to the output terminal is provided between at least two adjacent resonating elements constituting each of the symmetric type strip line resonators via the dielectric layers, the capacitance between the resonating elements and the electrodes can be increased. Thus, the laminated type dielectric filter can be made small in size and light in weight, and the pass band frequency and insertion loss of the filter can be lowered. Moreover, the pass band width of the filter can be adjusted over a wide range.

Particularly, when the coupling between the resonators is capacitive, the pass band width of the filter tends to be too narrowed as the pass band frequency of the filter is lowered. However, according to the invention, the pass band width of the filter can be broadened by increasing the capacitances between the coupling electrodes and the resonating elements. When the coupling is inductive, the pass band width is liable to be too broadened, but according to the invention, the pass band width can be narrowed by increasing the capacitances between the coupling electrodes and the resonating elements. On the other hand, since the capacitances between the resonating elements and the coupling elements can be easily decreased, the pass band width can be adjusted over a wide range. In this way, the present invention can propose the laminated type dielectric filter which can satisfy various requirements.

In the embodiments of the filter, in which the resonating element of the symmetric type strip line resonators is sandwiched with the interlayer earth electrodes, the capacitances between the resonating elements and the interlayer earth electrodes can be increased. Therefore, the pass band frequency can be lowered without making the size of the filter larger than that of the conventional filter. If the pass band frequency of the filter is identical with that of the conventional filter, the filter can be made small in size. Moreover, since the capacitances between the resonating elements and the interlayer earth electrodes can be easily decreased, the pass band of the filter can be adjusted over a wide range. In this way, the present invention can propose the laminated type dielectric filter which can satisfy various requirements.

In the embodiments of the filter in which the coupling electrode for coupling adjacent symmetric type strip line resonators is sandwiched with the resonating elements composing the resonators, the capacitances between the resonating elements and the coupling electrode can be increased. Then, the pass band width can be broadened in the case of the capacitive coupling and can be narrowed in the case of the inductive coupling without making the size of the filter large. On the other hand, since the capacitances between the resonating elements and the coupling elements can be easily decreased, the adjustable range for the pass band width can be widened. In this way, the present invention can provide the laminated type dielectric filter which can satisfy various requirements.

Moreover, in general, when the pass band frequency is lowered by sandwiching the resonating elements of the symmetric type strip line resonators with the interlayer earth electrodes like as the embodiment shown in FIG. 7, the pass band width is liable to be narrowed. However, according to the invention, by increasing the capacitances between the resonating elements and the coupling electrodes, the pass band width can be broadened when the coupling between the resonators is capacitive. Therefore, the pass band frequency can be effectively lowered without narrowing the pass band width.

Furthermore, in the embodiment of the filter in which at least one resonating element among plural resonating elements constituting the input stage symmetric type strip line resonator is not directly connected to the input terminal and at least one resonating element among plural resonating elements constituting the output stage symmetric type strip line resonator is not directly connected to the output terminal, the input and output impedance can be adjusted over a wide range. Therefore, the filter size can be decreased, the band pass frequency can be lowered, the insertion loss can be reduced and the return loss can be increased in an effective manner.

What is claimed is:

1. A laminated type dielectric filter comprising:

an earth electrode substantially surrounding an outer surface of the laminated type dielectric filter;

a resonator means including at least a first stage symmetric type strip line resonator and a last stage symmetric type strip line resonator, each of said resonators having at least two resonating elements which have substantially the same configuration and are stacked one on the other with interposing a dielectric therebetween, and are aligned in a stacking direction in which said resonator elements are stacked, said resonators being aligned in a direction perpendicular to said stacking direction;

an input means having an input terminal coupled with said first stage symmetric type strip line resonator;

an output means having an output terminal coupled with said last stage symmetric type strip line resonator;

plural interlayer earth electrodes connected to the earth electrode; and a coupling electrode coupling said plural symmetric type strip line resonators of the resonator means with each other;

wherein said resonating elements, earth electrode interlayer earth electrodes, and coupling electrode are mutually separated by means of dielectric layers.

2. A laminated type dielectric filter as claimed in claim 1, wherein said input means and output means have at least one input electrode and output electrode connected to the input terminal and the output terminal, respectively, and at least one kind of electrode among the interlayer earth electrode, coupling electrode, input electrode and output electrode is provided between at least two adjacent resonating elements of each of said symmetric type strip line resonators via dielectric layers.

3. A laminated type dielectric filter as claimed in claim 2, wherein said plural interlayer earth electrodes are provided on outer sides of the outermost resonating elements of respective symmetric type strip line resonators with interposing dielectric layers therebetween such that the interlayer earth electrodes are opposed to open end portions of the resonating elements.

4. A laminated type dielectric filter as claimed in claim 3, wherein the resonator means has two sets of symmetric type strip line resonators composed of the first and the last stage symmetric type strip line resonators, respectively, each of said two sets of resonators having first and second resonating elements, said input electrode is arranged between said first and second resonating elements of the first stage symmetric type strip line resonator via dielectric layers, and said output electrode is arranged between said first and second resonating elements of said second symmetric type strip line resonator via dielectric layers.

5. A laminated type dielectric filter as claimed in claim 4, wherein interlayer earth electrodes are provided between open ends of the first and the second resonating elements composing said first stage and last stage symmetric type strip line resonators via dielectric layers.

6. A laminated type dielectric filter as claimed in claim 4, wherein a coupling electrode for coupling said first stage and last stage symmetric type strip line resonators with each other is provided between the first and the second resonating elements of the first stage and last stage symmetric type strip line resonators via dielectric layers.

7. A laminated type dielectric filter as claimed in claim 4, wherein a coupling electrode for coupling the first and second symmetric type strip line resonators are provided on an outer side of at least one of the first and the second resonating elements of said first stage symmetric type strip line resonator via a dielectric layer and on an outer side of at least one of the first and second resonating elements of the last stage symmetric type strip line resonator via a dielectric layer.

8. A laminated type dielectric filter as claimed in claim 4, wherein another input electrode is arranged on an outer side of one of the resonating elements of the first stage symmetric type strip line resonator via a dielectric layer, and another output electrode is arranged on an outer side of one of the resonating elements of the last stage symmetric type strip line resonator via a dielectric layer.

9. A laminated type dielectric filter as claimed in claim 4, wherein the resonator means includes a middle stage symmetric type strip line resonator arranged between the first stage symmetric type strip line resonator and the last stage symmetric type strip line resonator, each of said resonators includes first and second resonating elements oppositely arranged via dielectric layers, a first couple electrode for coupling the first stage and middle stage symmetric type strip line resonators with each other is provided on an outer side of the first resonating element of the first stage and middle stage symmetric type strip line resonators via dielectric layers, and a second coupling electrode for coupling the middle stage and last stage symmetric type strip line resonators with each other is provided on an outer side of the second resonating element of the middle stage and last stage symmetric type strip line resonators via dielectric layers.

10. A laminated type dielectric filter as claimed in claim 9, wherein interlayer earth electrodes are arranged between the first and second resonating elements of said respective three sets of symmetric type strip line resonators via dielectric layers.

11. A laminated type dielectric filter as claimed in claim 4, wherein the resonator means includes a middle stage symmetric type strip line resonator arranged between the first stage and last stage symmetric type strip line resonators, each of said three sets of resonators has first, second and third resonating elements, the input electrode is arranged between the first and second resonating elements of the first stage symmetric type strip line resonator via dielectric layers, the output electrode is arranged between the second and third resonating elements of the last stage symmetric type strip line resonator via dielectric layers, a first coupling electrode for coupling the first stage and middle stage symmetric type strip line resonators is arranged between the second and third resonating elements of the first stage and middle stage symmetric type strip line resonators, and a second coupling electrode for coupling the middle stage and last stage symmetric type strip line resonators is arranged between the first and second resonating elements of the middle stage and last stage symmetric type strip line resonators via dielectric layers.

12. A laminated type dielectric filter as claimed in claim 11, wherein interlayer earth electrodes are provided between open end portions of the first and second resonating elements of each of said three sets of symmetric type strip line resonators via dielectric layers, as well as between open end portions of the second and third resonating elements of each of said three set symmetric type strip line resonators via dielectric layers.

13. A laminated type dielectric filter as claimed in claim 11, wherein interlayer earth electrodes are arranged between open end portions of the second and third resonating elements of each of said first stage and middle stage symmetric type strip line resonators via dielectric layers, and interlayer earth electrodes are arranged between open end portions of the second and third resonating elements of each of said middle stage and last stage symmetric type strip line resonators via dielectric layers.

14. A laminated type dielectric filter as claimed in claim 13, wherein the input electrode arranged between the first and second resonating elements of the first stage symmetric type strip line resonator via the dielectric layers is extended to a position opposing the open end portions of these resonating elements, and the output electrode arranged between the second and third resonating elements of the last stage symmetric type strip line resonator via the dielectric layers is extended to a position opposing the open end portions of these resonating elements.

15. A laminated type dielectric filter as claimed in claim 13, wherein at least one coupling electrode for coupling adjacent symmetric type strip line resonators is arranged to be sandwiched with the resonating elements via dielectric layers.

16. A laminated type dielectric filter as claimed in claim 15, wherein said resonator means includes two sets of symmetric type strip line resonators composed of said first stage and last stage symmetric type strip line resonators, respectively, each of said resonators having first and second resonating elements, and a single coupling electrode for coupling said resonators with each other is arranged between the first and second resonating elements of each of said resonators via dielectric layers.

17. A laminated type dielectric filter as claimed in claim 15, wherein said resonator means further includes a middle stage symmetric type strip line resonator arranged between said first stage symmetric type strip line resonator and the last stage symmetric type strip line resonator, each of the first stage, middle stage and last stage symmetric strip line resonators includes first, second and third resonating elements, a first coupling electrode for coupling the first stage and middle stage symmetric type strip line resonators with each other is arranged between the first and the second resonating elements of each of said first stage and middle stage resonators via dielectric layers, and a second coupling electrode for coupling the middle stage and last stage symmetric type strip line resonators with each other is arranged between the second and third resonating elements of each of said middle stage and last stage resonators via dielectric layers.

18. A laminated type dielectric filter as claimed in claim 16, wherein another coupling electrode is arranged via a dielectric layer on a side of at least one of said pair of resonating elements which sandwich said coupling electrode via the dielectric layers, said side being opposite to a side which faces with said coupling electrode the dielectric layers.

19. A laminated type dielectric filter as claimed in claim 16, wherein open end portions of all the resonating elements of all the symmetric type strip line resonators are sandwiched with interlayer earth electrodes via dielectric layers.

20. A laminated type dielectric filter as claimed in claim 16, wherein interlayer earth electrodes are arranged on outer sides of open end portions of the resonating elements of all the symmetric type strip line resonators via dielectric layers.

21. A laminated type dielectric filter as claimed in claim 1, wherein said input means includes a tap portion for directly connecting one or more resonating elements of the first stage symmetric type strip line resonator except for at least one resonating element to the input terminal.

22. A laminated type dielectric filter as claimed in claim 21, wherein said input means includes a tap portion for directly connecting only one resonating element among the resonating elements of the first stage symmetric type strip line resonator to said input terminal.

23. A laminated type dielectric filter as claimed in claim 21, wherein said output means includes a tap portion for directly connecting one or more resonating elements of the resonating elements of the last stage symmetric type strip line resonator except for at least one resonating element to said output terminal.

24. A laminated type dielectric filter as claimed in claim 23, wherein said output means includes a tap portion for directly connecting only one resonating element among the resonating elements of the last stage symmetric type strip line resonator to said output terminal.

25. A laminated type dielectric filter as claimed in claim 21, wherein open ends of all the resonating elements of all the symmetric type strip line resonators are sandwiched with interlayer earth electrodes via dielectric layers.

26. A laminated type dielectric filter as claimed in claim 21, wherein interlayer earth electrodes are arranged on outer sides of open end portions of the resonating elements of all the symmetric type strip line resonators.

27. A laminated type dielectric filter as claimed in claim 21, wherein at least one coupling electrode for coupling the first stage and last stage symmetric type strip line resonators with each other is arranged between adjacent resonating elements opposed to each other.

28. A laminated type dielectric filter as claimed in claim 21, wherein said resonator means includes two sets of symmetric type strip line resonators constituting said first stage and last stage symmetric type strip line resonators, each of said resonators includes first and second resonating elements, and the first resonating elements of the first stage and last stage symmetric type strip line resonators are directly connected to the input and the output terminals, respectively by means of tap portions.

29. A laminated type dielectric filter as claimed in claim 28, wherein interlayer earth electrodes are arranged on outer sides of open end portions of the first and second resonating elements of the first stage and last stage symmetric type strip line resonators.

30. A laminated type dielectric filter as claimed in claim 28, wherein the open ends of the first and the second resonating elements of each of said first stage and last stage symmetric type strip line resonators are sandwiched with interlayer earth electrodes via dielectric layers.

31. A laminated type dielectric filter as claimed in claim 28, wherein a coupling electrode for coupling the first stage and last stage symmetric type strip line resonators with each other is arranged on outer sides of at least one of the first and second resonating elements of said symmetric type strip line resonators.

32. A laminated type dielectric filter as claimed in claim 28, wherein a coupling electrode for coupling the first stage and last stage symmetric type strip line resonators with each other is arranged between the first and the second resonating elements of said symmetric type strip line resonators.

33. A laminated type dielectric filter as claimed in claim 21, wherein said resonator means further comprises a middle stage symmetric type strip line resonator interposed between said first stage and last stage symmetric type strip line resonators, each of said first stage, middle stage and last stage symmetric strip line resonators having first, second and third resonating elements, a tap portion formed on the second resonating element of the first stage symmetric type strip line resonator is directly connected to said input terminal, a tap portion formed on the second resonating element of the last stage symmetric type strip line resonator is directly connected to said output terminal, a first coupling electrode for coupling the first stage and middle stage symmetric type strip line resonators with each other is arranged between the second and third resonating elements of said resonators via dielectric layers, and a second coupling electrode for coupling the middle stage and last stage symmetric strip line resonators with each other is arranged between the first and second resonating elements of said resonators via dielectric layers.

34. A laminated type dielectric filter as claimed in claim 33, wherein interlayer earth electrodes are arranged between open end portions of the first and second resonating elements of each of said symmetric type strip line resonators via dielectric layers, and interlayer earth electrodes are arranged between open end portions of the second and third resonating elements of each of said symmetric type strip line resonators via dielectric layers.

35. A laminated type dielectric filter comprising:

an earth electrode substantially surrounding an outer surface of the laminated type dielectric filter;

a resonator means including three sets of symmetric type strip line resonators constituting first stage, middle stage and last stage symmetric type strip line resonators, each of said resonators having first, second and third resonating elements which are stacked one another via dielectric layers, one end of the resonating elements of said resonators being connected to the ear electrode, the other end of said resonators being opened, and said resonators being aligned in a direction perpendicular to a stacking direction;

an input terminal directly connected to a tap portion formed on the second resonating elements of the first stage symmetric type strip line resonator;

an output terminal directly connected to a tap portion formed on the second resonating element of the last stage symmetric type strip line resonator;

twelve interlayer earth electrodes arranged such that open end portions of all the resonating elements of all three sets of symmetric type strip line resonators are sandwiched with the interlayer earth electrodes via dielectric layers, said interlayer earth electrodes being connected to said earth electrodes;

a first coupling electrode for coupling said first stage and middle stage symmetric type strip line resonators with each other, said first coupling electrode being arranged between the first and the second resonating elements of said first stage and middle stage symmetric type strip line resonators via dielectric layers; and a second coupling electrode for coupling said middle stage and last stage symmetric type strip line resonators with each other arranged, said second coupling electrode being arranged between the second and third resonating elements of said resonators via dielectric layers.

* * * * *